US010500867B2

(12) United States Patent
Sawadaishi et al.

(10) Patent No.: US 10,500,867 B2
(45) Date of Patent: Dec. 10, 2019

(54) LIQUID TANK

(71) Applicant: SEIKO EPSON CORPORATION, Tokyo (JP)

(72) Inventors: Makoto Sawadaishi, Shiojiri (JP); Naomi Kimura, Okaya (JP); Shoma Kudo, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/117,438

(22) Filed: Aug. 30, 2018

(65) Prior Publication Data

US 2019/0061363 A1 Feb. 28, 2019

(30) Foreign Application Priority Data

Aug. 31, 2017 (JP) ..... 2017-166851

(51) Int. Cl.
*B41J 2/175* (2006.01)
*B41J 29/13* (2006.01)

(52) U.S. Cl.
CPC ..... *B41J 2/17553* (2013.01); *B41J 2/175* (2013.01); *B41J 2/1752* (2013.01); *B41J 2/17513* (2013.01); *B41J 2/17523* (2013.01); *B41J 2/17596* (2013.01); *B41J 29/13* (2013.01)

(58) Field of Classification Search
CPC ..... B41J 2/17553; B41J 29/13; B41J 2/175; B41J 2/1752; B41J 2/17513; B41J 2/17596; B41J 2/17523
See application file for complete search history.

(56) References Cited

U.S. PATENT DOCUMENTS

| | | | | |
|---|---|---|---|---|
| 6,257,712 | B1 | 7/2001 | Haigo | |
| 7,360,877 | B2 | 4/2008 | Ikezaki et al. | |
| 10,166,780 | B2 * | 1/2019 | Shinoda | B41J 2/16508 |
| 2004/0189756 | A1 | 9/2004 | Ikezaki et al. | |
| 2010/0188467 | A1 | 7/2010 | Hyakudome et al. | |
| 2015/0210581 | A1 * | 7/2015 | Sorg | C03B 5/2375 432/217 |
| 2015/0367648 | A1 * | 12/2015 | Kimura | B41J 2/17509 347/86 |
| 2018/0016147 | A1 * | 1/2018 | Kwon | B01J 23/75 |
| 2018/0056662 | A1 * | 3/2018 | Shinoda | B41J 2/16508 |
| 2019/0061360 | A1 * | 2/2019 | Yokoi | B41J 2/1752 |

FOREIGN PATENT DOCUMENTS

JP 4259158 B2 2/2009

* cited by examiner

*Primary Examiner* — Huan H Tran
(74) *Attorney, Agent, or Firm* — Foley & Lardner LLP

(57) ABSTRACT

Provided is a technique for reducing the likelihood of air bubbles flowing to a liquid ejection head, in a liquid tank mounted on a carriage. The liquid tank mounted on the carriage movable in a Y direction includes a liquid chamber, a liquid inlet port, an atmospheric air introduction portion, a liquid outlet, and a division wall arranged in the liquid chamber. The division wall has first division walls perpendicular to the Y direction in a mounted state on the carriage, and the liquid chamber includes a plurality of small liquid chambers partitioned by the first division walls, an upper communication portion allowing the small liquid chambers to be in communication with each other, and a lower communication portion positioned below the upper communication, and allowing the small liquid chambers to be in communication with each other.

15 Claims, 32 Drawing Sheets

LIQUID TANK

CROSS REFERENCE TO RELATED APPLICATIONS

The present application claims priority from Japanese Patent Application No. 2017-166851 filed on Aug. 31, 2017, the contents of which are hereby incorporated by reference into this application.

BACKGROUND

1. Technical Field

The present invention relates to a technique of a liquid tank.

2. Related Art

Heretofore, there are known techniques in which a wall orthogonal to the direction of reciprocal movement of a carriage (also simply referred to as a "direction of movement") is provided within a sub tank on the carriage so as to mitigate foaming of ink caused by rippling of the ink liquid surface that accompanies reciprocal movement of the carriage (e.g., JP-4259158).

JP-4259158 is an example of related art.

In previous techniques, when ink flows out from an ink chamber on the downstream side to a head from among two ink chambers partitioned by a wall orthogonal to the direction of movement of a carriage, the ink moves over the upper edge of the wall from the ink chamber on the upstream side, and is supplied to an upper space of the ink chamber on the downstream side in which the amount of ink has decreased. Accordingly, there are cases where ink in which air is trapped and contains air bubbles is supplied to the head. Therefore, an ink discharge error may be caused by air bubbles flowing to the head side. Thus, conventionally, there have been demands for a technique that can reduce the likelihood of air bubbles flowing to the head side. Moreover, the above issue is not limited to a sub tank that is mounted on a carriage, and applies to a liquid tank that is mounted on a carriage that can move in a predetermined direction.

SUMMARY

The invention has been made in order to solve at least a portion of the above-described issue, and can be realized as the following modes or application examples.

(1) According to a mode of the invention, a liquid tank that is mounted on a carriage that has a liquid ejection head and can move in a Y direction, and can contain liquid to be supplied to the liquid ejection head is provided. This liquid tank includes a liquid chamber that can contain the liquid, a liquid inlet port through which the liquid can be injected into the liquid chamber, an atmospheric air introduction portion for introducing atmospheric air into the liquid chamber, a liquid outlet provided in a bottom face of the liquid chamber, and a division wall arranged in the liquid chamber. The division wall has first division walls perpendicular to the Y direction in a mounted state in which the liquid tank is mounted on the carriage, and the liquid chamber includes a plurality of small liquid chambers partitioned by the first division walls, an upper communication portion that allows the plurality of small liquid chambers to be in communication with each other in the mounted state, and a lower communication portion that is positioned below the upper communication portion in the mounted state, and allows the plurality of small liquid chambers to be in communication with each other.

According to this mode, the plurality of small liquid chambers are in communication with each other through the upper communication portion and lower communication portion positioned at different heights, and thus when the liquid surface of a liquid is lowered by liquid consumption, air moves to an adjacent small liquid chamber via the upper communication portion, and liquid moves to an adjacent small liquid chamber via the lower communication portion. Accordingly, it is possible to suppress movement of liquid in the small liquid chambers over the first division walls. In addition, the volume of a small liquid chamber is smaller than the volume of the entire liquid chamber, and thus it is possible to suppress the rippling of liquid due to movement of the carriage, and thus it is possible to mitigate the generation of air bubbles due to the foaming of liquid. Therefore, it is possible to reduce the likelihood of air bubbles flowing to the liquid ejection head side.

(2) In the above mode, the liquid chamber may have a liquid visual recognition wall that is parallel to the Y direction that is a horizontal direction and a Z direction that is a direction along a gravity direction orthogonal to the Y direction, in the mounted state, and that makes it possible to visually recognize the liquid in the liquid chamber from the outside. According to this mode, a liquid visual recognition wall that makes it possible to visually recognize liquid in the liquid chamber from the outside is provided, and thus the amount of liquid in the liquid chamber is easily recognized. In addition, it is possible to view the surface of liquid in which generation of air bubbles is suppressed by the first division walls, and thus the amount of liquid in the liquid chamber can be more accurately recognized.

(3) In the above mode, the liquid visual recognition wall may have an upper limit sign indicating an upper limit of an amount of the liquid that is contained in the liquid chamber, the upper communication portion may be formed above the upper limit sign in the mounted state, and the lower communication portion may be formed below the upper limit sign in the mounted state. According to this mode, a lower communication portion is formed below the upper limit sign in the mounted state, and thus it is possible to further suppress movement of liquid in the small liquid chambers over the first division walls.

(4) In the above mode, two or more first division walls may be provided, and three or more small liquid chambers may be provided. According to this mode, two or more first division walls are provided, and three or more small liquid chambers are provided, and thus the volume of the small liquid chambers can be further made smaller than the volume of the entire liquid chamber. Accordingly, it is possible to further suppress the rippling of liquid due to movement of the carriage, and thus it is possible to further suppress generation of air bubbles.

(5) In the above mode, the division wall may further have a second division wall that is parallel to the Y direction and the Z direction that is a direction along a gravity direction orthogonal to the Y direction, in the mounted state, and partitions the small liquid chambers. According to this mode, the division wall that partitions small liquid chambers includes the second division wall, and thus the volume of the small liquid chambers can further be made smaller than the volume of the entire liquid chamber. Accordingly, it is possible to further suppress the rippling of liquid due to movement of the carriage, and it is possible to further mitigate the generation of air bubbles.

(6) In the above mode, the upper communication portion may be formed by a gap between upper end portions of the first division walls and a ceiling face of the liquid chamber, and the lower communication portion may be formed by lower end recessed portions provided in lower end portions of the first division walls. According to this mode, the upper communication portion and lower communication portion can be easily formed.

(7) In the above mode, the liquid chamber may be formed by a recessed portion formed in a tank body of the liquid tank and a film member that seals an opening of the recessed portion, and the division wall may be a body separate from the recessed portion. According to this mode, compared with a case where the first division walls and the second division wall are not bodies separate from the recessed portion, it is possible to easily form the first division walls and second division wall in the liquid chamber.

(8) In the above mode, the liquid outlet may have a filter member that catches an extraneous material in the liquid. According to this mode, it is possible to suppress the leakage of extraneous materials such as air bubbles using the filter member.

(9) In the above mode, the liquid outlet may be formed between one wall that defines the liquid chamber and is perpendicular to the Y direction and the first division wall. According to this mode, rippling can be suppressed in a region in which the liquid outlet is arranged, and thus it is possible to reduce the likelihood of the liquid outlet coming into contact with air. Accordingly, it is possible to reduce the likelihood of bubbles flowing into the liquid ejection head.

(10) In the above mode, an opposing wall that is positioned above the liquid outlet, is positioned below a ceiling face of the liquid chamber, and is opposed to at least a portion of the liquid outlet, in the mounted state, may further be provided. According to this mode, it is possible to suppress the height of a wave that is formed in an upper portion of the liquid outlet, using the opposing wall. Accordingly, it is possible to further reduce the likelihood of the liquid outlet coming into contact with air, and thus it is possible to further reduce the likelihood of air bubbles flowing into the liquid ejection head.

(11) In the above mode, the opposing wall may be inclined relative to the horizontal direction in the mounted state. According to this mode, air bubbles generated between the filter member and the opposing wall can be easily released in a direction away from the filter member.

(12) In the above mode, the opposing wall may be connected to the first division walls. According to this mode, it is possible to easily provide the opposing wall whose position is fixed, by connecting the opposing wall to the first division wall.

(13) According to another mode of the invention, a liquid tank that is mounted on a carriage that has a liquid ejection head and can move in a Y direction, and can contain liquid to be supplied to the liquid ejection head is provided. This liquid tank includes a liquid chamber that can contain the liquid, a liquid inlet port through which the liquid can be injected into the liquid chamber, an atmospheric air introduction portion for introducing atmospheric air into the liquid chamber, a liquid outlet provided in a bottom face of the liquid chamber, and an opposing wall that is positioned above the liquid outlet and below a ceiling face of the liquid chamber, and is opposed to at least a portion of the liquid outlet, in a mounted state in which the liquid tank is mounted on the carriage. According to this mode, the liquid tank includes the opposing wall that is positioned below the ceiling face of the liquid chamber, and is opposed to at least a portion of the liquid outlet, and thus it is possible to suppress the height of a wave formed in an upper portion of the liquid outlet, using the opposing wall. Accordingly, it is possible to reduce the likelihood of the liquid outlet coming into contact with air, and thus it is possible to reduce the likelihood of air bubbles flowing into the liquid ejection head.

(14) In the above mode, the liquid chamber may have a liquid visual recognition wall that is parallel to the Y direction that is a horizontal direction and a Z direction that is a direction along a gravity direction orthogonal to the Y direction in the mounted state, and that makes it possible to visually recognize the liquid in the liquid chamber from the outside, the liquid visual recognition wall may have a lower limit sign indicating a reference of a lower limit of an amount of the liquid that is contained in the liquid chamber, and at least a portion of the opposing wall opposed to the liquid outlet may be arranged at a position lower than or at the same height as a position of the lower limit sign, in the mounted state. According to this mode, at least a portion of the opposing wall opposed to the liquid outlet is arranged at a position lower than or at the same height as the position of the lower limit sign in the mounted state, and thus liquid can be easily held between the liquid outlet and the opposing wall. Accordingly, exposure of the liquid outlet to air can be suppressed.

(15) In the above mode, the liquid tank may further have a division wall arranged in the liquid chamber, the division wall may have a first division wall perpendicular to the Y direction in the mounted state, the liquid outlet may be formed between a wall face of the liquid chamber orthogonal to the horizontal direction and the first division wall opposed to the wall face in the mounted state. According to this mode, in a region in which the liquid outlet is arranged, rippling can be suppressed, and thus it is possible to reduce the likelihood of the liquid outlet coming into contact with air. Accordingly, it is possible to reduce the likelihood of air bubbles flowing into the liquid ejection head.

The invention can be realized in various modes other than a liquid tank. For example, the invention can be realized as modes such as a method for manufacturing a liquid tank, a liquid ejection apparatus that includes a liquid tank and a liquid ejection head, and the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. Embodiment

A-1. Configuration of Liquid Ejection Apparatus

Figure 1:
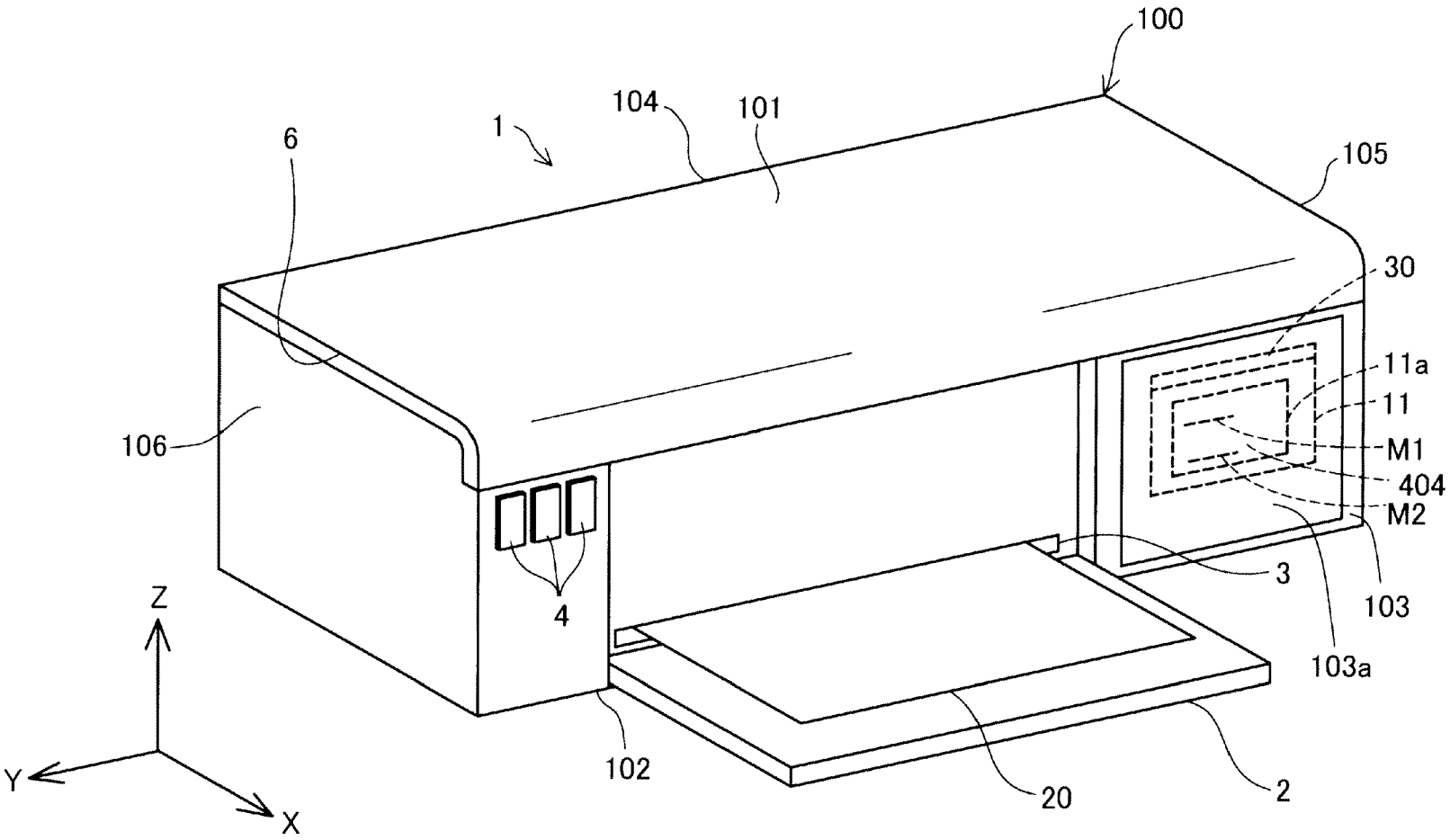
FIG. 1 is an external view of a liquid ejection apparatus that has a liquid tank as a mode of the invention.

FIG. 1 is an external view of a liquid ejection apparatus 1 that has a liquid tank 30 as a mode of the invention. FIG. 1 shows three spatial axes orthogonal to each other, namely, an X axis, a Y axis, and a Z axis. A direction along the X axis is referred to as an "X axis direction" (also simply referred to as an "X direction"), a direction along the Y axis is referred to as a "Y axis direction" (also simply referred to as a "Y direction"), and a direction along the Z axis is referred to as a "Z axis direction" (an up-down direction, also simply referred to as a "Z direction"). The liquid ejection apparatus 1 is installed on a plane parallel to the X axis direction and the Y axis direction (an XY plane). A +Z axis direction is the vertically upward direction, and a −Z axis direction is the vertical downward direction. Also in other drawings to be described below, the X axis, Y axis, and Z axis are added as necessary.

The liquid ejection apparatus 1 is a so-called inkjet printer, and prints on a recording medium such as paper by ejecting ink as a liquid onto the recording medium. The liquid ejection apparatus 1 of this embodiment is a printer that performs monochrome printing using black ink as a liquid.

The liquid ejection apparatus 1 has an outer shell 100 that forms the outer surface. The outer shell 100 has a substantially rectangular parallelepiped shape, and has an upper face (first face, first wall) 101, a lower face (second face, second wall) 102, a front face (third face, third wall) 103, a rear face (fourth face, fourth wall) 104, a right side face (fifth face, fifth wall) 105, and a left side face (sixth face, sixth wall) 106. The upper face 101 is opposed to the lower face 102 in the Z axis direction. The front face 103 is opposed to the rear face 104 in the X axis direction. The right side face 105 is opposed to the left side face 106 in the Y axis direction. The front face 103, the rear face 104, the right side face 105, and the left side face 106 are faces substantially vertical to an installation face of the liquid ejection apparatus 1. The upper face 101 and the lower face 102 are faces substantially horizontal to the installation face of the liquid ejection apparatus 1. Note that, in this embodiment, "substantially vertical" and "substantially horizontal" include "generally vertical" and "generally horizontal" as well as "perfectly vertical" and "perfectly horizontal". Accordingly, those faces 101 to 106 are not perfect flat faces, and allow for irregularities and the like, and it suffices for the faces 101 to 106 to appear "generally vertical" or "generally horizontal".

The liquid ejection apparatus 1 further has a front face cover 2, a discharge port 3, an operation unit 4, and an upper face cover 6. The front face cover 2 constitutes a portion of the front face 103, is axially supported at its lower end portion, and can be opened/closed by pivoting the upper end portion side. In FIG. 1, the front face cover 2 is in an open state. The discharge port 3 is exposed by opening the front face cover 2.

The discharge port 3 is a portion from which a recording medium is discharged. Note that a recording medium may be arranged in a tray provided on the rear face 104 side (not illustrated). Printing on the recording medium is executed by conveying the recording medium arranged on the tray into the outer shell 100 and ejecting liquid onto the recording medium.

The operation unit 4 consists of buttons that accept various operations from the user. For example, the various operations include an operation of starting printing of the liquid ejection apparatus 1, and an operation for executing a discharging operation for discharging fluid in a liquid tank to the outside, which will be described later.

The upper face cover 6 constitutes the upper face 101. The end portion of the upper face cover 6 on the rear face 104 side is axially supported, and the upper face cover 6 can be opened/closed by pivoting the front face 103 side. By opening the upper face cover 6, it is possible to check the internal state of the liquid ejection apparatus 1, perform a mounting/removing operation on the liquid tank, which will be described later, and inject liquid into the liquid tank.

A window portion 103*a* of the apparatus is formed in a region in the front face 103 overlapping a home position of a carriage 19 in the Y axis direction (the direction of reciprocal movement of the carriage 19 to be described later). In this embodiment, the window portion 103*a* of the apparatus is arranged at a position different from that of the front face cover 2, and is arranged on the −Y axis direction side relative to the front face cover 2. The window portion 103*a* of the apparatus is provided with a front face 404 of the liquid tank 30 mounted on the carriage 19 positioned at the home position. The front face 404 is a liquid visual recognition wall that makes it possible to visually recognize the liquid in a second liquid chamber 52 from the outside. In addition, an upper limit sign M1 and a lower limit sign M2 are provided in the front face 404. For example, the window portion 103*a* of the apparatus may be a through hole that penetrates the front face 103, or may be a transparent member. The upper limit sign M1 and the lower limit sign M2 are elements for indicating references for the level of liquid contained in the liquid tank 30, and, in this embodiment, the upper limit sign M1 indicates a reference of an upper limit, and the lower limit sign M2 indicates a reference of a lower limit. The upper limit sign M1 and the lower limit sign M2 will be described later in detail. Note that as long as the front face 404 of the liquid tank 30 at the home position can be visually recognized from the outside, the window portion 103*a* of the apparatus does not need to be provided in the front face 103. For example, the window portion 103*a* of the apparatus may be provided in the upper face 101. In this case, the user can visually recognize the front face 404 of the liquid tank 30 by visually recognizing the window portion 103*a* of the apparatus from above and front on.

Figure 2:
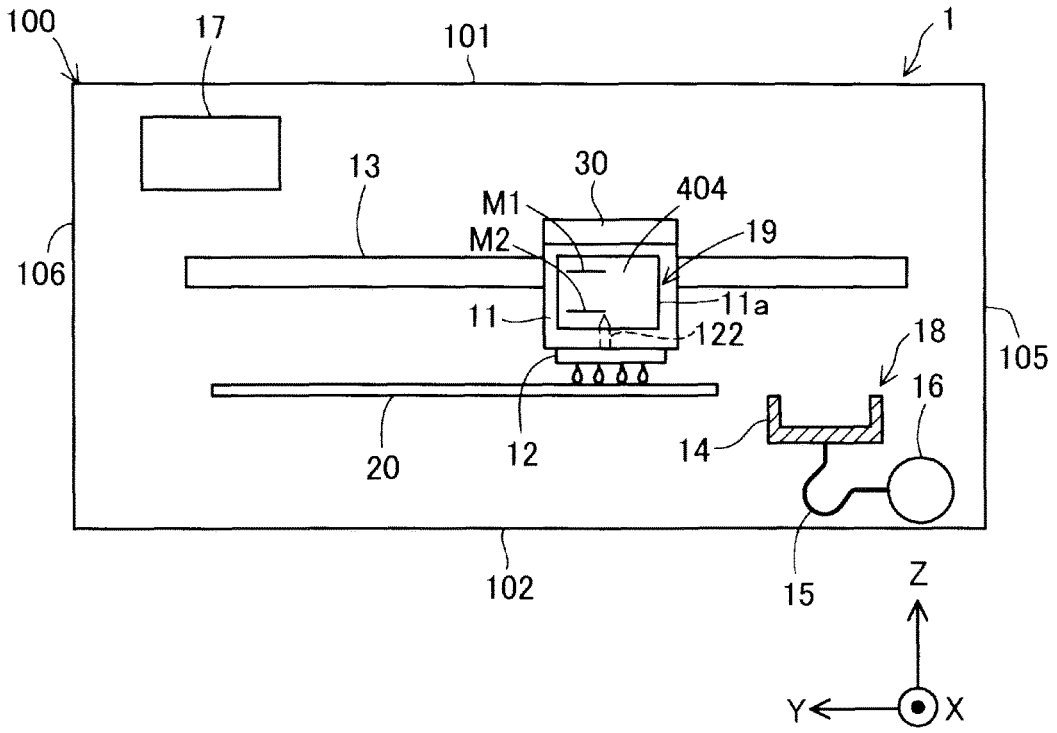
FIG. 2 is a schematic diagram showing the internal configuration of a liquid ejection apparatus.

FIG. 2 is a schematic diagram showing the internal configuration of the liquid ejection apparatus 1. The liquid ejection apparatus 1 has, inside the outer shell 100, a control unit 17, the carriage 19 provided with a liquid ejection head 12, and the liquid tank 30 that is detachably mounted on the carriage 19. The control unit 17 controls various operations of the liquid ejection apparatus 1 (e.g., a printing operation).

The carriage 19 has a mounting portion 11 arranged on the liquid ejection head 12. For example, the mounting portion 11 has a recessed shape that is open in the +Z axis direction, and forms a mounting space in which the liquid tank 30 is mounted. The mounting portion 11 has a liquid introduction needle portion 122 protruding in the +Z axis direction from a lower face that defines the mounting space. The liquid introduction needle portion 122 is connected to the liquid tank 30. The liquid introduction needle portion 122 is hollow, and a communication hole for communication with the inside of the liquid introduction needle portion 122 is formed on the tip end side thereof. Liquid that is supplied from the liquid tank 30 via the communication hole of the liquid introduction needle portion 122 flows inside the liquid introduction needle portion 122. The liquid ejection head 12 is in communication with the liquid introduction needle portion 122, and ejects liquid (in this embodiment, black ink) supplied from the liquid tank 30 toward a recording medium 20 (e.g., printing paper).

In addition, the mounting portion 11 has a window portion 11*a* of the mounting portion for the user to visually recognize the front face 404 including the upper limit sign M1 and the lower limit sign M2. The window portion 11*a* of the mounting portion is provided at least at a position opposed to the upper limit sign M1 and the lower limit sign M2 of the liquid tank 30. For example, the window portion 11*a* of the mounting portion may be a through hole that penetrates a wall that forms the mounting portion 11, or may be a transparent member. In the case where the carriage 19 is positioned at the home position, the user can visually recognize the front face 404 with the upper limit sign M1 and the lower limit sign M2 via the window portion 103*a* of the apparatus (FIG. 1) and the window portion 11*a* of the mounting portion.

The carriage 19 including the liquid ejection head 12 is driven by a driving mechanism (not illustrated), and repeats reciprocal movement above the recording medium 20 while being guided by a guide rail 13 extending in the Y axis direction. Accordingly, the carriage 19 can move in the Y direction. In addition, the liquid ejection apparatus 1 has a conveyance mechanism for conveying the recording medium 20 toward the discharge port 3 (FIG. 1). An image or the like is printed onto the recording medium 20 by ejecting liquid from the liquid ejection head 12 in accordance with the movement of the carriage 19 that reciprocally moves, and movement of conveyance of the recording medium 20.

The liquid tank 30 contains liquid to be supplied to the liquid ejection head 12. In this embodiment, the contained liquid is black ink, and is ink in which pigment particles are dissolved in a solvent. The liquid tank 30 is detachably connected to the liquid introduction needle portion 122. By connecting the liquid tank 30 to the liquid introduction needle portion 122, liquid in the liquid tank 30 can flow to the liquid introduction needle portion 122.

The liquid ejection apparatus 1 further has a discharge portion 18 that executes an operation (discharging operation) of periodically sucking out a fluid (e.g., liquid or air) from the liquid ejection head 12.

The discharge portion 18 is arranged inside the outer shell 100. The discharge portion 18 includes a cap 14, a suction tube 15, and a suction pump 16. While the liquid ejection apparatus 1 is not performing a printing operation, the carriage 19 is arranged at the home position that is out of a movement region of a printing operation.

The cap 14 is a member arranged below the home position and shaped like a bottomed box. The cap 14 can move in the Z axis direction (the up-down direction) due to an elevation mechanism (not illustrated). The cap 14 presses against the lower face of the liquid ejection head 12 by moving upward. Accordingly, the cap 14 forms a closed space such that nozzle holes formed in the lower face of the liquid ejection head 12 are covered (a closed space state). It is possible to suppress the drying of ink in the liquid ejection head 12 (nozzles) using this closed space.

The suction tube 15 allows the cap 14 (specifically, a through hole formed in the bottom face of the cap 14) and the suction pump 16 to be in communication with each other. The suction pump 16 sucks fluid (liquid or air) in the liquid ejection head 12 or the liquid tank 30 via the suction tube 15 by being driven in the closed space state. Initial filling of the liquid ejection head 12 with liquid can be performed in this manner, and deteriorated liquid (dried and thickened liquid) in the liquid ejection head 12 can be sucked out.

A-2. Overview of Liquid Tank

Figure 3:
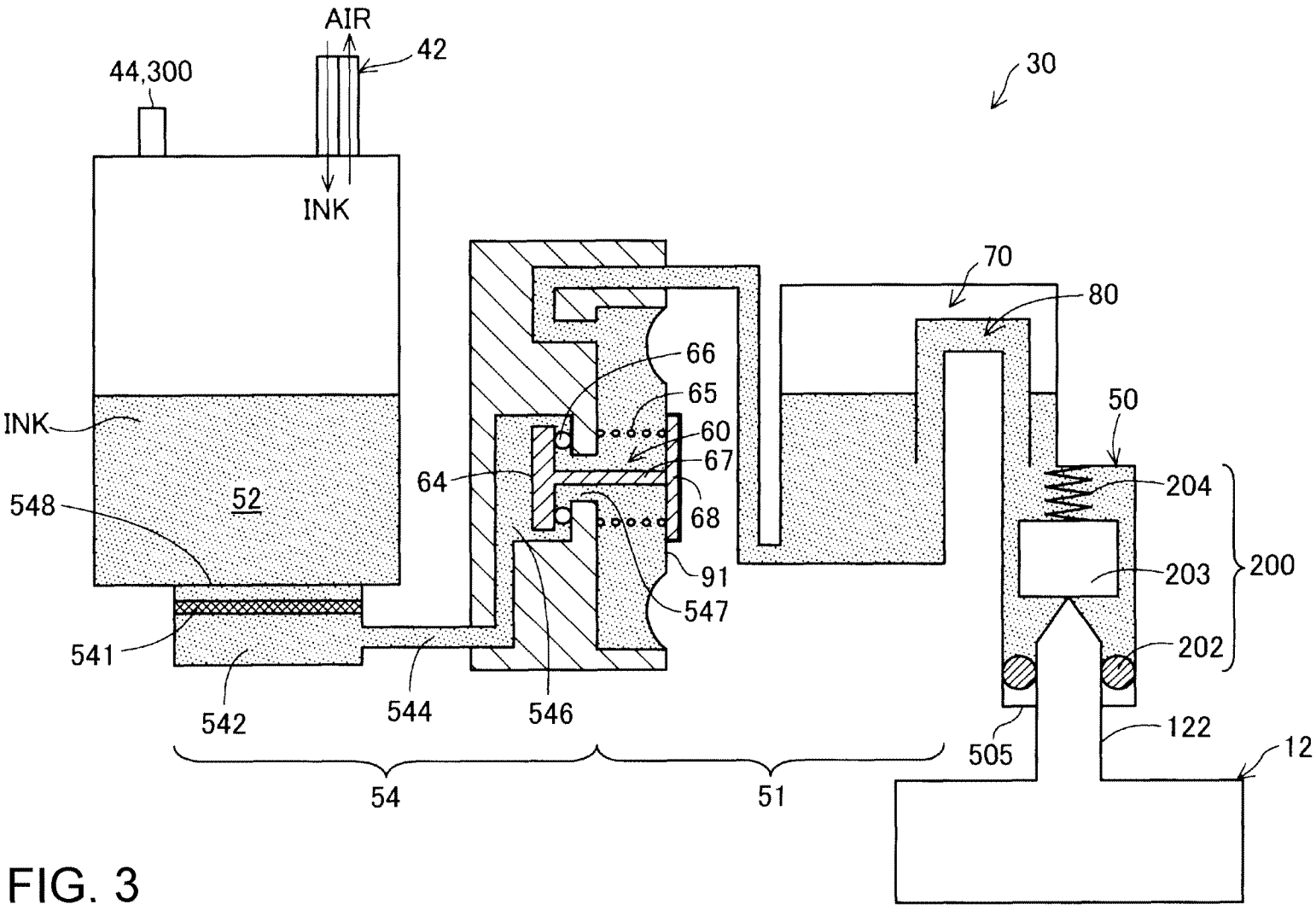
FIG. 3 is a conceptual diagram for describing mainly the channel configuration of a liquid tank.

FIG. 3 is a conceptual diagram for describing mainly the channel configuration of the liquid tank 30. Before describing a detailed configuration of the liquid tank 30, the liquid tank 30 is schematically described below with reference to FIG. 3. In addition, the "upstream side" and the "downstream side" that are used in the following description are based on the direction in which liquid flows from the liquid tank 30 toward the liquid ejection head 12. Note that, in FIG. 3, regions in which liquid exists are indicated by dots.

The liquid tank 30 includes, as a channel through which liquid flows, the second liquid chamber 52, a connection channel 54, a first liquid chamber 51, a liquid communication channel 80, and a liquid supply portion 50 from the upstream side in the stated order. The liquid tank 30 also includes an air communication channel 70 as a channel through which air flows.

Liquid can be injected into the second liquid chamber 52 from the outside through a liquid inlet port 42. In addition, the second liquid chamber 52 is in communication with atmospheric air due to an atmospheric air communication portion 300 that includes an atmospheric air release portion 44 as one end. The second liquid chamber 52 can be in communication with the first liquid chamber 51, and contain liquid to be supplied to the first liquid chamber 51, in other words, liquid that is yet to be contained in the first liquid chamber 51. Note that the second liquid chamber 52 corresponds to the "liquid chamber" in the summary of the invention.

The connection channel 54 can connect the first liquid chamber 51 and the second liquid chamber 52 so as to supply liquid in the second liquid chamber 52 to the first liquid chamber 51. The connection channel 54 has a filter chamber 542, an intermediate channel 544, and a valve-arranged chamber 546 from the upstream side in the stated order. The filter chamber 542 as a liquid outlet is formed to be positioned below the second liquid chamber 52, in the mounted state of the liquid tank 30. The filter chamber 542 is connected to the second liquid chamber 52. Specifically, the filter chamber 542 has a liquid outlet 548 that is an opening formed in a bottom face 404*fa* of the second liquid chamber 52. Accordingly, the liquid outlet 548 is connected to the second liquid chamber 52. The filter chamber 542 serving as a liquid outlet is provided in the bottom face 404*fa* of the second liquid chamber 52. A filter member 541 that demarcates the filter chamber 542 on the upstream side and the filter chamber 542 on the downstream side is arranged in the filter chamber 542, and the filter chamber 542 is connected to the second liquid chamber 52 via the filter member 541. The filter member 541 catches extraneous materials (solid materials and air bubbles) in a liquid that flows from the upstream side to the downstream side, and keeps the extraneous materials from flowing downstream. Accordingly, it is possible to reduce the likelihood of extraneous material flowing into the liquid ejection head 12, and thus it is possible to reduce clogging in the liquid ejection head 12 and the occurrence of a liquid ejection error. In addition, due to the filter chamber 542 being arranged on the upstream side relative to the valve-arranged chamber 546, the likelihood of extraneous material flowing into the valve-arranged chamber 546 is reduced. Accordingly, it is possible to reduce the likelihood of a malfunction occurring in an opening/closing operation of a valve mechanism to be described later caused by extraneous material. The filter member 541 is a filter that is formed as a plate-like piece of stainless steel, and has a plurality of pores that allow liquid to pass through and can suppress extraneous materials from passing through. Note that the filter member 541 may be formed by another member, as long as liquid is allowed to pass through and the passing of extraneous materials can be suppressed.

The intermediate channel 544 is a channel that connects the filter chamber 542 and the first liquid chamber 51, and is a channel that allows the filter chamber 542 and the valve-arranged chamber 546 to be in communication with each other. The valve-arranged chamber 546 has an inlet opening portion 547 connected to the first liquid chamber 51. Accordingly, the inlet opening portion 547 forms one end of the connection channel 54 (downstream end). The inlet opening portion 547 forms a through hole whose channel cross-section is circular. A portion of a valve mechanism 60 for controlling the flow of liquid from the second liquid chamber 52 into the first liquid chamber 51 by opening/closing the inlet opening portion 547 is arranged in the valve-arranged chamber 546. Due to the valve mechanism 60 entering an open state, the second liquid chamber 52 and the first liquid chamber 51 come into communication with each other, and the liquid in the second liquid chamber 52 flows into the first liquid chamber 51. In addition, due to the valve mechanism 60 entering a closed state, the second liquid chamber 52 and the first liquid chamber 51 are brought into a non-communication state.

The valve mechanism 60 includes a valve body 64, a rod 67, a pressure receiving plate 68, and a biasing member 65. The valve body 64 is a disk-shaped member, and is arranged in the valve-arranged chamber 546. The valve body 64 is opposed to the inlet opening portion 547 so as to sandwich an annular sealing member 66. The sealing member 66 is arranged in a peripheral edge portion of the inlet opening portion 547 so as to surround the inlet opening portion 547. Due to the valve body 64 abutting against the sealing member 66, the valve-arranged chamber 546 and the first liquid chamber 51 are brought into a non-communication state. Due to the valve body 64 moving away from the sealing member 66, the valve-arranged chamber 546 and the first liquid chamber 51 are brought into a communication state. The rod 67 is a bar member with one end connected to the valve body 64, and the other end is connected to the pressure receiving plate 68. The rod 67 is inserted into the inlet opening portion 547. The pressure receiving plate 68 is a disk-shaped member. The pressure receiving plate 68 abuts against a flexible first film member 91 that demarcates the first liquid chamber 51, using the biasing force of the biasing member 65.

The biasing member 65 is a compression coil spring arranged in the first liquid chamber 51. The biasing member 65 biases the pressure receiving plate 68 toward the first film member 91. Due to liquid in the first liquid chamber 51 being supplied by the liquid ejection head 12 and consumed, when the pressure in the first liquid chamber 51 reaches a predetermined negative pressure, the pressure receiving plate 68, the rod 67, and the valve body 64 are biased against the biasing force of the biasing member 65 by the first film member 91 in a direction away from the sealing member 66 and the inlet opening portion 547. Accordingly, due to the valve body 64 moving away from the sealing member 66, the valve mechanism 60 enters an open state, and the valve-arranged chamber 546 and the first liquid chamber 51 are brought into a communication state. In the communication state, when liquid is supplied from the second liquid chamber 52 to the first liquid chamber 51, and the pressure in the first liquid chamber 51 rises to a certain degree (e.g. when the predetermined negative pressure is exceeded), the valve body 64 moves toward the sealing member 66 due to the biasing force of the biasing member 65, and abuts against the sealing member 66. Accordingly, the valve mechanism 60 enters a closed state, and the valve-arranged chamber 546 and the first liquid chamber 51 are brought into a non-communication state. As described above, the valve mechanism 60 enters an open state at least when the pressure in the first liquid chamber 51 reaches the predetermined negative pressure, and thus the pressure in the first liquid chamber 51 can be stabilized.

The first liquid chamber 51 can contain liquid to be supplied to the liquid supply portion 50. The liquid communication channel 80 can connect the first liquid chamber 51 and the liquid supply portion 50 so as to supply liquid in the first liquid chamber 51 to the liquid supply portion 50. The air communication channel 70 can connect the first liquid chamber 51 and the liquid supply portion 50, and can allow air to flow between the first liquid chamber 51 and the liquid supply portion 50.

The liquid supply portion 50 has a liquid supply port 505 at its downstream end. The liquid supply port 505 accommodates the liquid introduction needle portion 122. The liquid supply portion 50 is detachably connected to the liquid introduction needle portion 122 of the liquid ejection head 12. Specifically, by inserting the liquid introduction needle portion 122 into the liquid supply portion 50 via the liquid supply port 505 of the liquid supply portion 50, the liquid supply portion 50 is connected to the liquid introduction needle portion 122. Accordingly, liquid can be supplied from the liquid supply portion 50 to the liquid introduction needle portion 122.

A supply portion valve mechanism 200 for opening/closing the channel of the liquid supply portion 50 is arranged in the liquid supply portion 50. The supply portion valve mechanism 200 has a valve seat 202, a valve body 203, and a spring 204 from the downstream side in the stated order.

The valve seat 202 is an approximately annular member. The valve seat 202 is formed of an elastic body made of rubber, elastomer, and the like. The valve seat 202 is press-fitted in the liquid supply portion 50. The valve body 203 is a substantially columnar member. In a state before the liquid tank 30 is mounted on the carriage 19 (a pre-mounted state), the valve body 203 blocks a hole (a valve hole) formed in the valve seat 202. The spring 204 is a compression coil spring. The spring 204 biases the valve body 203 toward the valve seat 202. In the mounted state of the liquid tank 30 in which the liquid tank 30 is mounted on the carriage 19, and the liquid supply portion 50 is connected to the liquid introduction needle portion 122, the valve body 203 moves in a direction away from the valve seat 202 due to the liquid introduction needle portion 122 pressing the valve body 203 to the upstream side. Accordingly, the supply portion valve mechanism 200 enters an open state, and liquid can be supplied from the liquid supply portion 50 to the liquid introduction needle portion 122.

A-3. Detailed Configuration of Liquid Tank 30

Figure 4:
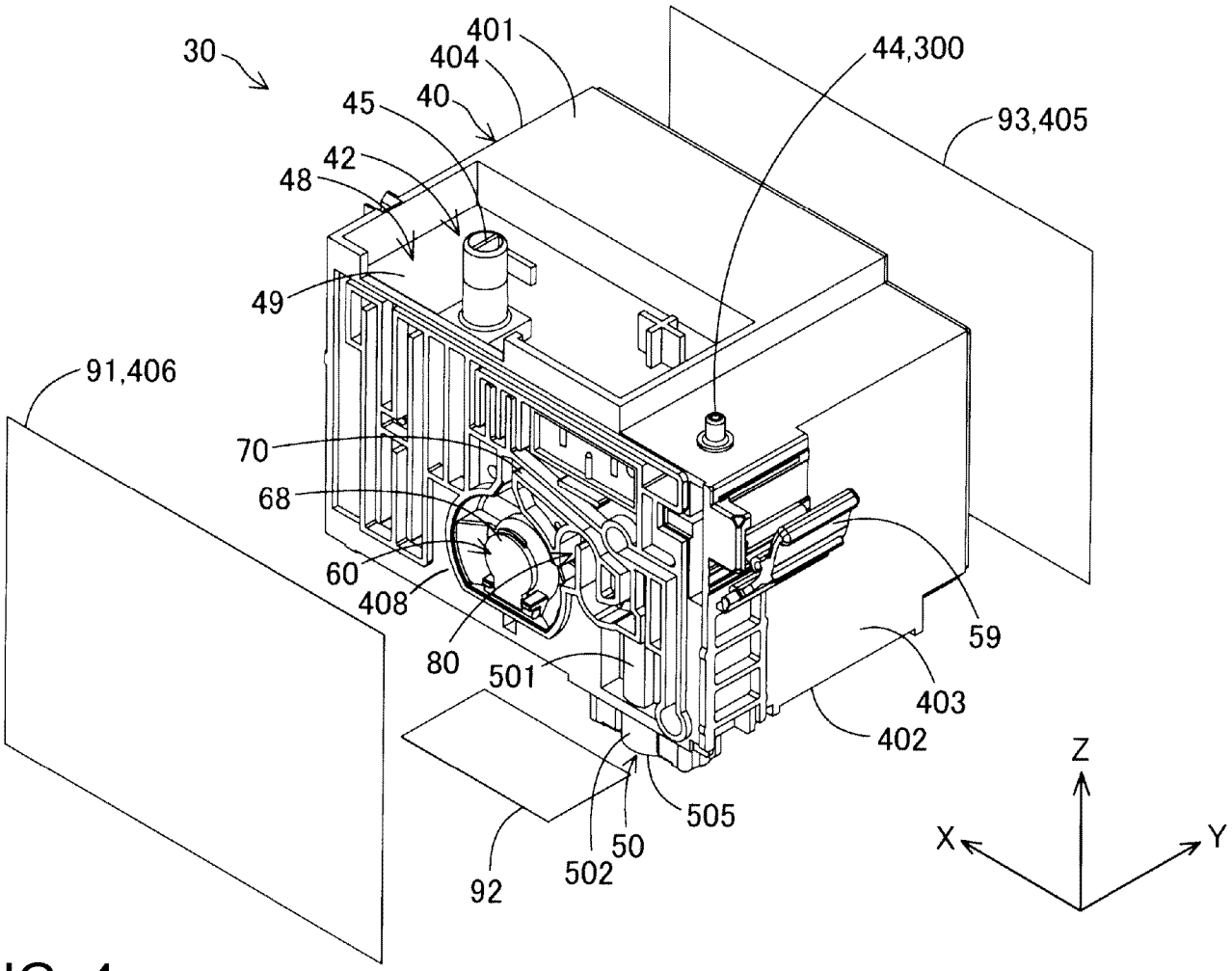
FIG. 4 is a partial exploded perspective view of the liquid tank.
Figure 5:
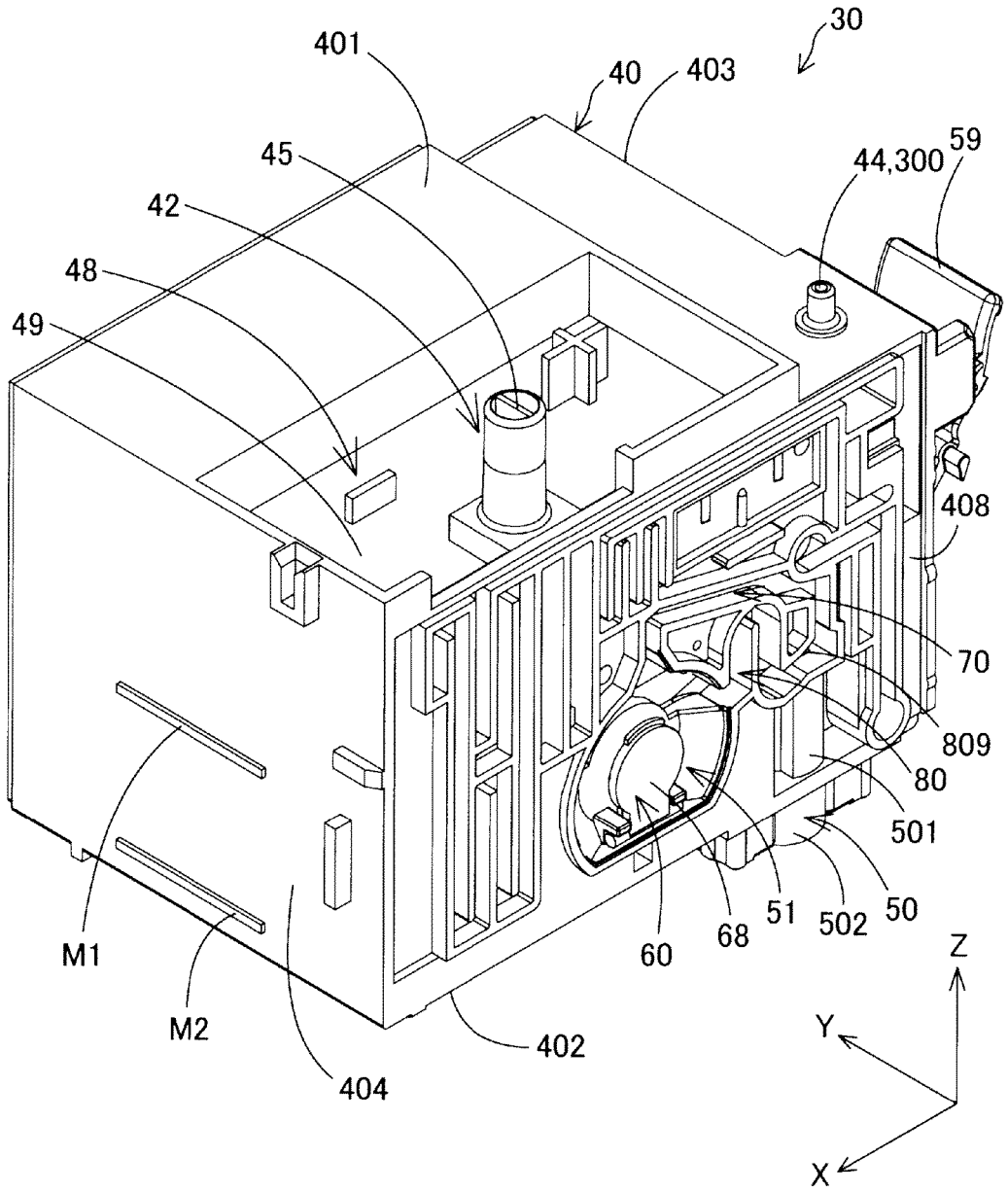
FIG. 5 is a first perspective view of a tank body.
Figure 6:
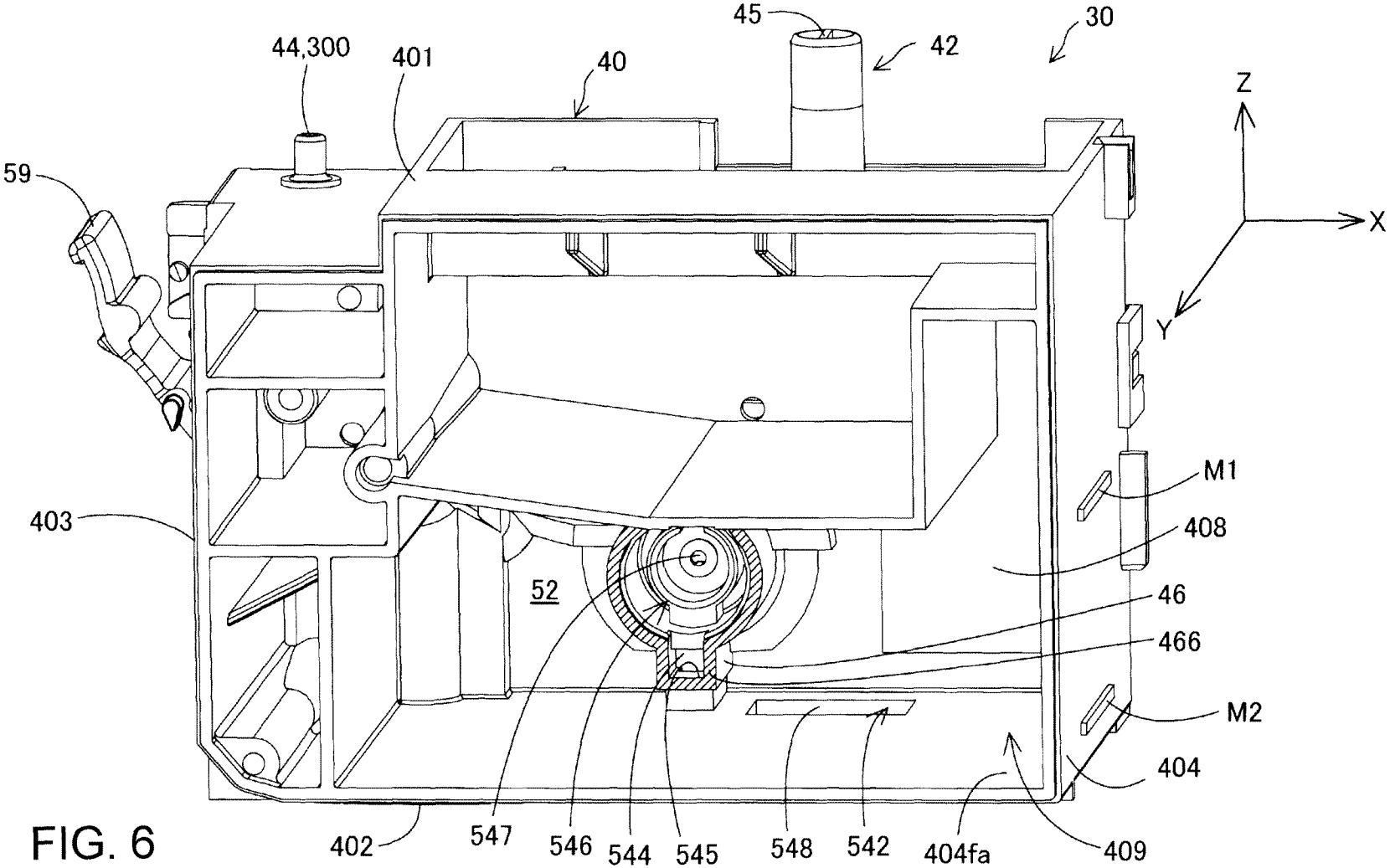
FIG. 6 is a second perspective view of the tank body.
Figure 7:
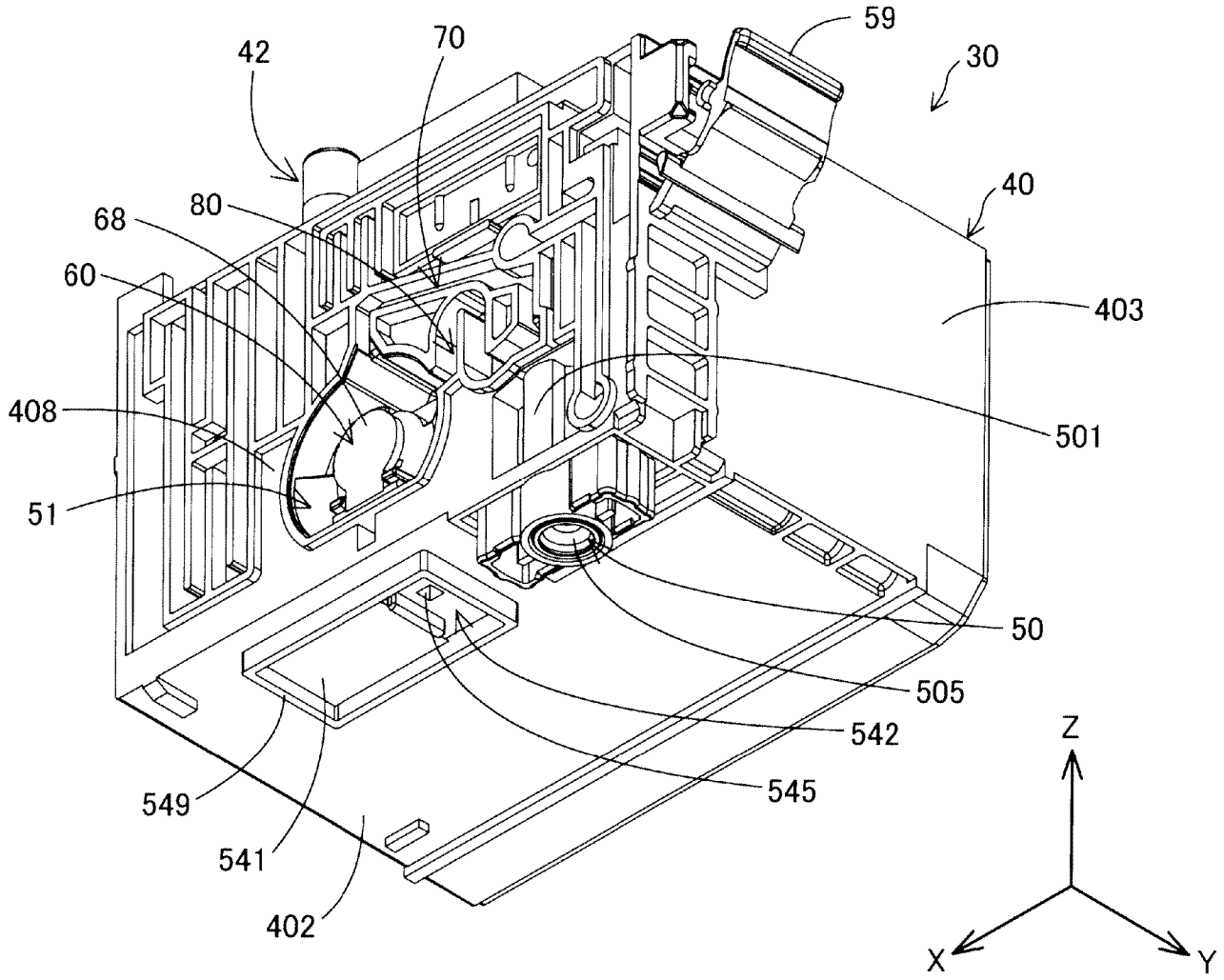
FIG. 7 is a third perspective view of the tank body.
Figure 8:
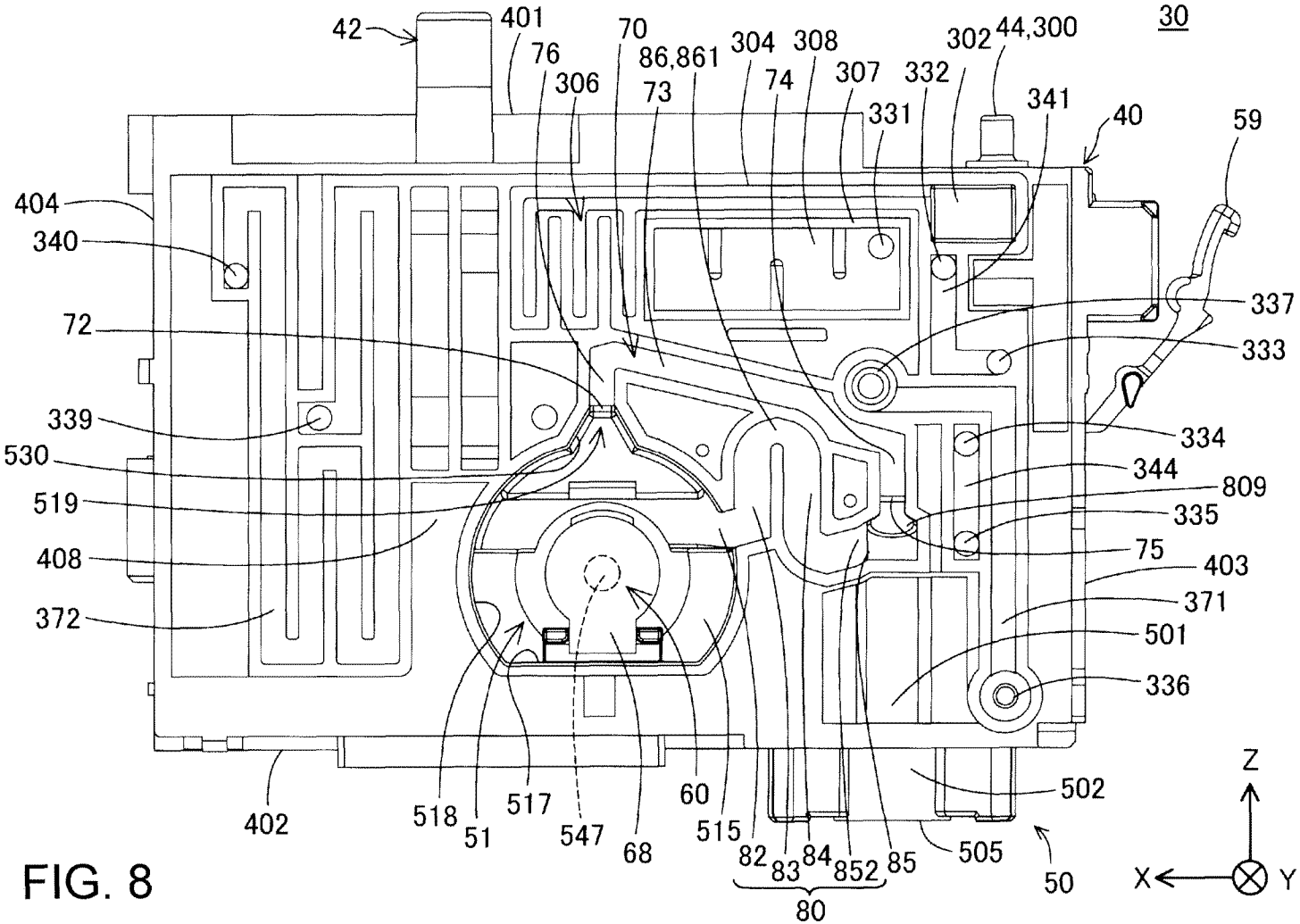
FIG. 8 is a first diagram of the tank body viewed from a −Y axis direction side.
Figure 9:
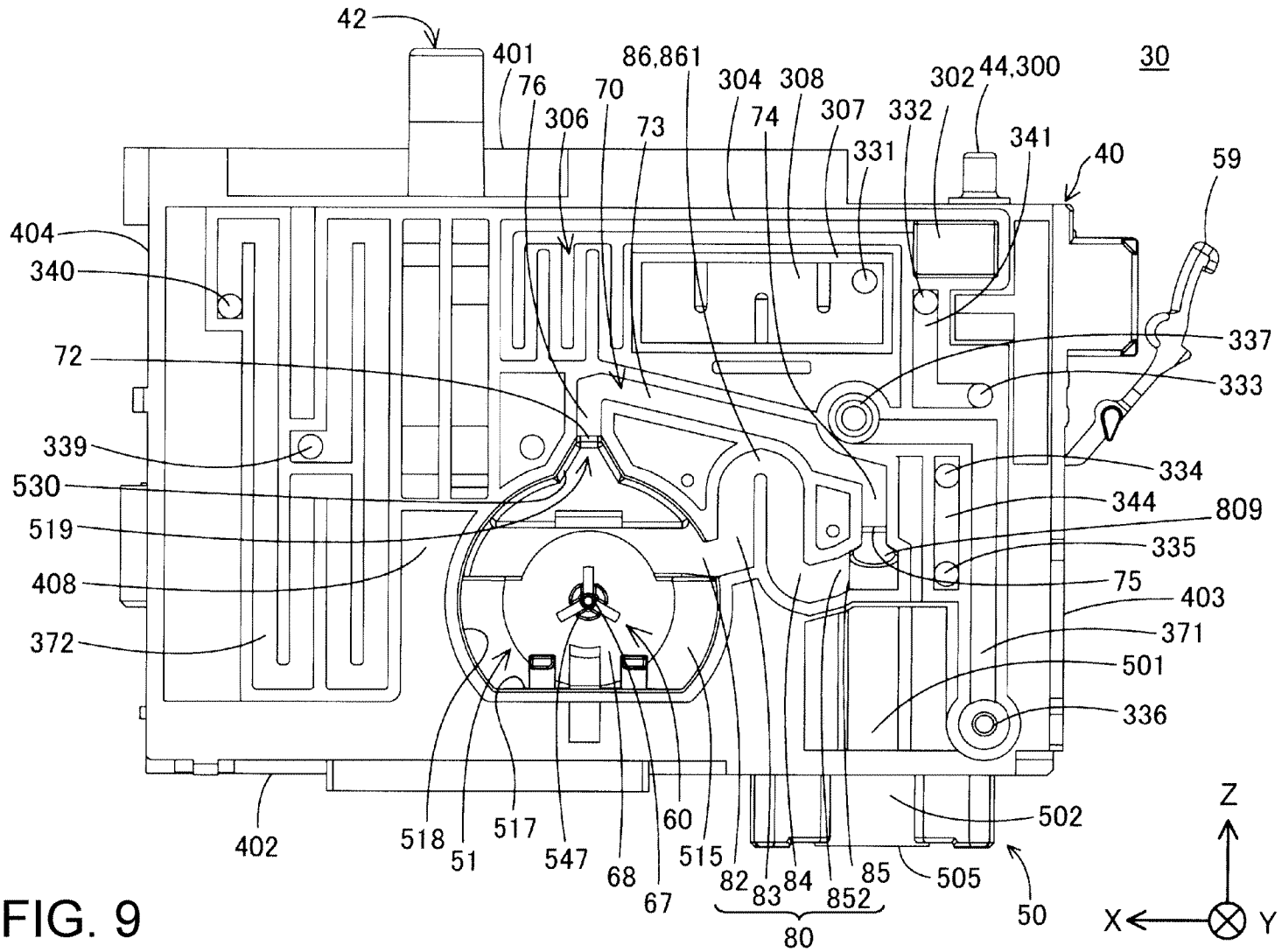
FIG. 9 is a second diagram of the tank body viewed from the −Y axis direction side.
Figure 10A:
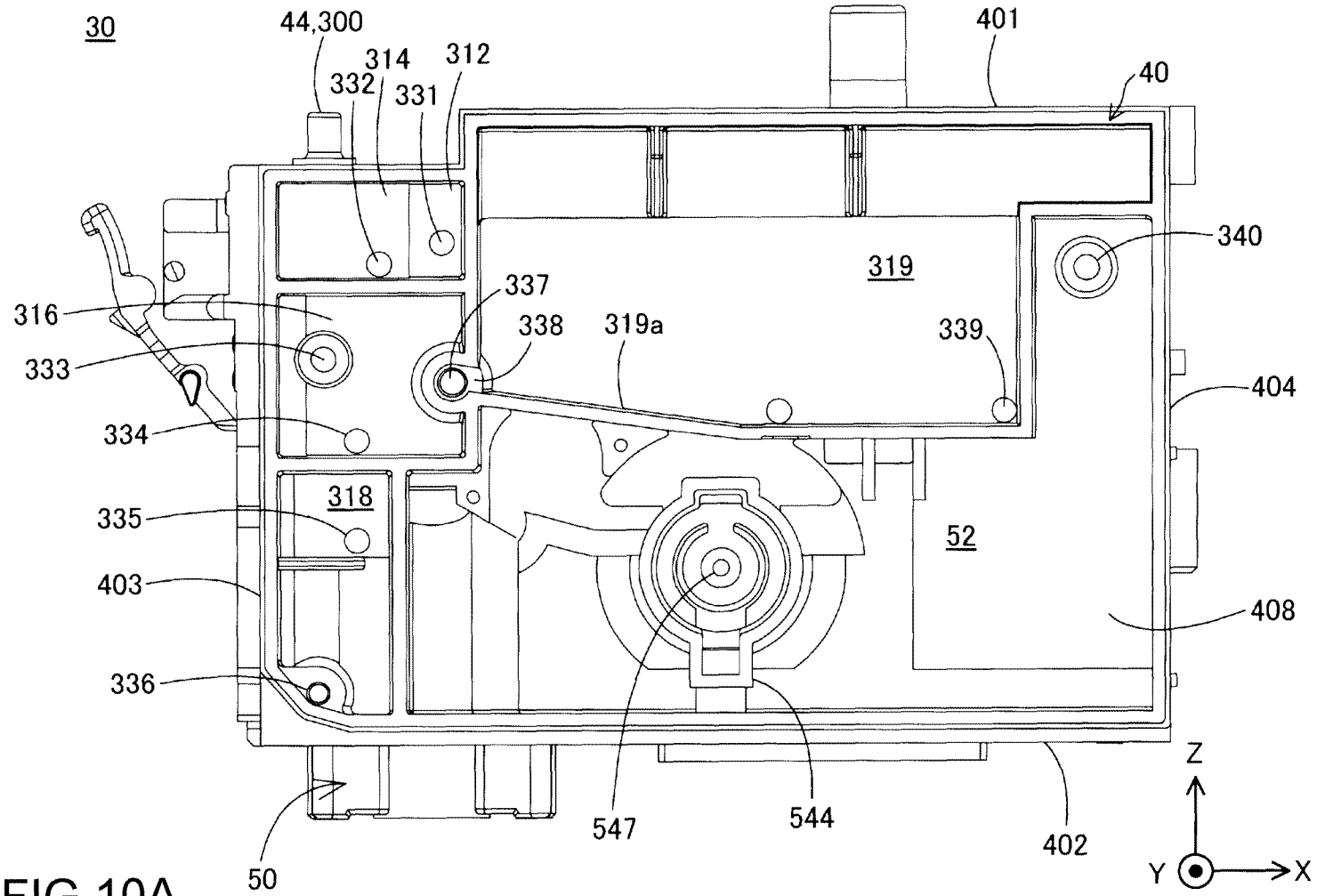
FIG. 10A is a diagram of the tank body viewed from a +Y axis direction side.
Figure 10B:
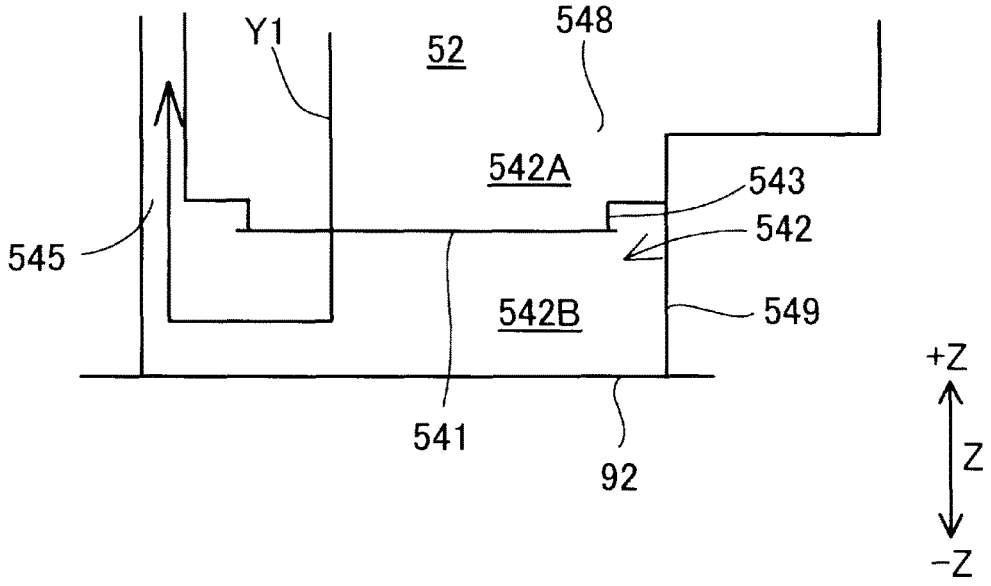
FIG. 10B is a schematic diagram of a filter chamber.
Figure 11:
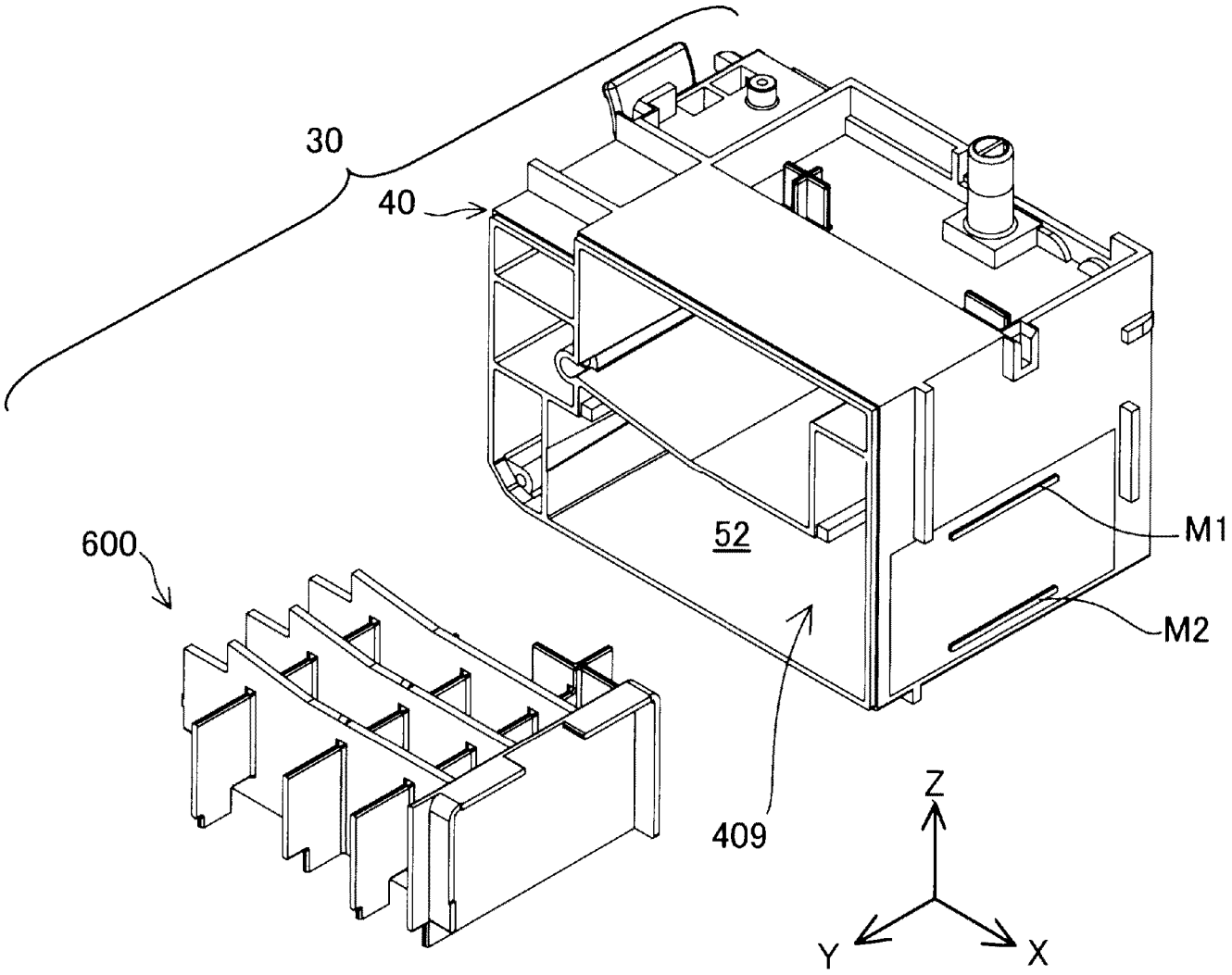
FIG. 11 is an external view showing the appearance of a division wall and the tank body.
Figure 12:
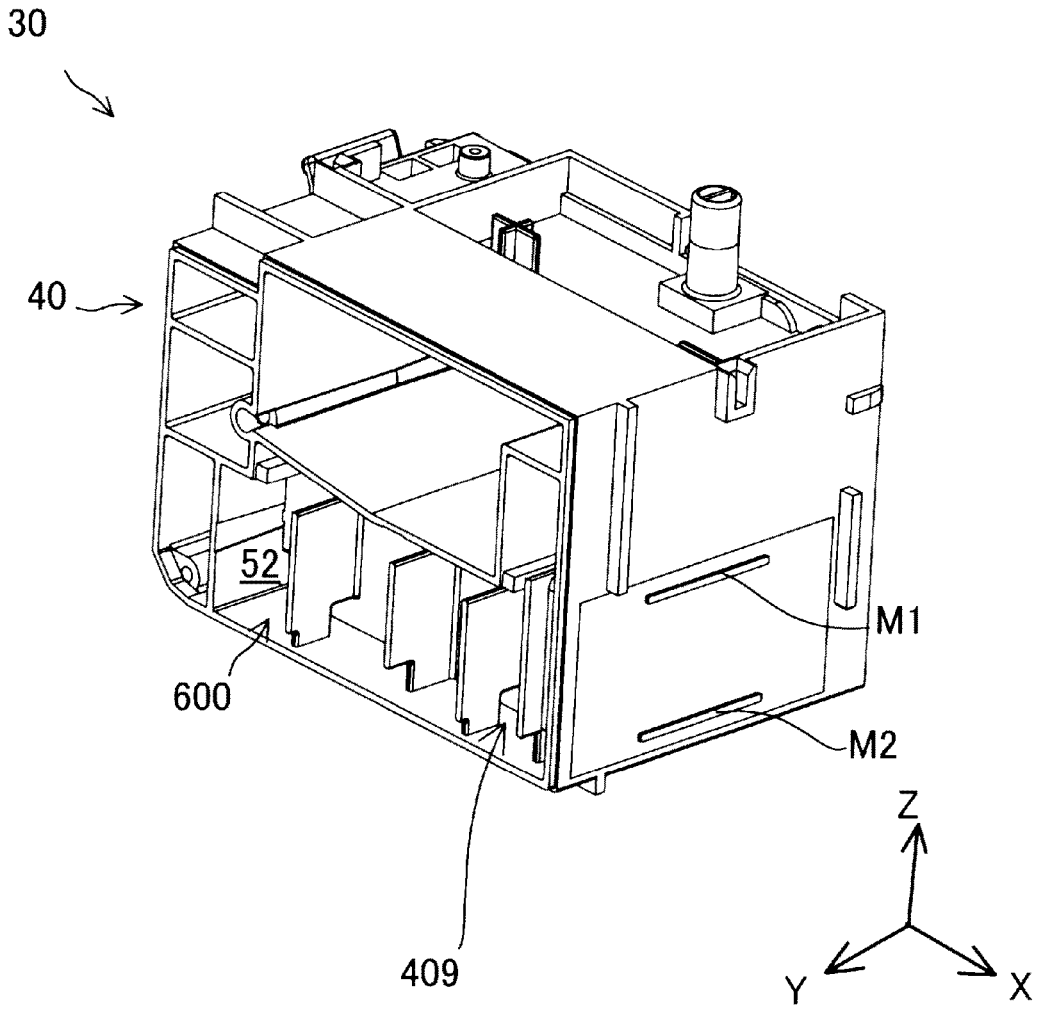
FIG. 12 is a perspective view of the tank body equipped with the division wall.

FIG. 4 is a partial exploded perspective view of the liquid tank 30. FIG. 5 is a first perspective view of a tank body 40. FIG. 6 is a second perspective view of the tank body 40. FIG. 7 is a third perspective view of the tank body 40. FIG. 8 is a first diagram of the tank body 40 viewed from the −Y axis direction side. FIG. 9 is a second diagram of the tank body 40 viewed from the −Y axis direction side. FIG. 10A is a diagram of the tank body 40 viewed from the +Y axis direction side. FIG. 10B is a schematic diagram of the filter chamber 542. FIG. 11 is an external view showing the appearance of a division wall 600 and the tank body 40. FIG. 12 is a perspective view of the tank body 40 in which the division wall 600 is mounted. FIGS. 5, 6, 7, and 8 also illustrate the valve mechanism 60 arranged in the tank body 40. FIG. 9 illustrates not only the valve mechanism 60 but also the rod 67 in the valve mechanism 60.

As shown in FIG. 4, the liquid tank 30 includes the tank body 40, the first film member 91, a second film member 92, and a third film member 93. The liquid tank 30 has a substantially rectangular parallelepiped shape. In the liquid tank 30, the X axis direction is a length direction, the Y axis direction is a width direction, and the Z axis direction is a height direction.

The liquid tank 30 has an upper face (first face, first wall) 401, a lower face (second face, second wall) 402, a rear face (third face, third wall) 403, a front face (fourth face, fourth wall) 404, a left side face (fifth face, fifth wall) 405, and a right side face (sixth face, fifth wall) 406. In the mounted state in which the liquid tank 30 is mounted on the carriage 19, the upper face 401 is opposed to the lower face 402 in the Z axis direction. In the mounted state, the rear face 403 is opposed to the front face 404 in the X axis direction. In the mounted state, the left side face 405 is opposed to the right side face 406 in the Y axis direction. The left side face 405 is formed by the third film member 93. The right side face 406 is formed by the first film member 91. The tank body 40 is formed by the upper face 401, the lower face 402, the rear face 403, and the front face 404. The rear face 403, the front face 404, the left side face 405, and the right side face 406 are faces substantially vertical to the installation face of the liquid ejection apparatus 1. The upper face 401 and the lower face 402 are faces substantially horizontal to the installation face of the liquid ejection apparatus 1. The faces 401 to 406 are not perfect flat faces, and may include irregularities and the like, and it suffices for those faces 401 to 406 to appear generally "vertical" or generally "horizontal".

In addition, the front face 404 is a wall face parallel to the Y axis direction and the Z axis direction, and constitutes a liquid visual recognition wall that enables visual recognition of the level of liquid in the liquid tank 30 (specifically, the second liquid chamber 52) from the outside. For example, the front face 404 is formed by a transparent or semi-transparent member. Signs (e.g., a scale and mark) corresponding to references (e.g., an upper limit and lower limit) of the level of liquid (liquid surface) may be provided in the front face 404. In this embodiment, as shown in FIG. 5, the upper limit sign M1 that is a sign corresponding to the upper limit and the lower limit sign M2 that is a sign corresponding to the lower limit are provided in the front face 404.

The upper limit sign M1 indicates the upper limit of the amount of liquid that is contained in the second liquid chamber 52. For example, in the case where the liquid surface reaches the upper limit sign M1 corresponding to the upper limit when injecting liquid from the liquid inlet port 42, the user stops injecting the liquid. The lower limit sign M2 indicates the reference of the lower limit of the amount of liquid that is contained in the second liquid chamber 52. For example, in the case where the liquid surface in the liquid tank 30 (specifically, the second liquid chamber 52) reaches the lower limit sign M2, the user injects liquid from the liquid inlet port 42 into the second liquid chamber 52.

A lever 59 for mounting/removing the liquid tank 30 to/from the mounting portion 11 of the carriage 19 (FIG. 2) is provided on the rear face 403. The lever 59 suppresses removal of the liquid tank 30 from the mounting portion 11 by engaging with the mounting portion 11, in the mounted state. The mounting portion 11 elastically deforms. The user releases engagement with the mounting portion 11 by pressing the lever 59 toward the rear face 403 such that the lever 59 elastically deforms toward the rear face 403. The liquid tank 30 can be removed from the mounting portion 11 by releasing this engagement.

The tank body 40 has a substantially rectangular parallelepiped shape, and is made of a synthetic resin such as polypropylene or polystyrene. The first film member 91, the second film member 92, and the third film member 93 are each attached to different portions of the tank body 40 in an airtight manner, and thereby demarcate and form, with the tank body 40, channels and the like in the liquid tank 30 through which liquid and air flow.

The tank body 40 (FIG. 6) has a recessed portion 409 that is open on the +Y axis direction side. The tank body 40 has one side wall 408 that forms a bottom portion of the tank body 40 having a recessed shape. The one side wall 408 is a wall that demarcates the first liquid chamber 51 and the second liquid chamber 52.

The one side wall 408 is substantially parallel to the X axis direction and the Z axis direction. As shown in FIG. 5, the first liquid chamber 51, the liquid communication channel 80, and the air communication channel 70 are formed on one side (the −Y axis direction side) of the one side wall 408. In addition, as shown in FIG. 6, the second liquid chamber 52 is formed on the other side (the +Y axis direction side) that is on the opposite side to the one side of the one side wall 408. Accordingly, the first liquid chamber 51, the liquid communication channel 80, the air communication channel 70, and the second liquid chamber 52 can be arranged by efficiently using the space of the liquid tank 30, and thus an increase in the size of the liquid tank 30 can be suppressed.

As shown in FIGS. 4 and 8, groove portions that demarcate and form the air communication channel 70 and the liquid communication channel 80, and recessed portions that form the first liquid chamber 51 are formed in the one side wall 408. By attaching the first film member 91 to the end face on the −Y axis direction side of the one side wall 408 in an airtight manner, the first liquid chamber 51, the air communication channel 70, and the liquid communication channel 80 are demarcated and formed. In addition, as shown in FIGS. 4 and 6, the second liquid chamber 52 is formed by the recessed portion 409 formed in the tank body 40 and the third film member 93 that seals the opening of the recessed portion 409 by being attached to the end face on the +Y axis direction side of the recessed portion 409 in an airtight manner. The recessed portion 409 has a recessed shape with the one side wall 408 serving as a bottom face. The end face on the +Y axis direction side is the end portion of the recessed portion 409 on the opposite side to the one side wall 408. The third film member 93 corresponds to the "film member" in the summary of the invention.

The tank body 40 (FIG. 4) further has the liquid inlet port 42 that allows liquid to be injected into the second liquid chamber 52. The liquid inlet port 42 extends in the +Z axis direction from a bottom face 49 of a corner portion 48 at which the upper face 401, the front face 404, and the right side face 406 intersect each other. The liquid inlet port 42 is a cylindrical member, and forms a first channel and a second channel. A partition wall 45 is arranged in the liquid inlet port 42. This partition wall 45 partitions the liquid inlet port 42 into the first channel and the second channel. When injecting liquid, the first channel functions as a liquid injection path for allowing liquid to flow into the second liquid chamber 52, and the second channel functions as an air discharge path for discharging air from the second liquid chamber 52. A cap (not illustrated) is mounted on the liquid inlet port 42 during use of the liquid in the liquid tank 30. In addition, the atmospheric air release portion 44 that is one end of the atmospheric air communication portion 300 is formed in an upper portion of the tank body 40. The atmospheric air communication portion 300 has a thin groove-like channel and a buffer chamber that can contain ink flowing backward. The other end portion of the atmospheric air communication portion 300 is connected to the second liquid chamber 52. Accordingly, when the liquid tank 30 is used, the second liquid chamber 52 is in communication with atmospheric air. The atmospheric air communication portion 300 will be described later in detail.

As shown in FIG. 6, the second liquid chamber 52 has the second liquid chamber bottom face 404*fa* that forms the bottom face in the mounted state. The second liquid chamber bottom face 404*fa* is the internal surface of the lower face 402. The liquid outlet 548 penetrating the second liquid chamber bottom face 404*fa* in the vertically downward direction (the −Z axis direction) is formed in the second liquid chamber bottom face 404*fa*. The liquid outlet 548 is the upstream end of the filter chamber 542 formed in the lower face 402. The second liquid chamber 52 internally includes the division wall 600. The division wall 600 shown in FIG. 11 is arranged inside the second liquid chamber 52. As shown in FIG. 11, the division wall 600 is a body that is separate from the recessed portion 409 of the liquid tank 30 that constitutes the second liquid chamber 52. After being manufactured separately from the tank body 40 in manufacturing of the liquid tank 30, the division wall 600 is mounted to the tank body 40 (FIG. 12). The division wall 600 is manufactured by integrally molding a synthetic resin such polypropylene or polystyrene. The division wall 600 will be described later in detail.

The filter chamber 542 (FIG. 7) is demarcated and formed by a frame-like member 549 protruding from the lower face 402 and the second film member 92 (FIG. 4) attached to the lower end face of the frame-like member 549 in an airtight manner. The filter chamber 542 is positioned below the second liquid chamber 52 (the −Z axis direction) in the mounted state. The filter member 541 is arranged inside the frame-like member 549. In this embodiment, for example, the filter member 541 is arranged in a frame-like arrangement portion 543 (FIG. 10B) formed inside the frame-like member 549. The filter member 541 is shaped like a plate, and is orthogonal to the vertically downward direction (the −Z axis direction) in the mounted state. In addition, a communication opening 545 that is in communication with the intermediate channel 544 is formed in a peripheral edge portion of the filter member 541 (FIGS. 7 and 10B). Liquid in the second liquid chamber 52 passes through the liquid outlet 548 and the filter member 541 by flowing along the −Z axis direction as indicated by an arrow Y1, and the liquid that has passed through the filter member 541 passes through the communication opening 545 by flowing along the +Z axis direction. The liquid that has passed through the communication opening 545 flows into the intermediate channel 544. As described above, in the mounted state, the filter member 541 (FIG. 10B) demarcates, from the filter chamber 542, an upper first portion 542A that includes the liquid outlet 548 and a second portion 542B positioned below the first portion 542A. In addition, the filter member 541 is positioned below the liquid outlet 548 in the mounted state. Accordingly, even in the case where air bubbles adhere to the filter member 541, it is possible to guide the adhering air bubbles to the second liquid chamber 52 via the liquid outlet 548, and thus it is possible to reduce the likelihood of air bubbles flowing out to the first liquid chamber 51 and the liquid supply portion 50.

The intermediate channel 544 and the valve-arranged chamber 546 (FIG. 6) are formed inside the second liquid chamber 52. The intermediate channel 544 and the valve-arranged chamber 546 are demarcated and formed by the one side wall 408, a channel wall 46 that rises from the one side wall 408 toward the opening side of the tank body 40 having a recessed shape (the +Y axis direction side), and a film (not illustrated) attached to an end face 466 on the +Y axis direction side of the channel wall 46 in an airtight manner. The end face 466 to which the film is attached is indicated by single hatching.

The intermediate channel 544 (FIG. 6) is a channel extending in a direction along the gravity direction in the mounted state. The direction along the gravity direction is a direction that is generally perpendicular to the horizontal direction, and forms an angle of 80° or more and 100° or smaller with the horizontal direction. In the mounted state, due to the intermediate channel 544 extending in a direction along the gravity direction, the channel length of the intermediate channel 544 can be set to be short compared with a case of extending in a direction intersecting the gravity direction. Here, in the case where liquid in the liquid tank 30 has been consumed, and the liquid has been consumed to the extent where the liquid surface falls to the position of the filter member 541, air bubbles flow in to the channel on the downstream side relative to the filter member 541. Thus, in the case where the liquid surface has fallen to the position of the filter member 541, the supply of liquid from the liquid tank 30 to the liquid ejection head 12 is stopped. In this embodiment, by setting the channel length of the intermediate channel 544 that connects the first liquid chamber 51 and the filter chamber 542 to be short, it is possible to reduce the amount of liquid that could not be used and remaining in the intermediate channel 544. Note that, in another embodiment, the intermediate channel 544 may be formed so as to extend in a direction including horizontal direction components and vertically upward components.

The valve-arranged chamber 546 has an approximately circular shape when the tank body 40 is viewed from the +Y axis direction side. The inlet opening portion 547 is formed in the valve-arranged chamber 546. Specifically, the inlet opening portion 547 is a through hole that penetrates the one side wall 408.

The first liquid chamber 51 (FIG. 8) is formed in the one side wall 408, and is formed by a recessed portion that is open on the horizontal direction (in this embodiment, the −Y axis direction) side and the first film member 91 (FIG. 4) attached in an airtight manner to the end face of the recessed portion on the −Y axis direction side. The size of the first liquid chamber 51 in the Y axis direction is larger than that of the air communication channel 70. In other words, the first liquid chamber 51 is deeper than the air communication channel 70. The volume of the first liquid chamber 51 (maximum volume) is smaller than that of the second liquid chamber 52 (maximum volume). The first liquid chamber 51 has a side wall 515 that is opposed to the first film member 91, a bottom wall 517 positioned on the vertically downward direction side in the mounted state, an arcuate peripheral wall 518 extending from the bottom wall 517 in the vertically upward direction in the mounted state, and an uppermost portion 519. The inlet opening portion 547 is formed in the side wall 515. The peripheral wall 518 has a portion opposed to the bottom wall 517. The uppermost portion 519 is a portion protruding upward from the top of the peripheral wall 518, and, in the mounted state, is arranged at the highest position in the first liquid chamber 51.

The uppermost portion 519 is a space that has a certain volume. In addition, the uppermost portion 519 is preferably provided with a tapered portion 530 whose channel cross-section area decreases upward, in other words, on the side of a connection portion 72 for air to which the air communication channel 70 is connected. In this embodiment, the uppermost portion 519 has the tapered portion 530. In the case where the uppermost portion 519 has the tapered portion 530, the volume of the uppermost portion 519 can be set to be large while suppressing an increase in the size of the first liquid chamber 51 compared with the case where the tapered portion 530 is not provided. Accordingly, it is possible to increase the amount of air that can be contained in the uppermost portion 519 (air storage volume). In addition, the volume of the uppermost portion 519 can be set to be large, and thus it is possible to suppress the flow of liquid and air bubbles from the first liquid chamber 51 to the air communication channel 70 due to a change in the environment (e.g., the temperature and air pressure) in which the liquid tank 30 is used.

The liquid communication channel 80 (FIG. 8) forms a projection-shaped channel at its upper position, in the mounted state. In this embodiment, the liquid communication channel 80 forms an inverted U-shaped channel in the mounted state. The liquid communication channel 80 has an upstream end 82, an ascending channel 83, a liquid intermediate channel 86, a descending channel 84, and a downstream end portion 852 that includes a downstream end 85 in a direction in which liquid flows, from the upstream side in the stated order. It is preferred that the channel cross-section area of the liquid communication channel 80 is larger than the channel cross-section area of the air communication channel 70. The channel cross-section area is a channel area when the channel is cut on a plane perpendicular to a direction in which fluid that flows in the channel flows. In the case where the channel cross-section area of the liquid communication channel 80 is larger than the channel cross-section area of the air communication channel 70, liquid in the first liquid chamber 51 is likely to flow to the liquid communication channel 80, compared with the case where the channel cross-section area of the liquid communication channel 80 is smaller than or equal to the channel cross-section area of the air communication channel 70. In this embodiment, the channel cross-section area of the thinnest portion of the liquid communication channel 80 is larger than the channel cross-section area of the largest portion of the air communication channel 70. Therefore, the liquid tank 30 can suppress the liquid contained in the first liquid chamber 51 from flowing into the air communication channel 70.

The upstream end 82 is an opening formed in the peripheral wall 518 of the first liquid chamber 51, and is connected to the first liquid chamber 51. The ascending channel 83 is positioned on the downstream side relative to the upstream end 82, and extends upward in the flow direction in the mounted state. In this embodiment, the ascending channel 83 extends from the upstream end 82 in the vertically upward direction. Note that, in another embodiment, the ascending channel 83 may obliquely extend as long as upward components are included. Here, in the mounted state, the inlet opening portion 547 is arranged at a position lower than the upstream end 82. In other words, the inlet opening portion 547 is arranged at a position closer to the bottom wall 517 than the upstream end 82 is.

Here, liquid contains pigment particles, and thus there are cases where, if the liquid comes into contact with air, and is exposed to a change in pressure due to the valve mechanism 60 being opened/closed, the pigment particles aggregate to become an extraneous material. As described above, in the mounted state, the inlet opening portion 547 is arranged at a position lower than the upstream end 82, and thus it is possible to suppress the liquid level from falling below the inlet opening portion 547. Thus, it is possible to suppress the existence of air in the periphery of the inlet opening portion 547, and thus it is possible to reduce the likelihood of extraneous material being generated in the periphery of the inlet opening portion 547. Accordingly, it is possible to reduce the likelihood of extraneous material flowing into the liquid ejection head 12.

The liquid intermediate channel 86 connects the ascending channel 83 and the descending channel 84. The liquid intermediate channel 86 has an uppermost portion 861 for liquid that is at the highest position in the liquid communication channel 80, in the mounted state. Accordingly, the liquid intermediate channel 86 is a portion positioned higher than the upstream end 82 and the downstream end 85 that form the two ends of the liquid communication channel 80, in the mounted state. The liquid intermediate channel 86 is a channel for changing the flow of liquid from upward to downward, and is a channel bent by 180 degrees. In addition, the liquid intermediate channel 86 is, in the mounted state, arranged at a position lower than the highest portion of the air communication channel 70 (the upstream end of an air second channel 73), which will be described later.

The descending channel 84 is positioned on the downstream side relative to the ascending channel 83 and the liquid intermediate channel 86 in the flow direction, and extends downward in the mounted state. In this embodiment, the descending channel 84 extends from the liquid intermediate channel 86 in the vertically downward direction. Note that, in another embodiment, the descending channel 84 may obliquely extend as long as downward components are included.

In the flow direction, the downstream end portion 852 is positioned on the downstream side relative to the descending channel 84, and is connected to the liquid supply portion 50. The downstream end portion 852 is formed as a connection chamber that connects the descending channel 84 and a liquid inlet 809 serving as the upstream end of the liquid supply portion 50 to be described later. This downstream end portion 852 includes the downstream end 85 to which the liquid inlet 809 is connected. It is preferred that, in the mounted state, the downstream end portion 852 is inclined upward relative to the horizontal direction toward the liquid supply portion 50, in other words, toward the downstream end 85. In addition, it is more preferable that the inclination of the downstream end portion 852 is an inclination having an angle of 10° or more and 45° or smaller relative to the horizontal direction. In this embodiment, the inclination of the downstream end portion 852 has an angle of 15° relative to the horizontal direction. Here, the angle of inclination of the downstream end portion 852 is an angle formed by the bottom face of the downstream end portion 852 and the horizontal direction (this angle is an acute angle). In the case where the downstream end portion 852 is inclined as described above, it is possible to suppress the flow of air bubbles remaining in the liquid supply portion 50 into the liquid communication channel 80. Therefore, it is possible to suppress blockage of the liquid communication channel 80 with air bubbles.

The air communication channel 70 (FIG. 8) has the connection portion 72 for air that forms one end thereof, an air first channel 76 serving as an upward air channel, the air second channel 73 serving as an inclined air channel, an air third channel 74, and a connection portion 75 on the supply side that forms the other end of the air communication channel 70. In the mounted state, the air communication channel 70 is connected to the first liquid chamber 51 at a position higher than the upstream end 82 that is at a connection position between the liquid communication channel 80 and the first liquid chamber 51.

The connection portion 72 for air is an opening formed in the uppermost portion 519 in the peripheral wall 518. Accordingly, the air communication channel 70 is connected to the uppermost portion 519 of the first liquid chamber 51 in the mounted state. It is preferred that, in the mounted state, the connection portion 72 for air is formed at the same height as the uppermost portion 861 for liquid of the liquid communication channel 80 or at a position higher than the uppermost portion 861 for liquid. In this case, in the first liquid chamber 51, the volume of the uppermost portion 519 can be set to be large, compared with the case where the connection portion 72 for air is formed at a position lower than the uppermost portion 861 for liquid. In this embodiment, the connection portion 72 for air is formed at a position higher than the uppermost portion 861 for liquid.

In the mounted state, the air first channel 76 has the connection portion 72 for air at one end thereof, and extends upward from the first liquid chamber 51. The air second channel 73 connects the air first channel 76 and the air third channel 74, and, in the mounted state, extends in a direction including the horizontal direction (in this embodiment, the X axis direction). The air third channel 74 extends downward from the air second channel 73, in the mounted state. Regarding the air third channel 74, the connection portion 75 on the supply side is connected to the liquid supply portion 50. The connection portion 75 on the supply side is formed as a connection chamber that connects the air third channel 74 and the liquid inlet 809.

It is preferred that the air second channel 73 is a channel extending in a direction inclined relative to the horizontal direction, in the mounted state. It is more preferred that the air second channel 73 is inclined with an angle of 10° or more and 45° or smaller relative to the horizontal direction. Here, an angle that is formed by the air second channel 73 and the horizontal direction is an angle formed by the bottom face of the air second channel 73 and the horizontal direction (this angle is an acute angle). Due to the air second channel 73 extending in a direction inclined relative to the horizontal direction, when liquid flows into the air second channel 73, liquid that has flowed into the air second channel 73 is likely to flow from the air second channel 73 to the air first channel 76 or the air third channel 74, compared with the case where the air second channel 73 extends in the horizontal direction. Therefore, it is possible to prevent the liquid that has flowed into the air second channel 73 from remaining in the air second channel 73. Therefore, it is possible to suppress blockage of the air second channel 73 with the liquid that has flowed into the air second channel 73. Note that the flow of liquid into the air second channel 73 is caused by a change in the temperature or air pressure, or inversion or vibration of the liquid tank 30, for example. In this embodiment, the entire air second channel 73 (inclined air channel 73) is inclined downward toward the air third channel 74, in the mounted state, and forms an angle of 15° with the horizontal direction.

It is more preferred that the connection portion 75 on the supply side that is the downstream end of the air communication channel 70 is, in the mounted state, positioned immediately above the liquid inlet 809 of the liquid supply portion 50, which will be described later. "Positioned immediately above" refers to an arrangement in which the connection portion 75 on the supply side overlaps at least a portion of the liquid inlet 809 when viewed from the Z axis direction. It is more preferred that the connection portion 75 on the supply side and the liquid inlet 809 are arranged such that the center of the channel cross-section in the connection portion 75 on the supply side generally overlaps the center of the channel cross-section of the liquid inlet 809. In the case where the connection portion 75 on the supply side is positioned immediately above the liquid inlet 809, if air bubbles remaining in the liquid supply portion 50 move upward, the air bubbles are likely to flow into the air communication channel 70 compared with the case where the connection portion 75 on the supply side is not positioned immediately above the liquid inlet 809. Accordingly, air bubbles remaining in the liquid supply portion 50 are kept from flowing into the liquid communication channel 80. In this embodiment, the connection portion 75 on the supply side is positioned immediately above the liquid inlet 809.

The liquid supply portion 50 (FIG. 7) is positioned below the downstream end 85 in the mounted state. Also, the liquid supply portion 50 extends downward toward the liquid supply port 505, in the mounted state. In this embodiment, in the mounted state, the liquid supply portion 50 extends in the vertically downward direction toward the liquid supply port 505, but in another embodiment, the liquid supply portion 50 may obliquely extend as long as downward components are included.

The liquid supply portion 50 (FIG. 8) has the liquid inlet 809, a first supply portion 501, and a second supply portion 502. The liquid inlet 809 forms the upstream end of the liquid supply portion 50 in the flow direction of liquid. The liquid inlet 809 is open in the vertically upward direction in the mounted state. The first supply portion 501 is provided with an internal channel connected to the liquid inlet 809. The first supply portion 501 is formed inside the tank body 40. The second supply portion 502 is connected to the first supply portion 501. The second supply portion 502 is formed by a member protruding vertically downward from the lower face 402, in the mounted state. The second supply portion 502 has the liquid supply port 505. The liquid supply port 505 is open in the vertically downward direction in the mounted state.

As shown in FIG. 8, when the liquid tank 30 is viewed from one side (the −Y axis direction side) of the one side wall 408, the liquid inlet port 42 and the liquid supply port 505 are arranged at diagonal positions. For example, when the liquid tank 30 is viewed from one side (the −Y axis direction side) of the one side wall 408, the liquid inlet port 42 is positioned on the vertically upward side relative to the first liquid chamber 51 in the mounted state and on one side (the +X axis direction side) of the horizontal direction (e.g., the X axis direction) relative to the first liquid chamber 51, and the liquid supply port 505 is positioned on the vertically downward direction side relative to the first liquid chamber 51 in the mounted state and on the other side (the −X axis direction side) of the horizontal direction (e.g., the X axis direction) relative to the first liquid chamber 51. Accordingly, it is possible to prevent the distance from the liquid inlet port 42 to the liquid supply port 505 from being short, and thus, even in the case where air bubbles are generated when liquid is injected from the liquid inlet port 42 into the second liquid chamber 52, it is possible to reduce the likelihood of air bubbles reaching the liquid supply port 505. Accordingly, it is possible to reduce air bubbles remaining in the vicinity of the liquid supply port 505 in the liquid supply portion 50, and thus it is possible to reduce the likelihood of air bubbles flowing into the liquid ejection head 12. In addition, it is possible to efficiently arrange channels that run from the liquid inlet port 42 to the liquid supply port 505, and through which liquid flows, and thus an increase in the size of the liquid tank 30 can be suppressed.

Next, the atmospheric air communication portion 300 will be described with reference to FIGS. 9 and 10A. The "upstream side" and "downstream side" used in the description of the atmospheric air communication portion 300 are based on the flow direction of fluid (air) that moves from the outside toward the second liquid chamber 52.

The atmospheric air communication portion 300 includes the atmospheric air release portion 44 serving as an upstream end thereof, a first atmospheric air channel 302 (FIG. 9), a second atmospheric air channel 304 (FIG. 9), a meandering channel 306 (FIG. 9), a gas-liquid separation chamber 308 (FIG. 9), a buffer chamber 310 (FIG. 10A), an atmospheric air intermediate channel 372 (FIG. 9), and an atmospheric air introduction portion 340 serving as the downstream end of the atmospheric air communication portion 300, from the upstream side in the stated order. Here, in the atmospheric air communication portion 300, various channels formed on one side (the −Y axis direction side) of the one side wall 408 are demarcated by the tank body 40 and the first film member 91 (FIG. 4), and various channels formed on the other side (the +Y axis direction side) of the one side wall 408 are demarcated by the tank body 40 and the third film member 93 (FIG. 4). The buffer chamber 310 includes a first buffer chamber 312, a second buffer chamber 314, a third buffer chamber 316, a fourth buffer chamber 318, and a fifth buffer chamber 319 from the upstream side in the stated order.

The atmospheric air release portion 44 (FIG. 9) is a cylindrical member extending in the +Z axis direction from a portion of the upper face 401 on the rear face 403 side. The first atmospheric air channel 302 (FIG. 9) is a channel that connects the atmospheric air release portion 44 and the second atmospheric air channel 304. The second atmospheric air channel 304 is a long and thin channel extending along the X axis direction. The meandering channel 306 is a channel that connects the second atmospheric air channel 304 and the gas-liquid separation chamber 308. The meandering channel 306 is a channel that is long, thin, and meanders such that the channel length of the atmospheric air communication portion 300 is increased. Accordingly, it is possible to suppress the evaporation of moisture in the liquid in the second liquid chamber 52. A gas-liquid separation film (not illustrated) is arranged in an inner peripheral wall 307 of the gas-liquid separation chamber 308. The gas-liquid separation film is made of a material that allows the permeation of gas, and does not allow the permeation of a liquid. The downstream end of the gas-liquid separation chamber 308 is a through hole 331 that penetrates the one side wall 408. The gas-liquid separation chamber 308 and the first buffer chamber 312 (FIG. 10A) are connected by the through hole 331. The first buffer chamber 312 is in communication with the second buffer chamber 314 via a gap 311 between the third film member 93 and the end face of the tank body 40 on the +Y axis direction side.

The second buffer chamber 314 and a first intermediate connection channel 341 (FIG. 8) are in communication with each other via a through hole 332 that penetrates the one side wall 408. The downstream end of the first intermediate connection channel 341 is a through hole 333 that penetrates the one side wall 408. The first intermediate connection channel 341 and the third buffer chamber 316 (FIG. 10A) are in communication with each other via the through hole 333. The third buffer chamber 316 and a second intermediate connection channel 344 are in communication with each other via a through hole 334 that penetrates the one side wall 408. The second intermediate connection channel 344 and the fourth buffer chamber 318 are in communication with each other via a through hole 335 that penetrates the one side wall 408. The fourth buffer chamber 318 and a third intermediate connection channel 371 are in communication with each other via a through hole 336 that penetrates the one side wall 408. The third intermediate connection channel 371 and the fifth buffer chamber 319 are in communication with each other via a through hole 337 that penetrates the one side wall 408 and a notch portion 338 formed in the periphery of the through hole 337. A bottom face 319*a* of the fifth buffer chamber 319 is inclined downward from the notch portion 338 that is on the upstream side toward a through hole 339 that is on the downstream side. Accordingly, even in the case where liquid intrudes into the fifth buffer chamber 319 from the through hole 339, it is possible to reduce the likelihood of a liquid reaching the notch portion 338.

The fifth buffer chamber 319 and the atmospheric air intermediate channel 372 are in communication with each other via the through hole 339 that penetrates the one side wall 408. The atmospheric air intermediate channel 372 and the second liquid chamber 52 are in communication with each other via the atmospheric air introduction portion 340 that penetrates the one side wall 408. The atmospheric air introduction portion 340 is arranged in the vicinity of the upper face of the second liquid chamber 52 in the mounted state. The atmospheric air introduction portion 340 introduces atmospheric air into the second liquid chamber 52 as liquid in the second liquid chamber 52 is consumed.

A-4. Initial Filling of Liquid Tank 30 with Liquid

Figure 13:
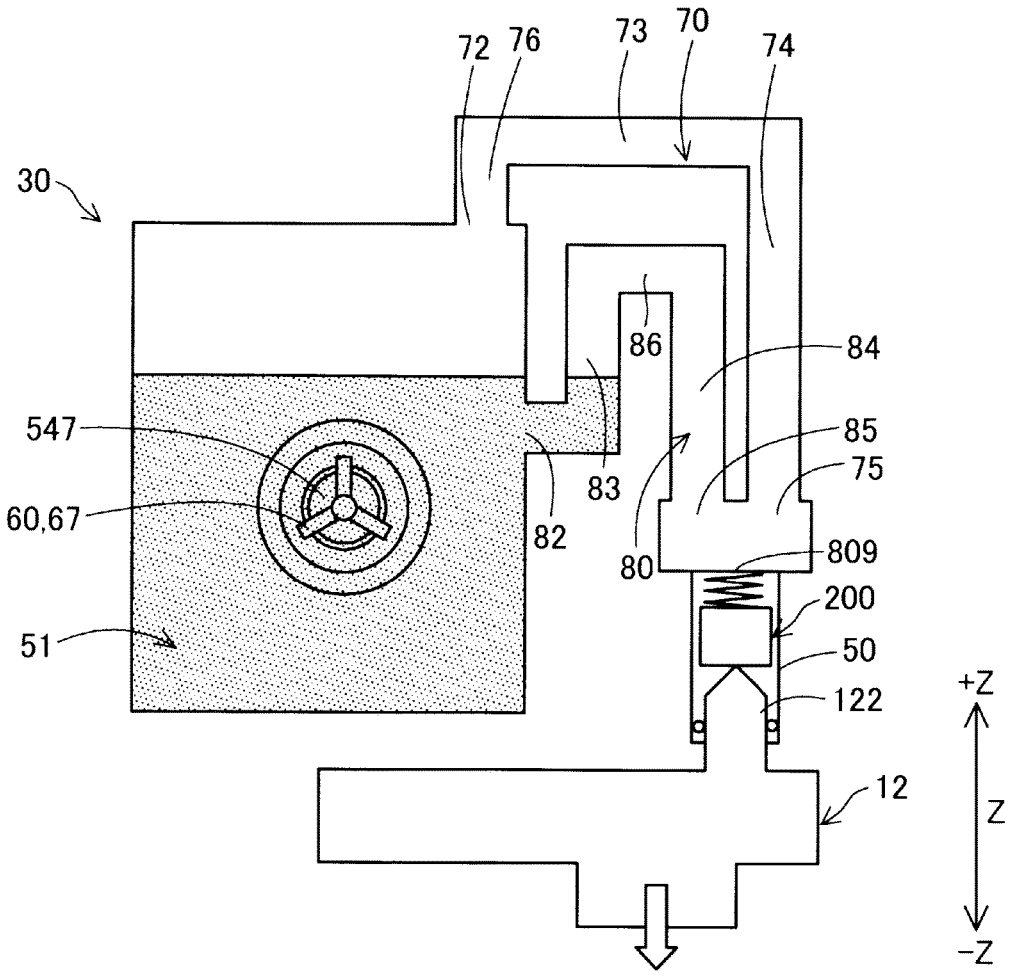
FIG. 13 is a first diagram for describing initial liquid filling.
Figure 14:
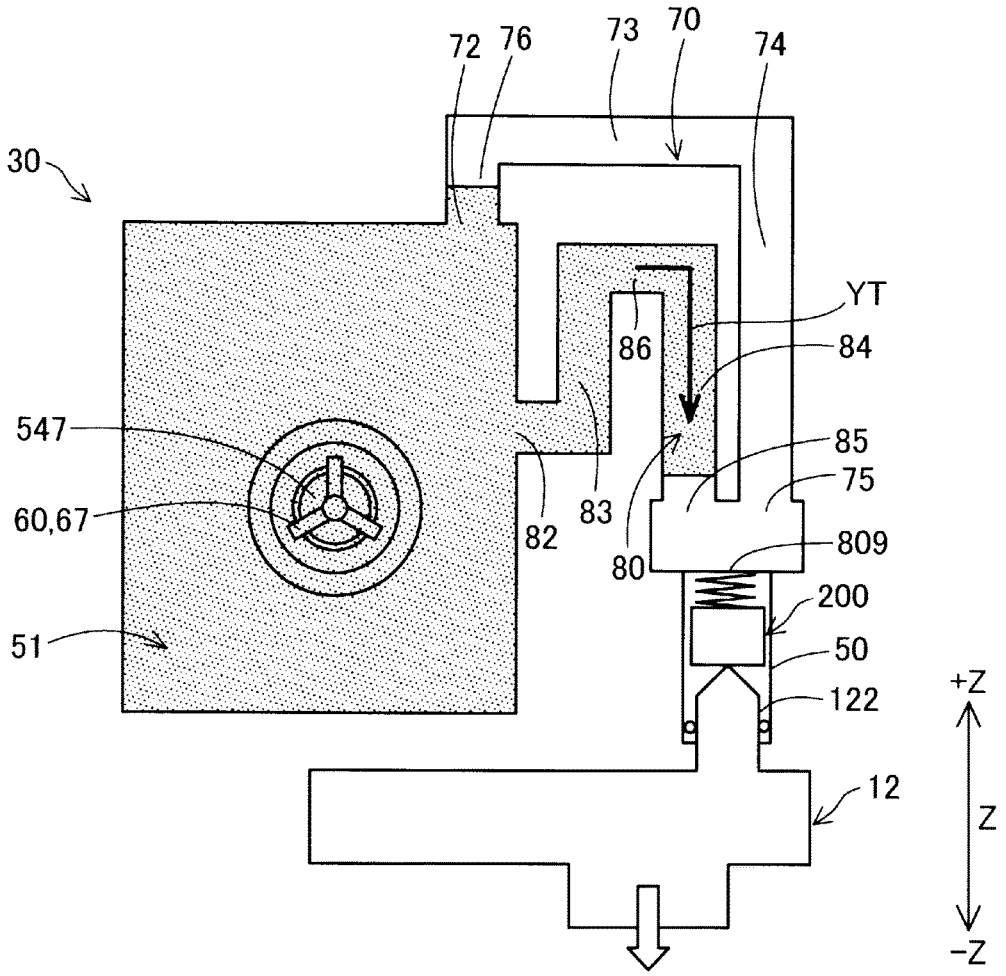
FIG. 14 is a second diagram for describing initial liquid filling.
Figure 15:
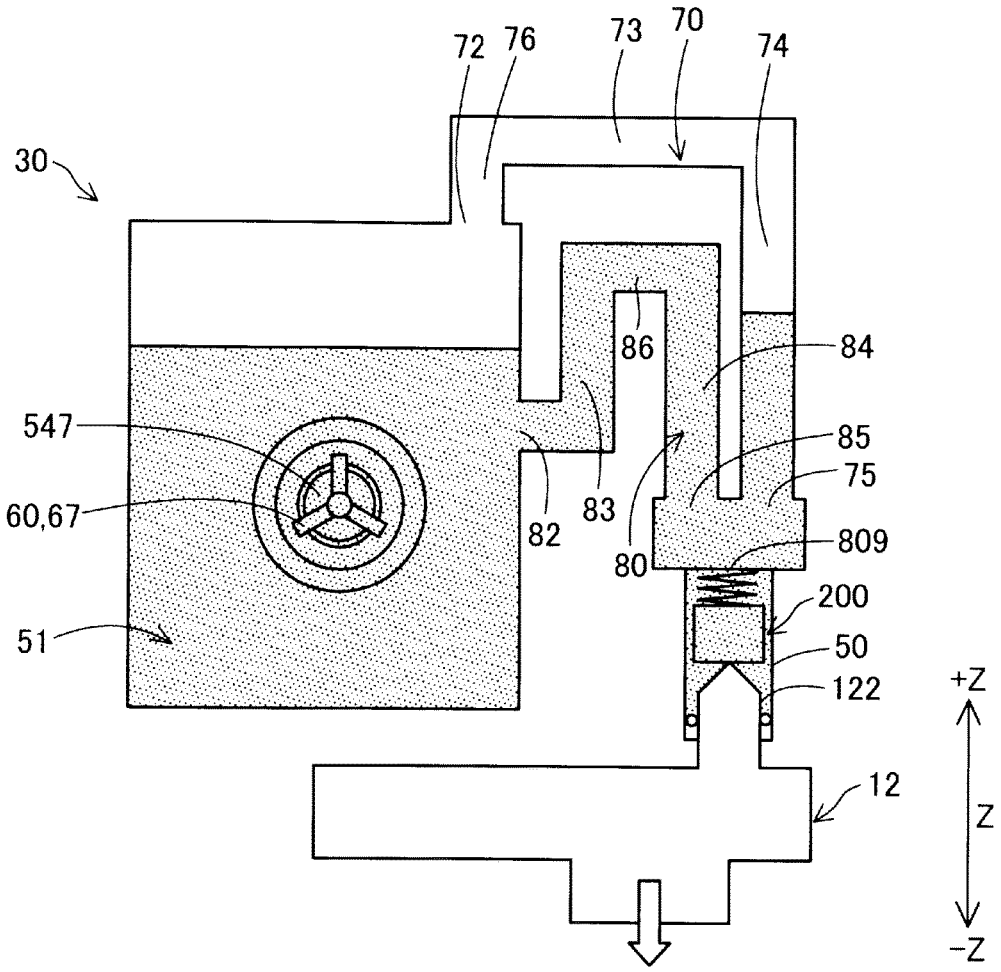
FIG. 15 is a third diagram for describing initial liquid filling.

Initial filling of the liquid tank 30 with liquid will be described with reference to FIGS. 13 to 15. FIG. 13 is the first diagram for describing initial liquid filling. FIG. 14 is the second diagram for describing initial liquid filling. FIG. 15 is the third diagram for describing initial liquid filling. In FIGS. 13 to 15, a region in which liquid exists is indicated by dots.

In initial liquid filling, liquid is first injected from the liquid inlet port 42 (FIG. 5) into the second liquid chamber 52 (FIG. 6). Next, as indicated by an arrow in FIG. 13, sucking (a discharging operation) of fluid (e.g., air or liquid) in the liquid tank 30 is started from the liquid ejection head 12 via the liquid supply portion 50. This suction is performed by driving the suction pump 16 of the discharge portion 18 (FIG. 2). If the pressure in the first liquid chamber 51 becomes a negative pressure due to this suction, the valve mechanism 60 enters an open state, and liquid in the second liquid chamber 52 flows into the first liquid chamber 51 via the inlet opening portion 547. Here, the flow of liquid to the liquid supply portion 50 is blocked by the ascending channel 83 of the liquid communication channel 80, and thus it is possible to suppress liquid from flowing into the liquid supply portion 50 from the first liquid chamber 51. On the other hand, as liquid flows into the first liquid chamber 51, air in the first liquid chamber 51 is discharged to the liquid ejection head 12 side through the air communication channel 70 and the liquid supply portion 50. Accordingly, the liquid level in the first liquid chamber 51 rises.

As shown in FIG. 14, when the liquid level in the first liquid chamber 51 rises, and reaches a height the same as the uppermost portion of the liquid communication channel 80, the flow of liquid into the liquid communication channel 80 is started, and as indicated by an arrow YT, liquid flows from the liquid communication channel 80 to the liquid supply portion 50 side. This flow from the liquid communication channel 80 to the liquid supply portion 50 side occurs rapidly due to suction from the suction pump 16 as well as the siphon phenomenon.

As shown in FIG. 15, when suction is further continued, liquid that has flowed into the liquid communication channel 80 flows into the air communication channel 70 via the connection portion 75 on the supply side. In addition, liquid that has flowed into the liquid communication channel 80 flows into the liquid supply portion 50 and the liquid ejection head 12. Due to liquid flowing into the air communication channel 70, air in the air communication channel 70 flows to the first liquid chamber 51. Due to air in the air communication channel 70 flowing into the first liquid chamber 51, the liquid level in the first liquid chamber 51 falls. However, compared with the volume of the air communication channel 70, the volume of the first liquid chamber 51 is sufficiently large, and thus it is possible to suppress a fall in the liquid level in the first liquid chamber 51 to an extent where the air reaches the upstream end 82. In other words, in the case where air having the volume of the air communication channel 70 has flowed into the first liquid chamber 51 from a state where the first liquid chamber 51 is filled with liquid, the upstream end 82 is connected to a position below a region of the first liquid chamber 51 in which air that has flowed in is positioned, in the mounted state. In this manner, it is possible to suppress the flow of air in the first liquid chamber 51 into the liquid communication channel 80 from the upstream end 82 after the liquid communication channel 80 is filled with liquid, and thus it is possible to reduce the likelihood of air bubbles flowing into the liquid ejection head 12 during initial filling.

In the above-described manner, initial filling of the first liquid chamber 51, the liquid communication channel 80, the liquid supply portion 50, and the liquid ejection head 12 with liquid is complete. After initial filling is complete, the suction pump 16 stops suctioning. Note that liquid in the first liquid chamber 51 when initial filling is complete does not exist in the entire region of the first liquid chamber 51, and air having about the same volume as that of the air communication channel 70 exists.

A-5. Liquid Tank 30 after Initial Liquid Filling

Figure 16:
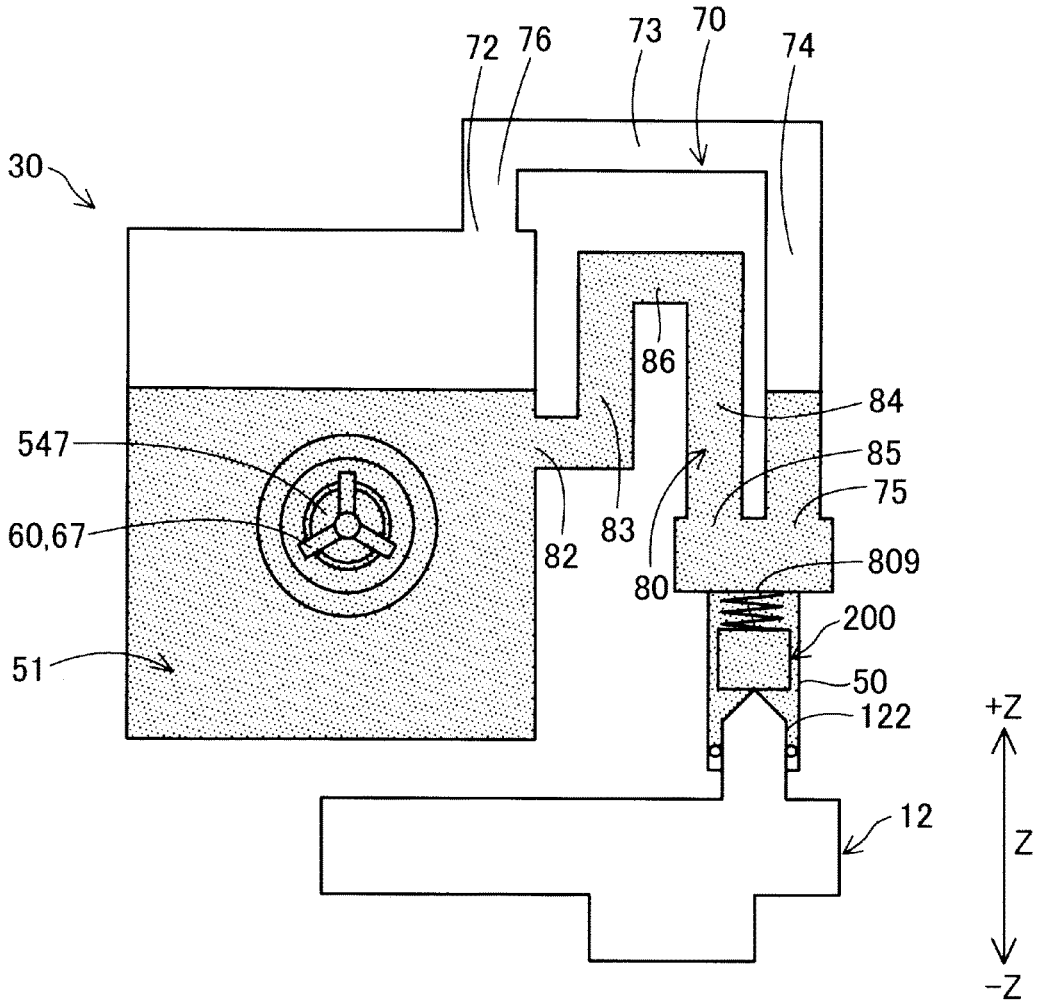
FIG. 16 is a first diagram for describing a liquid tank after initial liquid filling.
Figure 17:
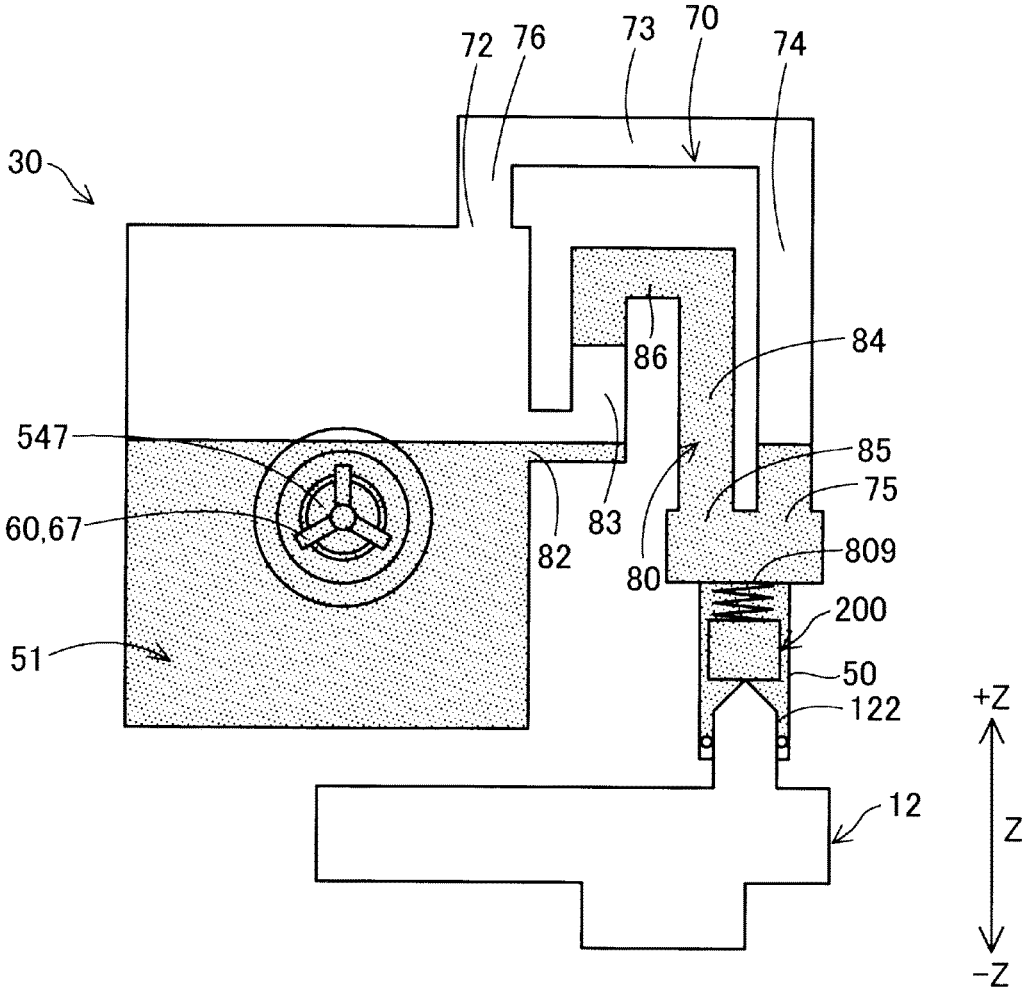
FIG. 17 is a second diagram for describing a liquid tank after initial liquid filling.
Figure 18:
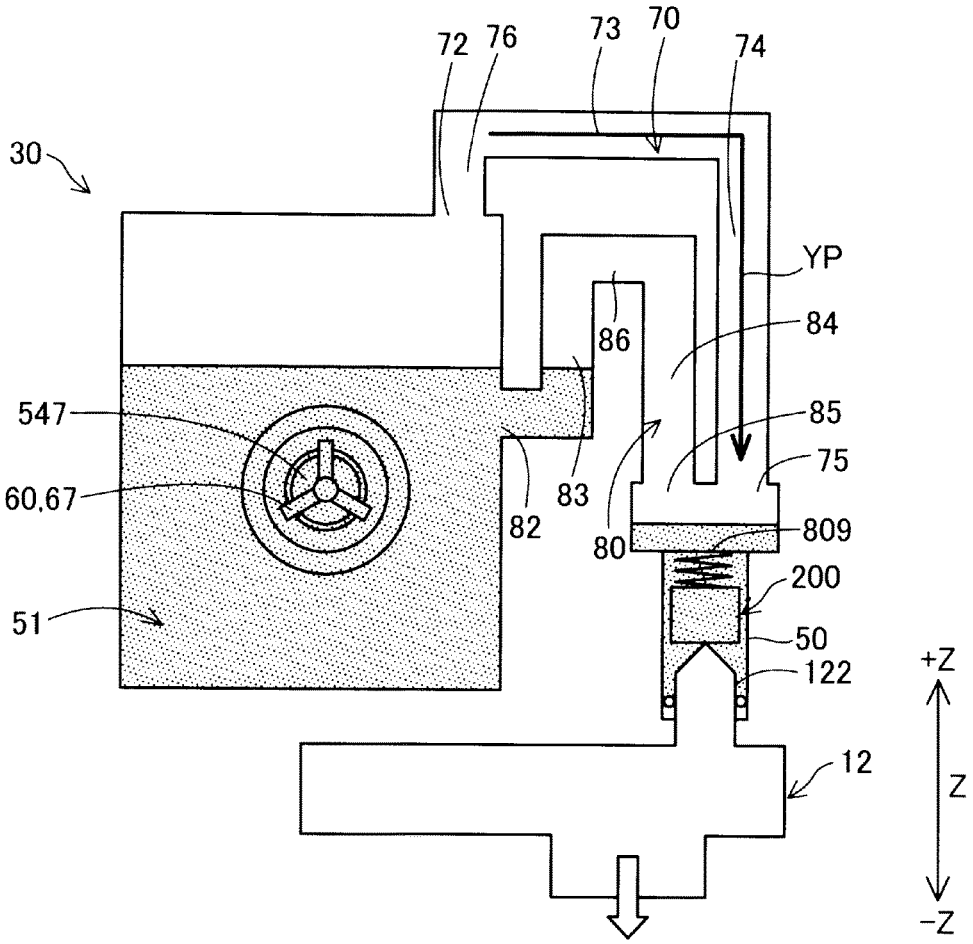
FIG. 18 is a third diagram for describing the liquid tank after initial liquid filling.
Figure 19:
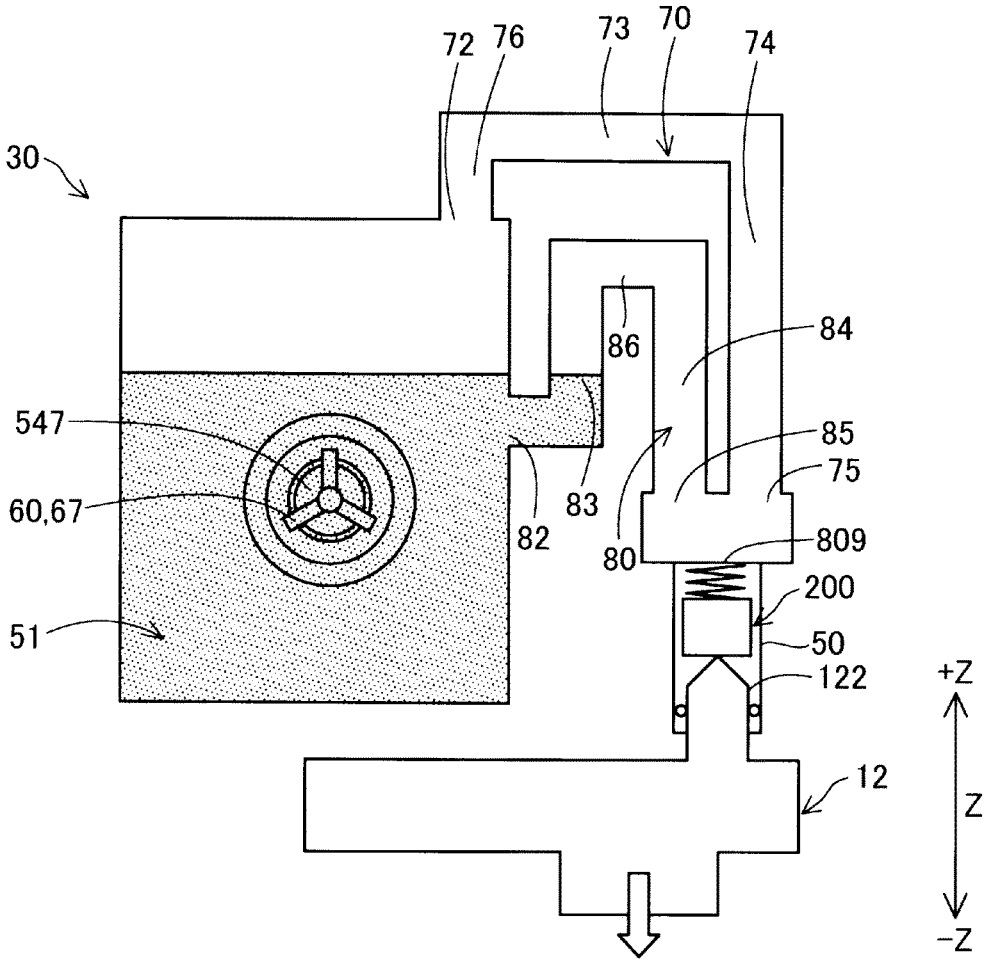
FIG. 19 is a fourth diagram for describing the liquid tank after initial liquid filling.
Figure 20:
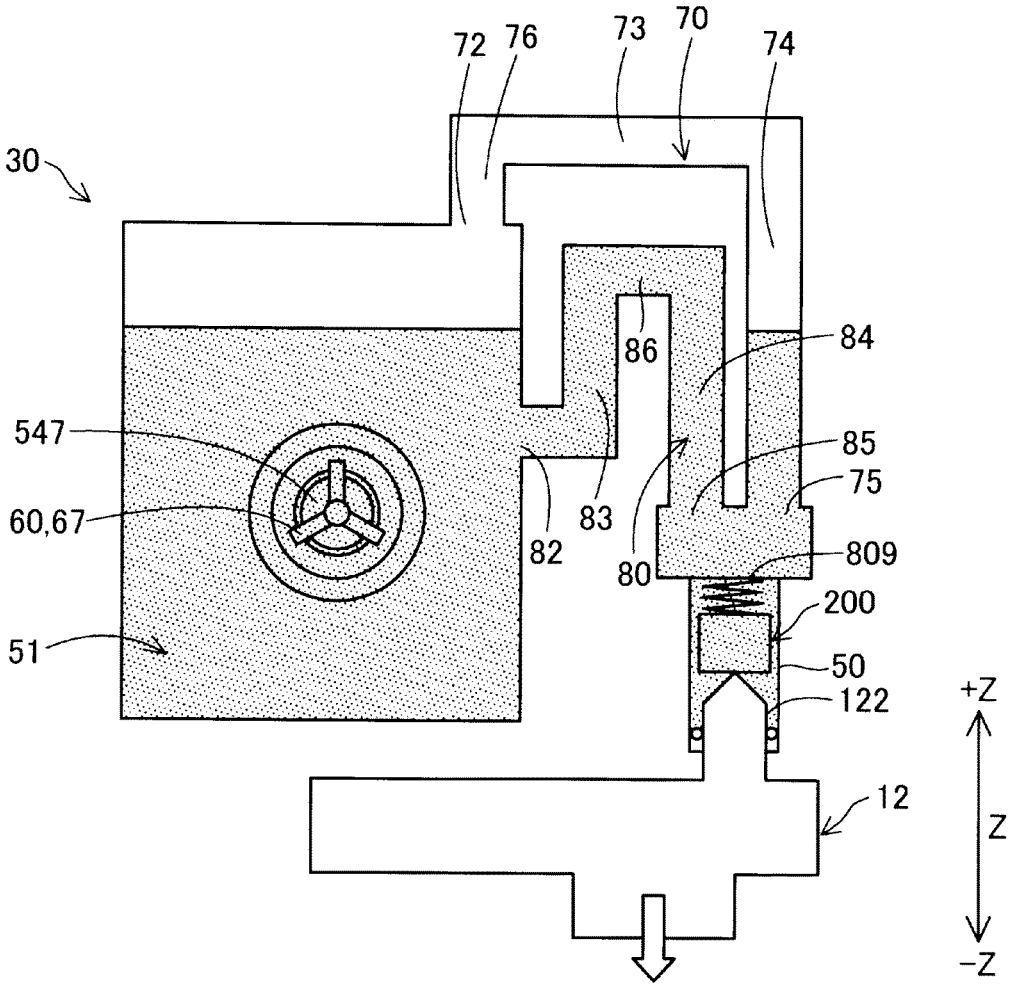
FIG. 20 is a fifth diagram for describing the liquid tank after initial liquid filling.

The liquid tank 30 after initial liquid filling will be described with reference to FIGS. 16 to 20. FIG. 16 is the first diagram for describing the liquid tank 30 after initial liquid filling. FIG. 17 is the second diagram for describing the liquid tank 30 after initial liquid filling. FIG. 18 is the third diagram for describing the liquid tank 30 after initial liquid filling. FIG. 19 is the fourth diagram for describing the liquid tank 30 after initial liquid filling. FIG. 20 is the fifth diagram for describing the liquid tank 30 after initial liquid filling. In FIGS. 16 to 20, regions in which liquid exists are indicated by dots.

As shown in FIG. 16, in the liquid tank 30 after initial liquid filling, as time elapses, air permeates the tank body 40 and the first film member 91 (FIG. 4), and gradually intrudes into the first liquid chamber 51 from the outside. Accordingly, air bubbles in the first liquid chamber 51 grow larger, and the liquid level in the first liquid chamber 51 falls. However, in the case where a long period of time has not elapsed after initial filling, the amount of air that flows from the outside to the first liquid chamber 51 is small, and thus a state where the liquid level in the first liquid chamber 51 is positioned above the upstream end 82 is maintained. In this state, it is possible to suppress the flow of air bubbles into the liquid ejection head 12 via the ascending channel 83, and thus it is possible to suppress the occurrence of nozzle omission that is a phenomenon in which liquid is not ejected from the liquid ejection head 12.

As shown in FIG. 17, in the case where time further elapses, air further intrudes into the first liquid chamber 51 from the outside, and air bubbles in the first liquid chamber 51 have further grown, the liquid level in the first liquid chamber 51 becomes lower than the upper end portion of the upstream end 82. In this case, the upstream end 82 comes into contact with air that exists in the first liquid chamber 51, and thus the air in the first liquid chamber 51 can flow to the liquid communication channel 80. In the case where air in the first liquid chamber 51 flows into the liquid communication channel 80, liquid in the liquid communication channel 80 (first liquid) and liquid in the second liquid chamber 52 (second liquid) are not continuously connected, and the first liquid and the second liquid are separated by air.

In the case where, in the state in FIG. 17, liquid is ejected from the liquid ejection head 12, and a recording operation (printing operation) is executed, a phenomenon to be described later arises. Specifically, as shown in FIG. 18, liquid in the liquid communication channel 80 is consumed, and, as indicated by an arrow YP, air in the first liquid chamber 51 flows to the liquid supply portion 50 side via the air communication channel 70. Furthermore, when the recording operation is executed, liquid in the liquid supply portion 50 is consumed as shown in FIG. 19, and air flows to the liquid ejection head 12 side, and thereby dot omission can occur.

In the case where, as shown in FIG. 19, air flows to the liquid ejection head 12 side, and dot omission occurs, the user operates the operation unit 4 (FIG. 1) so as to cause the discharge portion 18 to execute a discharging operation. Accordingly, after a process similar to initial liquid filling (FIGS. 14 to 15) has been carried out, the liquid communication channel 80, the liquid supply portion 50, and the liquid ejection head 12 are filled with liquid as shown in FIG. 20. In addition, when the amount of liquid in the second liquid chamber 52 is small, the user injects liquid from the liquid inlet port 42 (FIG. 4) into the second liquid chamber 52. Here, in the case where liquid in the liquid communication channel 80 flows due to a recording operation (printing operation) of the liquid ejection head 12 or a discharging operation that is performed by the discharge portion 18, the pressure on the downstream side of the liquid communication channel 80 decreases as a result of a pressure loss in the liquid communication channel 80. However, the degree of decrease in pressure is very small, and thus the liquid level of the air communication channel 70 on the side of the connection portion 75 on the supply side hardly falls. Thus, the likelihood of air bubbles flowing from the air communication channel 70 into the liquid supply portion 50 is reduced.

Note that a configuration may be adopted in which the liquid ejection head 12 is additionally provided with a sensor that detects the flow of air from the liquid tank 30 into the liquid ejection head 12, and in the case where the flow of air into the liquid ejection head 12 is detected by the sensor, the liquid ejection apparatus 1 may notify the user to prompt execution of a discharging operation. For example, this notification may be performed by additionally providing a display unit in the front face 103 (FIG. 1), and displaying, on this display unit, a message for prompting execution of a discharging operation.

A-6. Detailed Configuration of Division Wall 600

Figure 21:
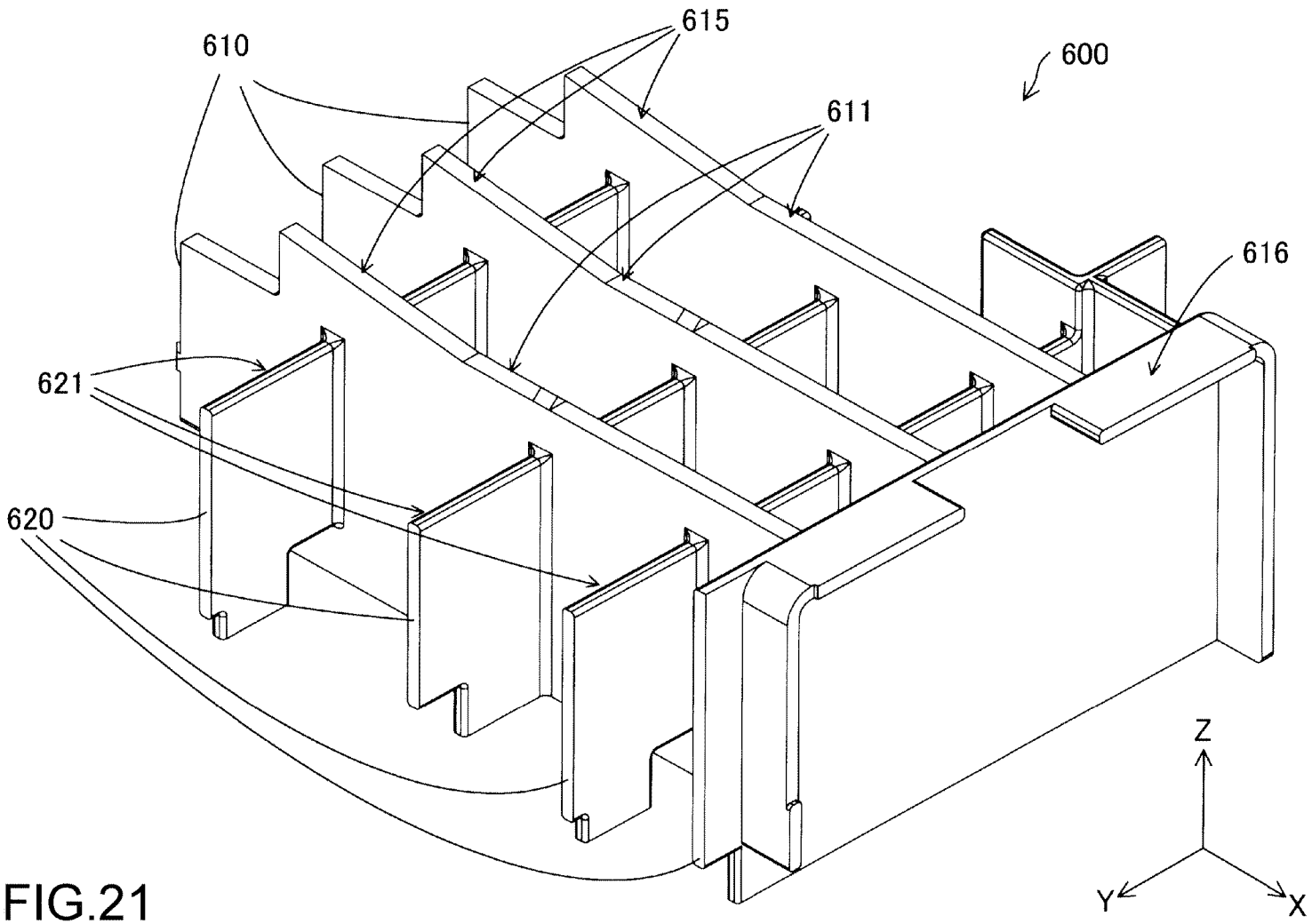
FIG. 21 is a first perspective view of division walls.
Figure 22:
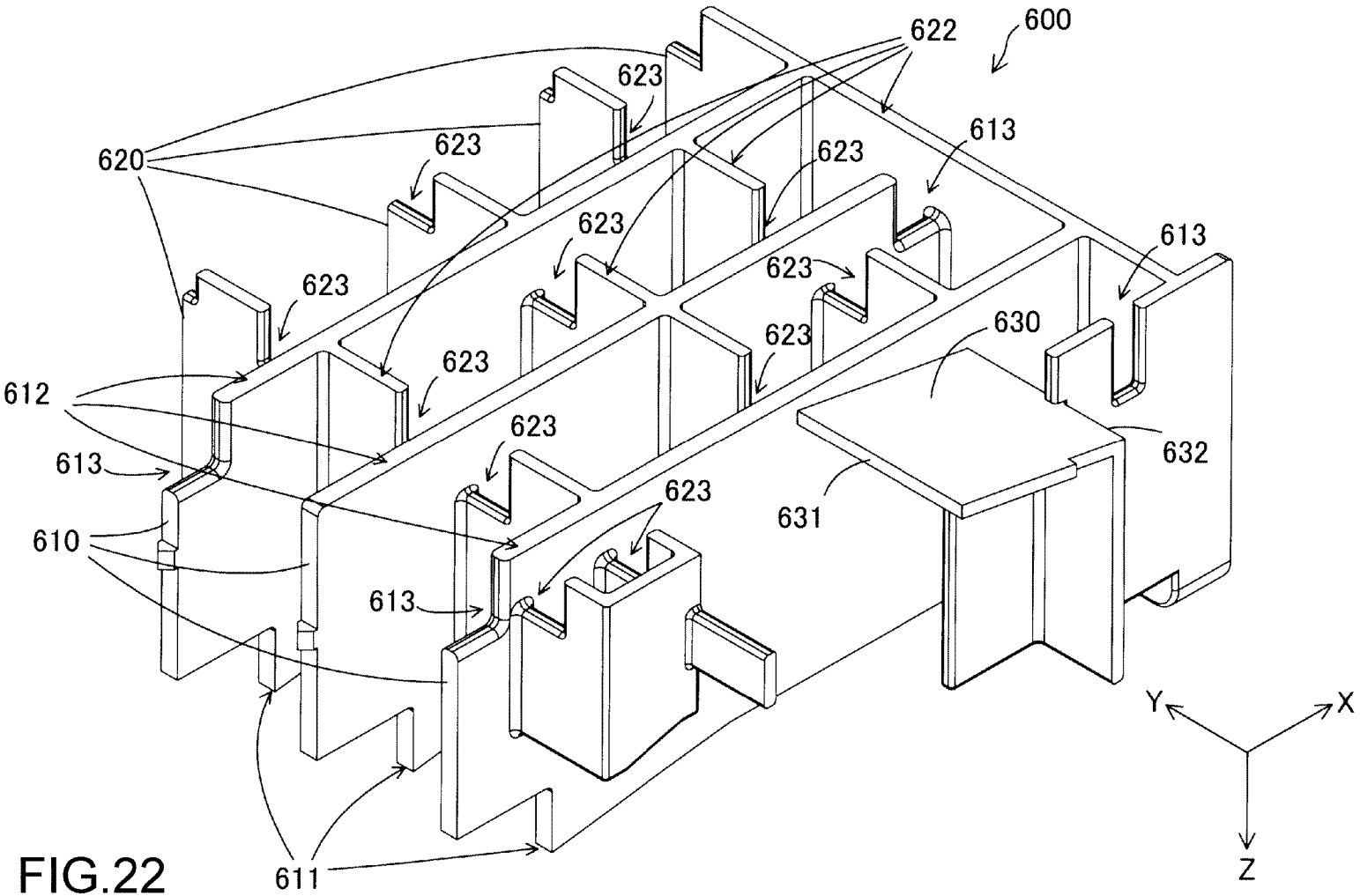
FIG. 22 is a second perspective view of division walls.
Figure 23:
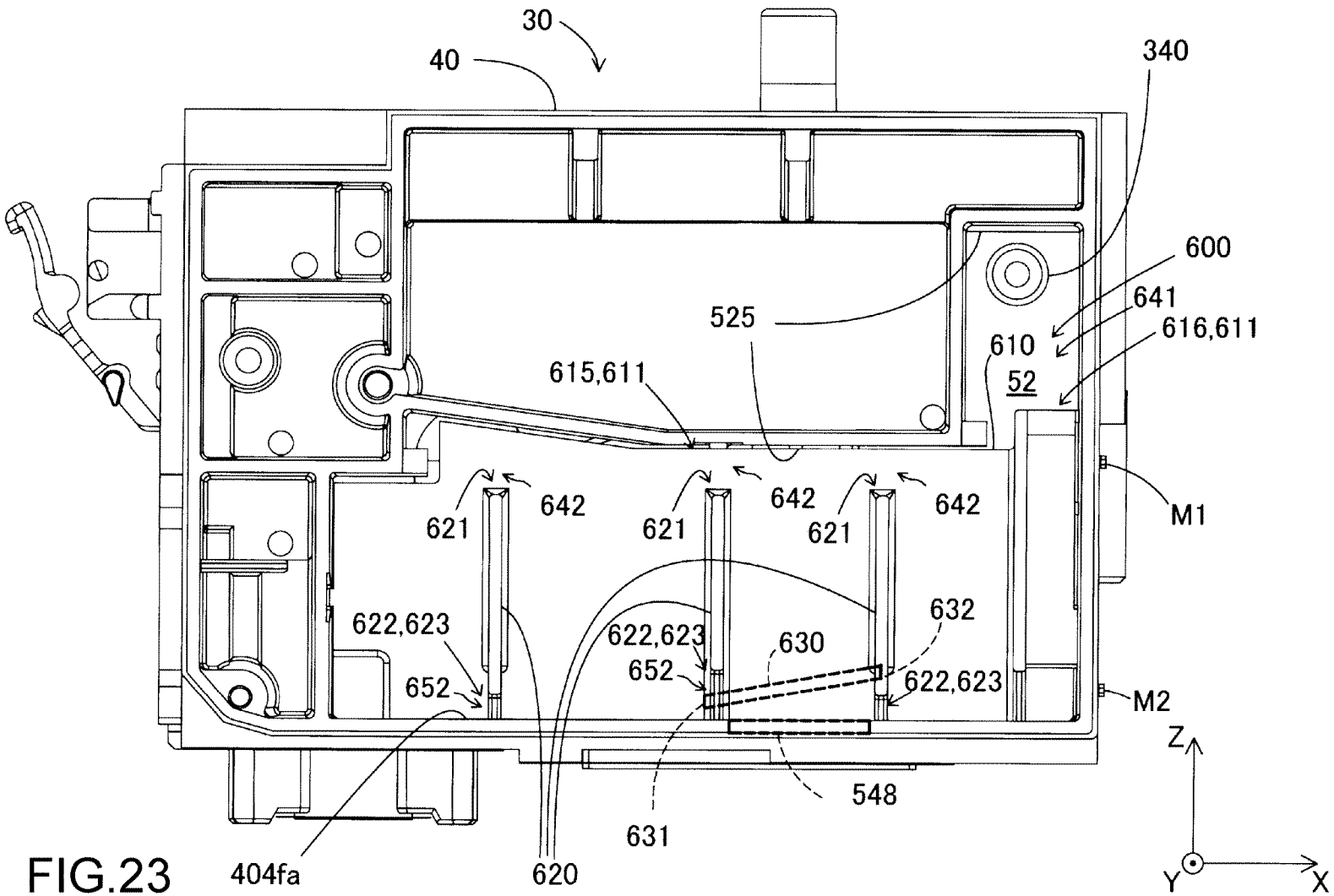
FIG. 23 is a diagram of a tank body equipped with division walls and viewed from the +Y direction.
Figure 24:
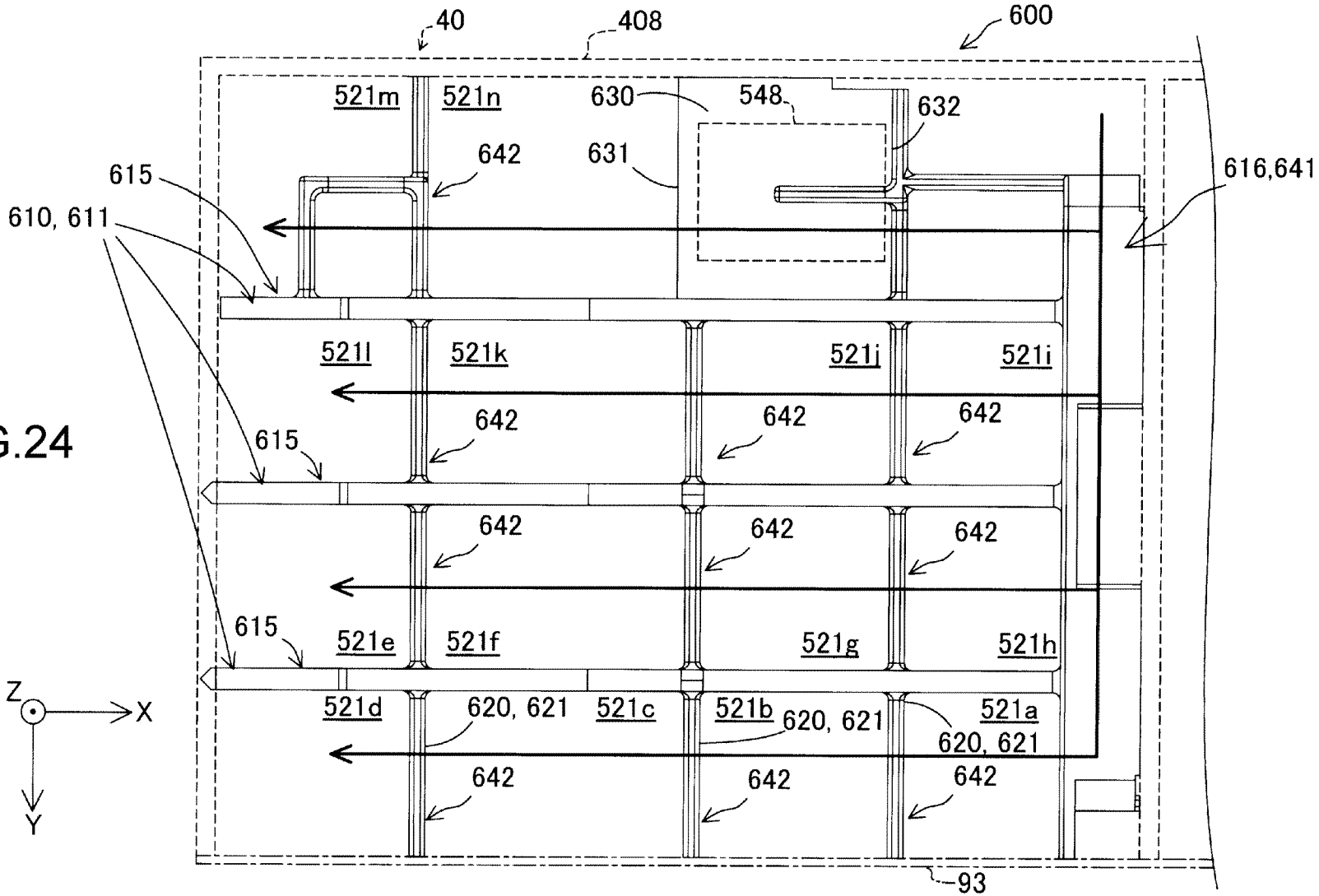
FIG. 24 is a diagram of the division walls viewed from a +Z axis direction.
Figure 25:
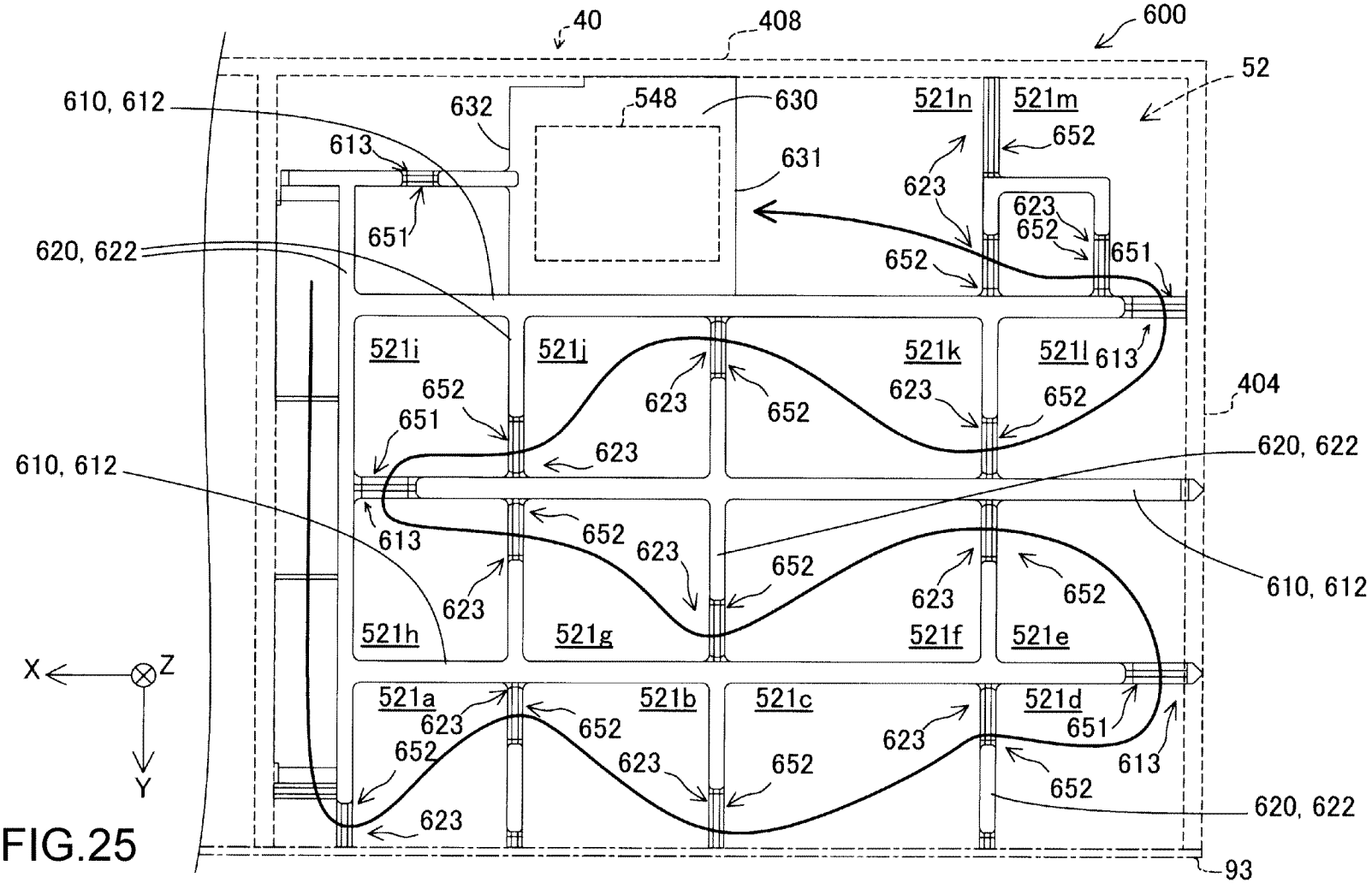
FIG. 25 is a diagram of the division walls viewed from a −Z axis direction.

FIG. 21 is the first perspective view of the division wall 600. FIG. 22 is the second perspective view of the division wall 600. FIG. 23 is a diagram of the tank body 40 on which the division wall 600 is mounted, and that is viewed from the +Y direction. FIG. 24 is a diagram of the division wall 600 viewed from the +Z direction. FIG. 25 is a diagram of the division wall 600 viewed from the −Z direction. The structure of the division wall 600 will be described below with reference to FIGS. 21 to 25. In FIGS. 24 and 25, the tank body 40 in which the division wall 600 is mounted is indicated by broken lines, and the third film member 93 is indicated by dashed-dotted lines. In addition, FIGS. 24 and 25 illustrate small liquid chambers 521*a* to 521*n* that are formed when the division wall 600 is mounted to the tank body 40.

The division wall 600 (FIG. 22) has first division walls 610, second division walls 620, and an opposing wall 630. As a result of being housed in the second liquid chamber 52, and mounted, the division wall 600 demarcates and forms a plurality of the small liquid chambers 521*a* to 521*n* (FIG. 24) from the second liquid chamber 52. The small liquid chambers 521*a* to 521*n* are in communication with each other via upper communication portions 641 and 642 (FIG. 24) and lower communication portions 651 and 652 (FIG. 25).

The first division wall 610 is a wall perpendicular to the Y direction in the mounted state in which the liquid tank 30 is mounted on the carriage 19. Here, "perpendicular" to the Y direction means "generally perpendicular", and means that an angle formed by the Y direction and the first division wall 610 (this angle is an acute angle or a right angle) is an angle in the range of 85° or more and 90° or smaller. In this embodiment, three first division walls 610 are provided.

In the mounted state, a first division wall 610 (FIG. 23) has an abutting portion 615 that abuts against a ceiling face 525 of the second liquid chamber 52 and a non-abutting portion 616 that forms a gap with the ceiling face 525 of the second liquid chamber 52. The abutting portion 615 and the non-abutting portion 616 form an upper end portion 611 of the first division wall 610.

The non-abutting portion 616 is higher than the upper limit sign M1, and lower than the ceiling face 525 of the second liquid chamber 52 (FIG. 23). Specifically, the upper end portion 611 that is an end portion of the first division wall 610 on the upper side is positioned between the upper limit sign M1 and the ceiling face 525 of the second liquid chamber 52, in the mounted state. In the case where the first division wall 610 is higher than the upper limit sign M1, compared with the case where the first division wall 610 is lower than the upper limit sign M1, it is possible to further suppress liquid contained in the second liquid chamber 52 from moving over the first division wall 610. As shown in FIG. 23, in the mounted state, the non-abutting portion 616 is positioned below the atmospheric air introduction portion 340.

A second division wall 620 (FIG. 21) is a wall parallel to the Y direction and the Z direction in the mounted state in which the liquid tank 30 is mounted on the carriage 19. The second division wall 620 intersects the first division walls 610. Here, "parallel" to the Y direction and the Z direction means "generally parallel", and means that an angle formed between the Y direction, the Z direction, and the second division wall 620 (this angle is an acute angle) is an angle in the range of 0° or more 5° or less. In the mounted state, an upper end portion 621 of the second division wall 620 (FIG. 23) is positioned below the upper limit sign M1. In addition, the second division wall 620 has a lower end recessed portion 623 (FIG. 22) in a lower end portion 622. The lower end recessed portion 623 has a recessed shape with an opening at least on the lower side. In this embodiment, four second division walls 620 are provided.

The upper communication portions 641 and 642 (FIG. 24) are through holes (gaps) for allowing air to flow between adjacent chambers out of the small liquid chambers 521*a* to 521*n*. The first upper communication portion 641 (FIG. 24) is a gap between the upper end portion 611 of the first division wall 610 and the ceiling face 525 of the second liquid chamber 52. The second upper communication portion 642 (FIG. 24) is a gap between the second division walls 620 and the ceiling face 525 of the second liquid chamber 52 (FIG. 23).

The lower communication portions 651 and 652 (FIG. 25) are through holes (gaps) that allow liquid to flow between adjacent chambers out of the small liquid chambers 521*a* to 521*n*. In this embodiment, the first lower communication portion 651 (FIG. 25) is a gap between a lower end recessed portion 613 and the bottom face 404*fa* of the second liquid chamber 52. The second lower communication portion 652 is a gap between the lower end recessed portion 623 and the bottom face 404*fa* of the second liquid chamber 52 (FIG. 23). The lower communication portions 651 and 652 (FIG. 23) are positioned below the upper limit sign M1 in the mounted state.

The opposing wall 630 (FIG. 23) is a wall provided so as to be opposed to the filter chamber 542 provided in the bottom face 404*fa* of the second liquid chamber 52 (specifically, the liquid outlet 548 that is the upstream end of the filter chamber 542) in the mounted state. Here, when viewed from the Z direction, the opposing wall 630 is arranged at a position such that the liquid outlet 548 is hidden, in the mounted state. The opposing wall 630 is connected to the first division wall 610. Here, the opposing wall 630 is inclined relative to the horizontal direction, in the mounted state. In this embodiment, the opposing wall 630 is inclined relative to the horizontal direction to be positioned upward from one end portion 631 of the opposing wall 630 toward the other end portion 632. An angle formed between the horizontal direction and the opposing wall 630 is 10°, for example. The other end portion 632 of the opposing wall 630 is arranged at an interval from another member in order to release air bubbles upward. In addition, as shown in FIG. 23, in the mounted state, the distance between the one end portion 631 positioned on the lowermost side of the opposing wall 630 and the bottom face 404*fa* of the second liquid chamber 52 is about 1 mm. In addition, the distance between the other end portion 632 positioned on the uppermost side of the opposing wall 630 and the bottom face 404*fa* of the second liquid chamber 52 is about 4.6 mm. Note that the one end portion 631 is positioned below the lower limit sign M2 in the mounted state. In the case where the opposing wall 630 is inclined relative to the horizontal direction, air bubbles adhered to the filter member 541 of the filter chamber 542 can be prevented from adhering to the opposing wall 630, compared with the case where the opposing wall 630 is not inclined. It is preferred that a gap that can hold liquid using a capillary force is provided between the bottom face 404*fa* and the opposing wall 630. Accordingly, even in the case where the amount of liquid is small, it is possible to suppress exposure of the liquid outlet 548 to air. Note that, as shown in FIG. 25, the opposing wall 630 and the liquid outlet 548 are provided in the small liquid chamber 521*n* between the one side wall 408 that is a side wall orthogonal to the horizontal direction and demarcates the second liquid chamber 52 and the first division wall 610 that is opposed to the one side wall 408. Accordingly, rippling can be suppressed in a region in which the filter chamber 542 that has the liquid outlet 548 is arranged, and thus it is possible to reduce the likelihood of the filter chamber 542 coming into contact with air. Accordingly, it is possible to reduce the likelihood of air bubbles flowing into the liquid ejection head 12.

Arrows shown in FIG. 24 schematically indicate a flow of air when the air that has been taken in from the atmospheric air introduction portion 340 as liquid in the second liquid chamber 52 is consumed flows within the second liquid chamber 52. In this embodiment, the liquid tank 30 has 14 small liquid chambers 521*a* to 521*n*. Air that has flowed in from the atmospheric air introduction portion 340 moves to the small liquid chambers 521*a* to 521*n* via the upper communication portions 641 and 642.

An arrow shown in FIG. 25 schematically indicates a flow of liquid that flows within the second liquid chamber 52 as liquid is consumed. The liquid in the second liquid chamber 52 moves toward the downstream side through the small liquid chambers 521*a* to 521*n* via the lower communication portions 651 and 652 as liquid is consumed. Liquid injected from the liquid inlet port 42 also moves within the second liquid chamber 52 in a similar flow. As described above, movement of air via the upper communication portions 641 and 642 and movement of liquid via the lower communication portions 651 and 652 equalize the heights of the liquid surfaces in the small liquid chambers 521*a* to 521*n*.

The first lower communication portions 651 provided in two opposing first division walls 610 are provided at positions so as to not be opposed. Here, the first lower communication portions 651 not being opposed means that, when viewed from the Y direction, the first lower communication portions 651 are at positions that do not overlap each other. The second lower communication portions 652 provided in two opposing second division walls 620 are provided at positions so as to not be opposed. Here, the second lower communication portions 652 not being opposed means that, when viewed from the X direction, the second lower communication portions 652 are at positions that do not overlap each other. In the flow direction of liquid, by providing adjacent first lower communication portions 651 at positions so as to not oppose each other and providing adjacent second lower communication portions 652 at positions so as to not to oppose each other, the flow path of liquid can be made to meander. Therefore, the moving distance of liquid that moves from the upstream side of the second liquid chamber 52 to the liquid outlet 548 can be increased. Accordingly, even in the case where air bubbles are included in liquid, it is possible to further reduce air bubbles in the liquid while the liquid is moving to the liquid outlet 548, and thus it is possible to reduce the likelihood of air bubbles flowing into the liquid outlet 548.

Figure 26:
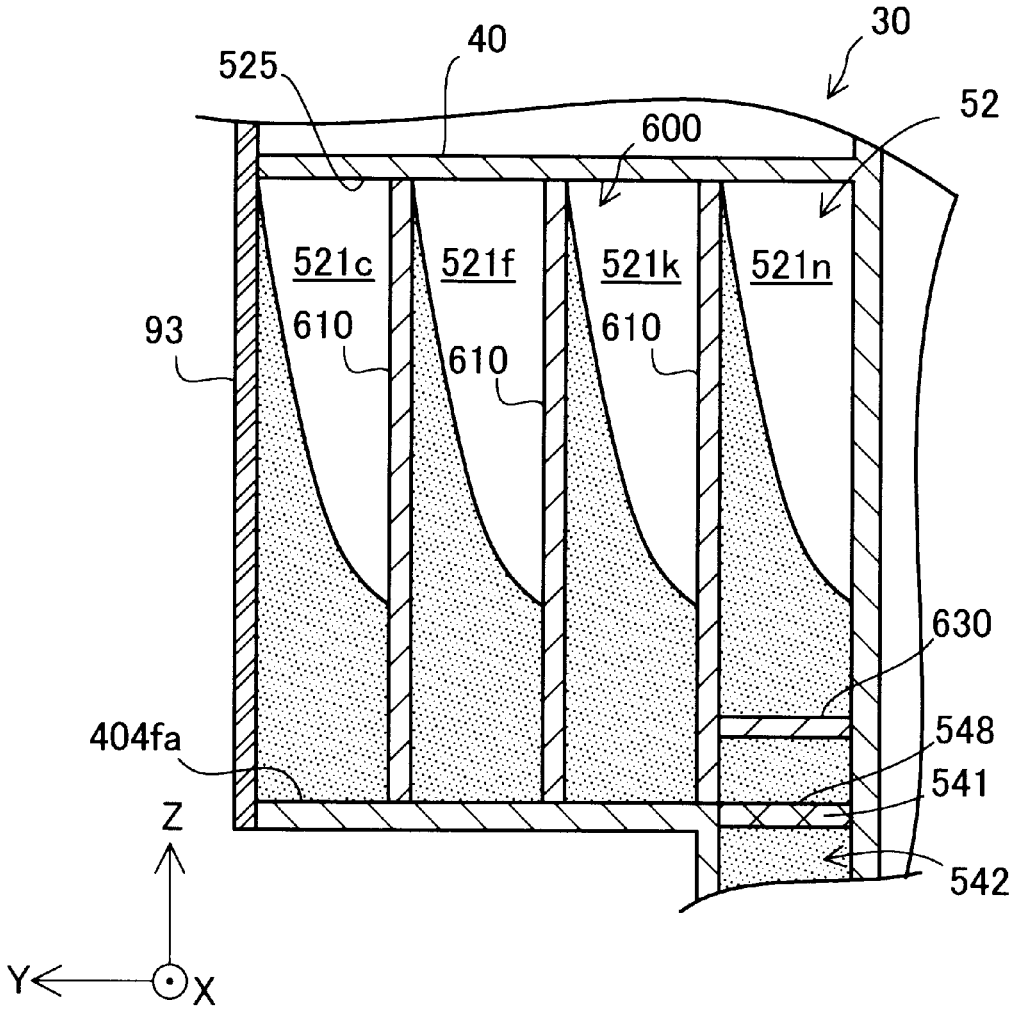
FIG. 26 is a first schematic diagram for describing an effect of the division walls.
Figure 27:
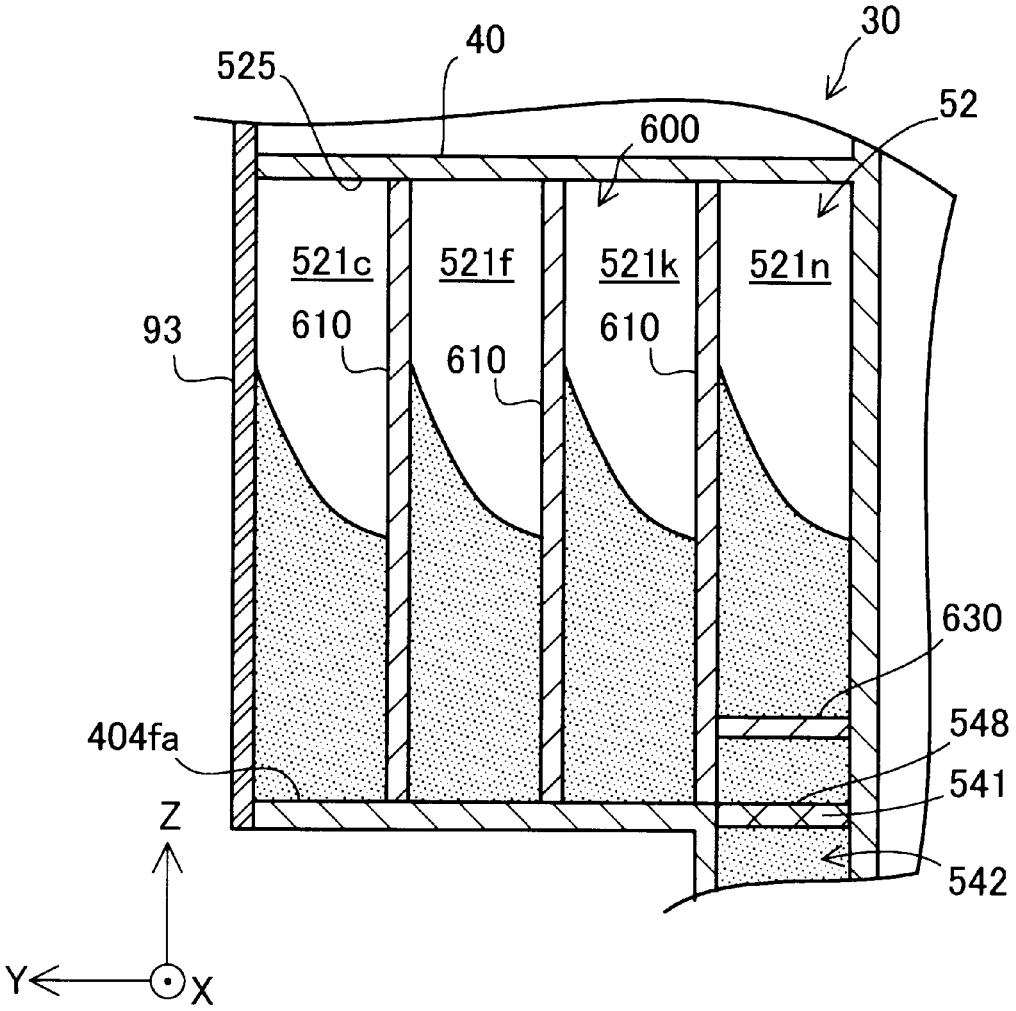
FIG. 27 is a second schematic diagram for describing an effect of the division walls.

FIG. 26 is a first diagram for describing an effect of the division wall 600. FIG. 27 is a second diagram for describing an effect of the division wall 600. FIGS. 26 and 27 are schematic diagrams in the case where the second liquid chamber 52 of the liquid tank 30 that has the division wall 600 is viewed from the −X direction, and are diagrams for describing movement of liquid in the second liquid chamber 52 that accompanies scanning by the carriage 19. Specifically, FIG. 26 shows movement of liquid when the carriage 19 that has moved to the +Y direction decelerates, and stops moving. FIG. 27 shows the movement of liquid when the carriage 19 that has stopped as shown in shown in FIG. 26 accelerates and moves in the −Y direction. In the liquid tank 30 in FIGS. 26 and 27, liquid of about a half of the volume of the second liquid chamber 52 is contained in the second liquid chamber 52. Note that liquid contained in the liquid tank 30 is indicated by dots.

Due to an abrupt change in acceleration of the carriage 19, a force (inertia force) is applied to the liquid in the second liquid chamber 52 in the direction (e.g., the +Y direction) opposite to the Y direction (e.g., the −Y direction) that is the direction of movement of the carriage 19. An abrupt change in acceleration of the carriage 19 occurs, for example, when the carriage 19 stops moving in the +Y direction, and accelerates and moves in the −Y direction, in other words, the carriage 19 turns back reciprocal movement. As shown in FIG. 26, when the carriage 19 decelerates and movement in the +Y direction and stops, liquid moves upward along wall faces due to motion energy from an inertia force, and ripples. Here, the wall faces are wall faces that demarcate the small liquid chambers 521*a* to 521*n*, in other words, wall faces that define the first division walls 610 or the second liquid chamber 52. The liquid tank 30 according to this embodiment has the division wall 600, and thus the volume of the small liquid chambers 521*a* to 521*n* is smaller than the volume of the entire second liquid chamber 52. Accordingly, compared with the case where the division wall 600 is not provided, motion energy that is applied to liquid in each of the small liquid chambers 521*a* to 521*n* is decreased, and the amount of liquid that moves upward along the wall faces and ripples is reduced, in the liquid tank 30. Therefore, the height difference of liquid surfaces can be reduced, and thus the amount of liquid that collides with the ceiling face 525 can be made small.

When the carriage 19 that has stopped moving in the +Y direction accelerates and moves in the −Y direction, an inertia force in the +Y direction is applied. As shown in FIG. 27, in the liquid tank 30 according to this embodiment, when the moving speed of the carriage 19 approaches the moving speed at the time of movement at a constant speed, and acceleration in the −Y direction is reduced, the inertia force that is applied to the liquid becomes smaller than that at the time of turning back. When the inertia force decreases, the liquid that has moved upward along the wall faces moves downward due to gravity. At this time, in this embodiment, the height difference of liquid surfaces when the carriage 19 turns back (stops) is small, and in addition, the amount of liquid that collides with the ceiling face 525 is small, and thus there is no large curve in the liquid column, and the liquid level returns to the original level. The original level is the height of the liquid surface in the case where the carriage 19 is moving at a constant speed. Therefore, the liquid tank 30 can suppress the generation of air bubbles due to a collision between the liquid column that has collapsed and the liquid surface.

Figure 28:
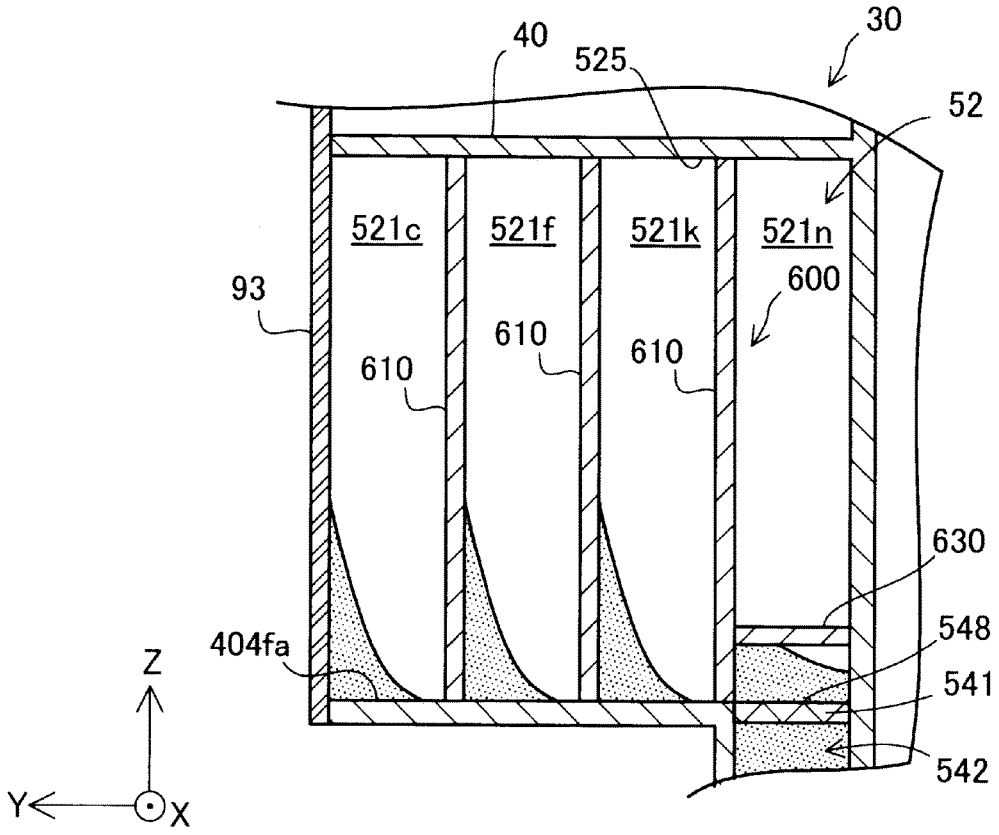
FIG. 28 is a third schematic diagram for describing an effect of the division walls.

FIG. 28 is a third schematic diagram for describing an effect of the division wall 600. FIG. 28 is a schematic diagram in the case where the second liquid chamber 52 of the liquid tank 30 that has the division wall 600 is viewed from the −X direction, and is a diagram for describing the movement of liquid in the second liquid chamber 52 when the carriage 19 turns. In the liquid tank 30 in FIG. 28, the second liquid chamber 52 contains liquid of the amount indicated by the lower limit sign M2, to which liquid has been used. Note that liquid contained in the liquid tank 30 is indicated by dots.

In the case where the amount of liquid contained in the second liquid chamber 52 is small, it is highly possible that the bottom face 404*fa* of the second liquid chamber 52 is exposed to the air due to the movement of liquid, compared with the case where the amount of liquid contained in the second liquid chamber 52 is large. In the case where the liquid outlet 548 formed in the bottom face 404*fa* is exposed to air, there is a risk that air bubbles will flow into the filter chamber 542 via the liquid outlet 548, and a failure such as a printing error of the liquid ejection apparatus 1 may occur. The liquid tank 30 has the opposing wall 630. Therefore, movement of liquid that moves upward along wall faces that demarcate the small liquid chambers 521*a* to 521*n* that have the liquid outlet 548, in other words, the first division walls 610, due to an abrupt change in acceleration can be suppressed using the opposing wall 630. In other words, the height of a wave that is formed in an upper portion of the liquid outlet 548 can be suppressed by the opposing wall 630. Accordingly, it is possible to reduce the likelihood of the liquid outlet 548 coming into contact with air, and thus it is possible to reduce the likelihood of air bubbles flowing into the liquid ejection head 12.

Figure 29:
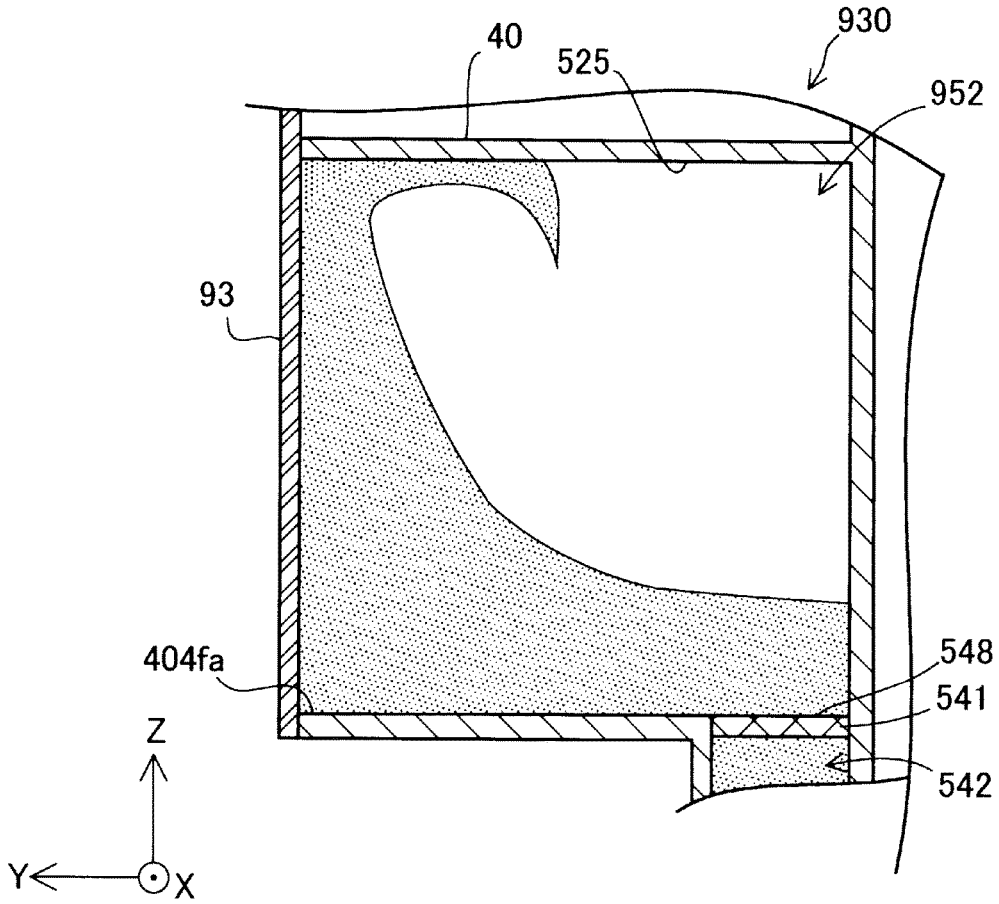
FIG. 29 is a first diagram for describing a second liquid chamber of a liquid tank according to a comparative example.
Figure 30:
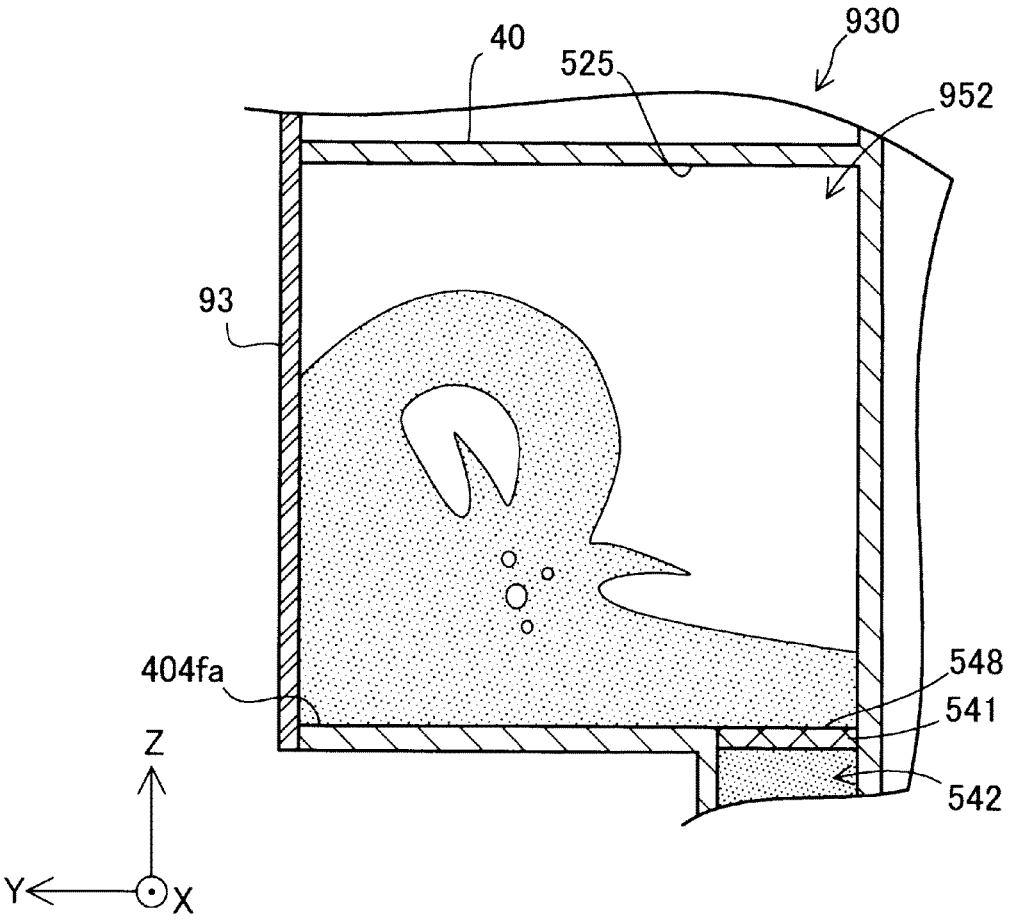
FIG. 30 is a second diagram for describing a second liquid chamber of a liquid tank according to a comparative example.
Figure 31:
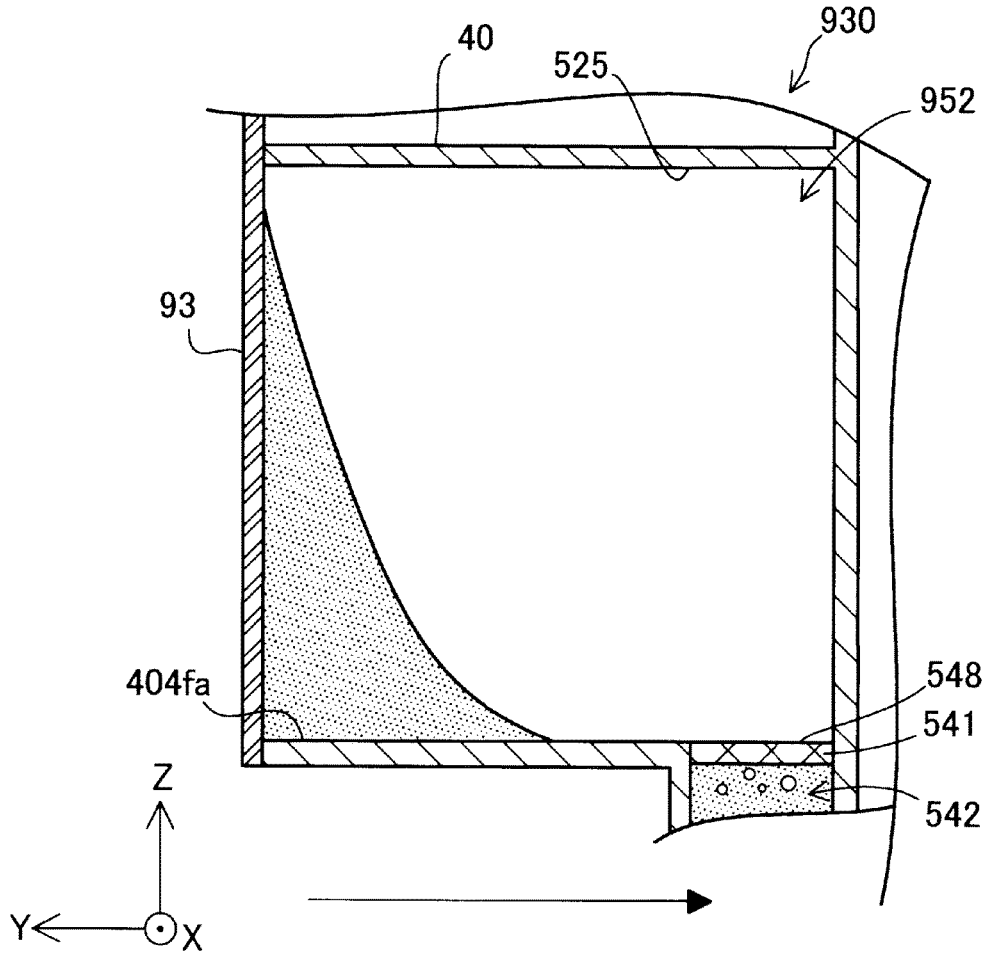
FIG. 31 is a third diagram for describing a second liquid chamber of a liquid tank according to a comparative example.

FIG. 29 is a first diagram for describing a second liquid chamber 952 of a liquid tank 930 according to a comparative example. FIG. 30 is a second diagram for describing the second liquid chamber 952 of the liquid tank 930 according to the comparative example. FIG. 31 is a third diagram for describing the second liquid chamber 952 of the liquid tank 930 according to the comparative example. FIGS. 29 to 31 show schematic diagrams of a case where the second liquid chamber 952 of the liquid tank 930 is viewed from the −X direction. The liquid tank 930 according to the comparative example is different from the liquid tank 30 according to the embodiment in that the division wall 600 is not mounted in the second liquid chamber 952. Similar reference numerals are assigned to constituent elements similar to those of the liquid tank 30 according to the embodiment from among constituent elements of the liquid tank 930 according to the comparative example, and the similar constituent elements will be described below.

In the liquid tank 930 in FIGS. 29 and 30, liquid of about a half of the volume of the second liquid chamber 952 is contained in the second liquid chamber 952. FIGS. 29 and 30 are schematic diagrams of the case where the second liquid chamber 952 of the liquid tank 930 according to the comparative example is viewed from the −X direction, and is a diagram for describing movement of liquid in the second liquid chamber 952 that accompanies scanning by the carriage 19. Specifically, FIG. 29 shows the movement of liquid when the carriage 19 that has moved in the +Y direction decelerates, and stops moving. FIG. 30 shows the movement of liquid when the carriage 19 that has stopped as shown in FIG. 29 accelerates and moves in the −Y direction. Note that, in FIGS. 29 and 30, liquid contained in the liquid tank 930 is indicated by dots, and air bubbles included in the liquid are indicated by hollow circles. Due to an abrupt change in acceleration, a force (inertia force) is applied to liquid in the second liquid chamber 952 in the direction (e.g., the −Y direction) opposite to the Y direction (e.g., the +Y direction) that is the direction of movement of the carriage 19. As shown in FIG. 29, when the carriage 19 decelerates and stops moving in the +Y direction, liquid moves upward along wall faces that define the second liquid chamber 952 due to motion energy from the inertia force, and ripples. The force (motion energy) that is applied to the liquid in the second liquid chamber 952 of the liquid tank 930 according to the comparative example is larger than a force (motion energy) that is applied to liquid in each of the small liquid chambers 521*a* to 521*n* according to the embodiment. Therefore, in the comparative example, the amount of liquid that collides with the ceiling face 525 is large compared to the embodiment. When the carriage 19 that has stopped moving in the +Y direction moves in the −Y direction, an inertia force is applied in the direction opposite to that of the inertia force that was applied at the time of the stopping. As shown in FIG. 30, in the liquid tank 930 according to the comparative example, when the moving speed of the carriage 19 approaches the moving speed at the time of movement at a constant speed, and the acceleration in the −Y direction decreases, the inertia force that is applied to the liquid becomes smaller than that at the time of turning. When the inertia force decreases, the liquid that has moved upward along the wall faces moves downward due to gravity. At this time, in the comparative example, compared with the embodiment, the height difference of the liquid surfaces when the carriage 19 turns back (stops) is large, and the amount of liquid that collides with the ceiling face 525 is large, and thus there is a large curve in the liquid column. Therefore, in the liquid tank 930 according to the comparative example, air bubbles are generated by the liquid column colliding with the liquid surface. As shown in FIG. 30, in the liquid tank 930 according to the comparative example, the amount of liquid that has moved upward is larger than that of the liquid tank 30 according to the embodiment, and thus the liquid column collapses as the carriage 19 accelerates and moves in the −Y direction. Therefore, in the liquid tank 930, if the liquid column that has collapsed collides with the liquid surface, air bubbles are generated, and thus there is a risk that the generated air bubbles will flow into the filter chamber 542 via the liquid outlet 548, and a failure such as a printing error of the liquid ejection apparatus 1 may occur. In addition, in the case where the amount of generated air bubbles is large, it is difficult to accurately recognize the height of the liquid surface in the second liquid chamber 952.

FIG. 31 is a diagram for describing the movement of liquid in the second liquid chamber 952 of the liquid tank 930 according to the comparative example when the carriage 19 turns back. In the liquid tank 930 in FIG. 31, the second liquid chamber 52 contains liquid of the amount indicated by the lower limit sign M2, to which liquid has been used. Note that liquid contained in the liquid tank 930 is indicated by dots, and air bubbles included in the liquid are indicated by hollow circles. In the case where the amount of liquid contained in the second liquid chamber 952 is small, there are cases were the bottom face 404*fa* of the second liquid chamber 952 is exposed to air due to the movement of the liquid, as shown in FIG. 31. In the case where the liquid outlet 548 formed in the bottom face 404*fa* is exposed to air, there is a risk that air bubbles will flow into the filter chamber 542 via the liquid outlet 548, and a failure such as a printing error of the liquid ejection apparatus 1 may occur.

According to the above embodiment, in the mounted state, the liquid supply portion 50 is positioned below the downstream end 85, and extends downward toward the liquid supply port 505 (FIG. 8). Accordingly, it is possible to suppress an increase in the size of the liquid tank 30 in the horizontal direction. In addition, this makes it possible to allow liquid to flow smoothly from the liquid supply portion 50 to the liquid ejection head 12, and thus liquid can be efficiently supplied to the liquid ejection head 12.

In addition, according to the above embodiment, in the case of suctioning liquid in the liquid tank 30 from the liquid ejection head 12 side, and filling the liquid ejection head 12 or the like with the liquid, air extruded by liquid that has flowed into the air communication channel 70 can be released to the first liquid chamber 51 via the air communication channel 70. Thus, when filling the liquid ejection head 12 with liquid, it is possible to reduce the likelihood of air bubbles flowing into the liquid ejection head. In addition, according to the above embodiment, the valve mechanism 60 is brought into an open state by liquid in the first liquid chamber 51 being suctioned from the liquid ejection head 12, and the pressure of the liquid reaching a negative pressure, and thus the valve mechanism 60 is in a closed state when liquid is injected into the second liquid chamber 52 from the liquid inlet port 42 in which liquid has not been suctioned from the liquid ejection head 12. Thus, it is possible to suppress a flow, into the first liquid chamber 51, of air bubbles in the second liquid chamber 52 generated when liquid was injected from the liquid inlet port 42 into the second liquid chamber 52.

In addition, according to the above embodiment, the volume of the first liquid chamber 51 is smaller than that of the second liquid chamber 52, and thus in the case of suctioning air in the first liquid chamber 51, and discharging the air to the liquid ejection head 12, the amount of air that is suctioned can be reduced. Accordingly, a period of time during which air is suctioned can be shortened. In addition, according to the above embodiment, the air communication channel 70 is connected to the uppermost portion 519 of the first liquid chamber 51 in the mounted state (FIG. 8). Accordingly, it is possible to reduce the likelihood of liquid flowing into the air communication channel 70. In addition, at the time of initial filling or a discharging operation using the discharge portion 18 after initial filling, air on the liquid supply portion 50 side can be allowed to flow smoothly into the first liquid chamber 51 via the air communication channel 70.

In addition, according to the above embodiment, the small liquid chambers 521*a* to 521*n* are in communication with each other via the upper communication portions 641 and 642 and the lower communication portions 651 and 652 positioned at different heights. Accordingly, as liquid is consumed, air moves to an adjacent chamber out of the small liquid chambers 521*a* to 521*n* via the upper communication portions 641 and 642, and liquid moves to an adjacent chamber out of the small liquid chambers 521*a* to 521*n* via the lower communication portions 651 and 652. Thus, as liquid is consumed, air-liquid exchange between adjacent chambers out of the small liquid chambers 521*a* to 521*n* can occur smoothly, and thus as liquid is consumed, the liquid surfaces in the small liquid chambers 521*a* to 521*n* can be lowered in the same manner. Accordingly, it is possible to suppress the movement of liquid in the small liquid chambers 521*a* to 521*n* over the first division walls 610 and the second division walls 620, and thus it is possible to reduce the likelihood of air (air bubble) being contained in liquid when liquid is moving. In addition, in this embodiment, the lower communication portions 651 and 652 are formed below the upper limit sign M1 in the mounted state, and thus liquid can move with ease via the lower communication portions 651 and 652, compared with the case where the lower communication portions 651 and 652 are formed above the upper limit sign M1. Furthermore, the lower communication portions 651 and 652 are formed below the lower limit sign M2 in the mounted state, and thus it is possible to further suppress the movement of liquid in the small liquid chambers 521*a* to 521*n* over the first division wall 610. Accordingly, generation of air bubbles can be mitigated compared with the case where liquid moves over the first division walls 610 and the second division walls 620. Therefore, it is possible to further reduce the likelihood of air bubbles flowing to the liquid ejection head 12 side.

In addition, according to the above embodiment, the liquid tank 30 has the first division walls 610 that are perpendicular to the Y direction, in the second small liquid chamber 52. Therefore, the second liquid chamber 52 can be divided into the small liquid chambers 521*a* to 521*n*. The volumes of the small liquid chambers 521*a* to 521*n* are smaller than that of the second liquid chamber 52, and thus it is possible to suppress the rippling of liquid due to an abrupt change in acceleration due to movement of the carriage 19 in the Y direction. Accordingly, it is possible to mitigate the generation of air bubbles due to rippling. Therefore, it is possible to reduce the likelihood of air bubbles flowing to the liquid ejection head 12 side.

In addition, according to the above embodiment, the liquid tank 30 has the second division walls 620 that further partition the second liquid chamber 52 partitioned by the first division walls 610. Accordingly, the volumes of the small liquid chambers 521*a* to 521*n* can be further made smaller than the volume of the entire second liquid chamber 52, compared with the case where the second division walls 620 are not provided. In addition, it is possible to suppress the rippling of liquid in the second liquid chamber 52 in the X direction, compared with the case where the second division walls 620 are not provided. Rippling in the X direction is caused by vibrations when a recording medium is conveyed out from the liquid ejection apparatus 1 (FIG. 1), for example. Accordingly, it is possible to further suppress the rippling of liquid due to movement of the carriage 19, and further mitigate the generation of air bubbles.

In addition, according to the above embodiment, the first wall 101 that is a liquid visual recognition wall that makes it possible to visually recognize liquid in the second liquid chamber 52 from the outside is provided, and thus the amount of the liquid in the second liquid chamber 52 is easily recognized. In addition, the first division wall 610 makes it possible to view the liquid surface in which the generation of air bubbles is mitigated, and thus it is possible to more accurately recognize the amount of the liquid in the second liquid chamber 52.

In addition, according to the above embodiment, the division wall 600 is a body that is separate from the recessed portion 409. Therefore, the first division walls 610 and the second division walls 620 are easily formed in the second liquid chamber 52, compared with the case where the first division walls 610 and the second division walls 620 are not bodies that are separate from the recessed portion 409.

In addition, according to the above embodiment, the first upper communication portion 641 is formed by the gap between the upper end portions 611 of the first division walls 610 and the ceiling face 525 of the second liquid chamber 52, and the second upper communication portion 642 is formed by the gap between the upper end portion 621 of the second division wall 620 and the ceiling face 525 of the second liquid chamber 52. In addition, the first lower communication portion 651 is formed by the lower end recessed portion 613 provided in a lower end portion 612 of the first division wall 610, and the second lower communication portion 652 is formed by the lower end recessed portion 623 provided in the lower end portion 622 of the second division wall 620. Accordingly, it is possible to easily form the upper communication portions 641 and 642 and the lower communication portions 651 and 652.

In addition, according to the above embodiment, the opposing wall 630 is connected to a first division wall 610. In this case, another member for fixing the opposing wall 630 is not necessary, and thus the opposing wall 630 whose position is fixed can be easily provided.

B. Other Embodiments

Note that the invention is not limited to the above working examples and embodiment, and can be carried out in various aspects without departing from the gist thereof, and, for example, the following modifications are possible.

B-1. First Other Embodiment

The invention is not limited to an inkjet printer and a liquid tank for supplying ink to an inkjet printer, and can also be applied to any liquid ejection apparatus that ejects liquid other than ink and a liquid tank for containing the liquid. For example, the invention can be applied to the following various liquid ejection apparatuses and liquid tanks thereof.

(1) Image recording apparatuses such as a facsimile apparatus, (2) Color material ejection apparatuses used to manufacture color filters for image display apparatuses such as a liquid crystal display, (3) Electrode material ejection apparatuses used to form electrodes for organic EL (Electro Luminescence) displays, surface light emission displays (field emission displays, FED), or the like.

(4) Liquid ejection apparatuses that eject liquid containing biological organic matter used to manufacture biochips, (5) Sample ejection apparatuses serving as precision pipettes, (6) Lubricating oil ejection apparatuses, (7) Resin liquid ejection apparatuses, (8) Liquid ejection apparatuses that perform pinpoint ejection of lubricating oil to precision machines such as a watch and a camera, (9) Liquid ejection apparatuses that eject transparent resin liquid such as UV-cured resin liquid onto substrates in order to form micro-hemispherical lenses (optical lenses) or the like used in optical communication elements or the like,

(10) Liquid ejection apparatuses that eject acid or alkaline etchant in order to etch substrates or the like, and

(11) Liquid ejection apparatuses that include liquid ejection heads for discharging a very small amount of any other kinds of droplet.

Note that "droplet" refers to a state of a liquid discharged from a liquid ejection apparatus, and includes droplets having a granular shape, a tear-drop shape, and a shape with a thread-like trailing end. In addition, the "liquid" mentioned here need only be a material, which can be ejected by a liquid ejection apparatus. For example, the "liquid" need only be a material in a state where a substance is in a liquid phase, and a liquid material having a high or low viscosity, sol, gel water, and other liquid materials such as an inorganic solvent, organic solvent, solution, liquid resin, and liquid metal (metallic melt) are also included as a "liquid". Furthermore, the "liquid" is not limited to being a single-state substance, and also includes particles of a functional material made from solid matter, such as pigment or metal particles, that are dissolved, dispersed, or mixed in a solvent, or the like. In addition, representative examples of the liquid include ink such as that described in the above embodiment, liquid crystal, or the like. Here, the "ink" encompasses general water-based ink and oil-based ink, as well as various types of liquid compositions such as gel ink and hot melt ink.

B-2. Second Other Embodiment

In the above embodiment, the entire air second channel 73 serving as an inclined channel of the air communication channel 70 is inclined downward toward the air third channel 74, in the mounted state (FIG. 8), but there is no limitation thereto. For example, only the bottom face of the air second channel 73 may be inclined, in place of the entire air second channel 73. In addition, the air second channel 73 may be inclined upward toward the air third channel 74, in the mounted state. Even in these cases, similar to the embodiment, it is possible to prevent liquid that has flowed into the air second channel 73 from remaining in the air second channel 73. Therefore, it is possible to suppress blockage of the air second channel 73 with liquid that has flowed into the air second channel 73.

B-3. Third Other Embodiment

In the above embodiment, the liquid tank 30 has the second division walls 620, but does not need to have the second division walls 620.

B-4. Fourth Other Embodiment

In the above embodiment, the lower communication portions 651 and 652 are formed below the upper limit sign M1 in the mounted state, but do not need to be formed below the upper limit sign M1.

B-5. Fifth Other Embodiment

In the above embodiment, the division wall 600 is a body that is separate from the recessed portion 409, but the division wall 600 does not need to be a body that is separate from the recessed portion 409. For example, when forming the second liquid chamber 52, the division walls 600 may be formed through integral molding.

B-6. Sixth Other Embodiment

In the above embodiment, the first upper communication portion 641 is formed by the gap between the upper end portion 611 of the first division wall 610 and the ceiling face 525 of the second liquid chamber 52, and the second upper communication portion 642 is formed by the gap between the upper end portion 621 of the second division wall 620 and the ceiling face 525 of the second liquid chamber 52. In addition, the first lower communication portion 651 is formed by the lower end recessed portion 613 provided in the lower end portion 612 of the first division wall 610, and the second lower communication portion 652 is formed by the lower end recessed portion 623 provided in the lower end portion 622 of the second division wall 620. However, this is not necessary. For example, the upper communication portions 641 and 642 and the lower communication portions 651 and 652 may be formed by cutting the division wall 600.

B-7. Seventh Other Embodiment

In the above embodiment, the filter chamber 542 has the filter member 541, but does not need to have the filter member 541.

B-8. Eighth Other Embodiment

In the above embodiment, the opposing wall 630 is connected to the first division walls 610, but this is not necessary. The opposing wall 630 does not need to be connected to the first division wall 610. For example, the opposing wall 630 may be fixed by being connected to the bottom face 404*fa* of the second liquid chamber 52 via a supporting member.

B-9. Ninth Other Embodiment

In the above embodiment, the liquid tank 30 has the opposing wall 630 that is inclined relative to the horizontal direction, in the mounted state, but the invention is not limited thereto. For example, the liquid tank 30 may have the opposing wall 630 extending in a direction along the horizontal direction, in the mounted state. In addition, in the above embodiment, the height of the opposing wall 630 from the bottom face 404*fa* of the second liquid chamber 52 is a height that allows liquid to be held by a capillary force, but there is no limitation thereto. It suffices for the opposing wall 630 to be positioned below the upper limit sign M1. Even in this case, rippling of liquid in an upper portion of the liquid outlet 548 can be suppressed. In addition, the liquid tank 30 does not need to have the opposing wall 630.

B-10. Tenth Other Embodiment

In the above embodiment, three first division walls 610, four second division walls 620, and 14 small liquid chambers 521*a* to 521*n* are provided, but the number of the first division walls 610, second division walls 620, and small liquid chambers 521*a* to 521*n* is not limited thereto. The number of the first division walls 610, the second division walls 620, and the small liquid chambers 521*a* to 521*n* may be changed in accordance with the amount of liquid that can be contained in the liquid tank 30, the scanning speed of the carriage 19, and the like. It suffices that the number of first division walls 610 may be one or more, and the number of small liquid chambers 521*a* to 521*n* may be two or more. Note that it is preferred that two or more first division walls 610 are provided. Also, it is preferred that three or more of the small liquid chambers 521*a* to 521*n* are provided. In this case, the volumes of the small liquid chambers 521*a* to 521*n* can be made small, compared with the case where one first division wall 610 is provided or where one of the small liquid chambers 521*a* to 521*n* is provided.

B-11. Eleventh Other Embodiment

In the above embodiment, the liquid tank 30 includes the front face 404 that is a liquid visual recognition wall, but the front face 404 does not need to be a liquid visual recognition wall.

B-12. Twelfth Other Embodiment

In the above embodiment, the liquid outlet 548 that is an end portion of the filter chamber 542 is provided in the small liquid chamber 521*n*, but there is no limitation thereto. For example, the liquid outlet 548 may be provided in the small liquid chambers 521*a* to 521*m*, other than the small liquid chamber 521*n*.

In any of the above first to twelfth other embodiments, the small liquid chambers 521*a* to 521*n* are in communication with each other via the upper communication portions 641 and 642 and the lower communication portions 651 and 652 at different heights, and thus liquid flows to an adjacent chamber out of the small liquid chambers 521*a* to 521*n* via the lower communication portions 651 and 652. Therefore, it is possible to reduce the likelihood of air bubbles flowing to the liquid ejection head 12 side.

B-13. Thirteenth Other Embodiment

In the above embodiment, the liquid tank 30 includes the first division walls 610, but does not need to have the first division walls 610 in the case where the liquid tank 30 has the first division wall 610. Even in this case, the height of a wave that is formed in an upper portion of the liquid outlet 548 can be suppressed using the opposing wall 630. Accordingly, it is possible to reduce the likelihood of liquid outlet 548 coming into contact with air, and thus it is possible to reduce the likelihood of air bubbles flowing into the liquid ejection head 12.

B-14. Fourteenth Other Embodiment

In the above embodiment, the upper end portion 611 of a first division wall 610 is formed at a position above the upper limit sign M1, but there is no limitation thereto. For example, it suffices for the first division walls 610 to be higher than one-fourth of the height from the bottom face 404*fa* of the second liquid chamber 52 to the ceiling face 525. Also, it suffices for the second division walls 620 to be higher than one-fourth of the height from the bottom face 404*fa* of the second liquid chamber 52 to the ceiling face 525. Even in this case, rippling of liquid due to movement of the carriage 19 can be suppressed compared with the case where the first division walls 610 and the second division walls 620 are not provided. Therefore, it is possible to reduce the likelihood of air bubbles flowing to the liquid ejection head 12 side, by reducing the generation of air bubbles caused by rippling of a liquid.

B-15. Fifteenth Other Embodiment

In the above embodiment, the liquid tank 30 includes the first liquid chamber 51 between the second liquid chamber 52 and the liquid supply portion 50, but does not need to include the first liquid chamber 51. Accordingly, the liquid supply portion 50 may be immediately on the downstream side of the filter chamber 542.

The invention is not limited to the above-described embodiments, working examples, and modified examples, and can be achieved with various configurations without departing from the gist thereof. For example, the technical features in the embodiments, working examples, and modified examples that correspond to the technical features in the modes described in the summary of the invention can be replaced or combined as appropriate in order to solve some or all of the problems described above, or in order to achieve some or all of the above-described effects. In addition, a technical feature that is not described as essential in the specification can be deleted as appropriate.

What is claimed is:

1. A liquid tank that is mounted on a carriage provided with a liquid ejection head movable in a Y direction, and configured to contain liquid to be supplied to the liquid ejection head, the liquid tank comprising:
- a liquid chamber configured to contain the liquid;
- a liquid inlet port through which the liquid can be injected into the liquid chamber;
- an atmospheric air introduction portion for introducing atmospheric air into the liquid chamber;
- a liquid outlet provided in a bottom face of the liquid chamber; and
- a division wall arranged in the liquid chamber,
- wherein the division wall has first division walls perpendicular to the Y direction in a mounted state in which the liquid tank is mounted on the carriage, and
- the liquid chamber includes:
  - a plurality of small liquid chambers partitioned by the first division walls,
  - an upper communication portion that allows the plurality of small liquid chambers to be in communication with each other in the mounted state, and
  - a lower communication portion that is positioned below the upper communication portion in the mounted state, and allows the plurality of small liquid chambers to be in communication with each other.

2. The liquid tank according to claim 1,
- wherein the liquid chamber has a liquid visual recognition wall that is parallel to the Y direction that is a horizontal direction and a Z direction that is a direction along a gravity direction orthogonal to the Y direction, in the mounted state, and that makes it possible to visually recognize the liquid in the liquid chamber from the outside.

3. The liquid tank according to claim 2,
- wherein the liquid visual recognition wall has an upper limit sign indicating an upper limit of an amount of the liquid that is contained in the liquid chamber,
- the upper communication portion is formed above the upper limit sign in the mounted state, and
- the lower communication portion is formed below the upper limit sign in the mounted state.

4. The liquid tank according to claim 1,
- wherein two or more first division walls are provided, and three or more small liquid chambers are provided.

5. The liquid tank according to claim 1,
- wherein the division wall further has a second division wall that is parallel to the Y direction and the Z direction that is a direction along a gravity direction orthogonal to the Y direction, in the mounted state, and partitions the small liquid chambers.

6. The liquid tank according to claim 1,
- wherein the upper communication portion is formed by a gap between upper end portions of the first division walls and a ceiling face of the liquid chamber, and
- the lower communication portion is formed by lower end recessed portions provided in lower end portions of the first division walls.

7. The liquid tank according to claim 5,
- wherein the liquid chamber is formed by a recessed portion formed in a tank body of the liquid tank and a film member that seals an opening of the recessed portion, and
- the division wall is a body separate from the recessed portion.

8. The liquid tank according to claim 1,
- wherein the liquid outlet includes a filter member that catches an extraneous material in the liquid.

9. The liquid tank according to claim 1,
- wherein the liquid outlet is formed between one wall that define the liquid chamber and is perpendicular to the Y direction and the first division walls.

10. The liquid tank according to claim 1, further comprising:
- an opposing wall that is positioned above the liquid outlet, is positioned below a ceiling face of the liquid chamber, and is opposed to at least a portion of the liquid outlet, in the mounted state.

11. The liquid tank according to claim 10,
- wherein the opposing wall is inclined relative to the horizontal direction in the mounted state.

12. The liquid tank according to claim 10,
- wherein the opposing wall is connected to the first division walls.

13. A liquid tank that is mounted on a carriage provided with a liquid ejection head and movable in a Y direction, and configured to contain liquid to be supplied to the liquid ejection head, the liquid tank comprising:

a liquid chamber configured to contain the liquid;

a liquid inlet port through which the liquid can be injected into the liquid chamber;

an atmospheric air introduction portion for introducing atmospheric air into the liquid chamber;

a liquid outlet provided in a bottom face of the liquid chamber; and an opposing wall that is positioned above the liquid outlet and below a ceiling face of the liquid chamber, and is opposed to at least a portion of the liquid outlet, in a mounted state in which the liquid tank is mounted on the carriage.

14. The liquid tank according to claim 13, wherein the liquid chamber has a liquid visual recognition wall that is parallel to the Y direction that is a horizontal direction and a Z direction that is a direction along a gravity direction orthogonal to the Y direction in the mounted state, and that makes it possible to visually recognize the liquid in the liquid chamber from the outside, the liquid visual recognition wall has a lower limit sign indicating a reference of a lower limit of an amount of the liquid that is contained in the liquid chamber, and at least a portion of the opposing wall opposed to the liquid outlet is arranged at a position lower than or at the same height as a position of the lower limit sign, in the mounted state.

15. The liquid tank according to claim 13, further comprising:

a division wall arranged in the liquid chamber, wherein the division wall has a first division wall perpendicular to the Y direction in the mounted state, and the liquid outlet is formed between a wall face of the liquid chamber orthogonal to the horizontal direction and the first division wall opposed to the wall face in the mounted state.

* * * * *